US006546220B1

(12) United States Patent
Asakura et al.

(10) Patent No.: US 6,546,220 B1
(45) Date of Patent: Apr. 8, 2003

(54) IMAGE FORMING APPARATUS WITH PLURAL COLOR IMAGE FORMING UNITS MOVEABLE INTO IMAGE FORMING POSITION

(75) Inventors: Kenji Asakura, Osaka (JP); Masanori Yoshikawa, Osaka (JP); Noboru Katakabe, Kyoto (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 09/378,811

(22) Filed: Aug. 23, 1999

(30) Foreign Application Priority Data

Aug. 28, 1998 (JP) ..... 10-244031
Sep. 7, 1998 (JP) ..... 10-252955

(51) Int. Cl.[7] ..... G03G 15/01
(52) U.S. Cl. ..... 399/227
(58) Field of Search ..... 399/116, 117, 399/167, 226, 227

(56) References Cited

U.S. PATENT DOCUMENTS 4,839,690 A * 6/1989 Onoda et al. ..... 399/117
5,023,660 A * 6/1991 Ebata et al. ..... 399/167 X
5,128,715 A * 7/1992 Furuyama et al. ..... 399/116
5,132,728 A * 7/1992 Suzaki et al. ..... 399/167
5,313,255 A * 5/1994 Taniguchi et al. ..... 399/117
5,583,630 A * 12/1996 Kimura et al. ..... 399/227
5,610,701 A 3/1997 Terada et al. ..... 399/227 X
5,669,046 A * 9/1997 Yoshida et al. ..... 399/167
5,809,380 A * 9/1998 Katakabe et al. ..... 399/227
6,157,799 A * 12/2000 Asakura et al. ..... 399/167
6,185,396 B1 * 2/2001 Aizawa et al. ..... 399/302 X
6,249,663 B1 * 6/2001 Aizawa et al. ..... 399/167

FOREIGN PATENT DOCUMENTS

EP 827 049 3/1998

* cited by examiner

*Primary Examiner*—Fred L Braun
(74) *Attorney, Agent, or Firm*—Merchant & Gould, P.C.

(57) ABSTRACT

An image forming apparatus includes a plurality of image forming units having a developer, a charger, and a photosensitive member; a carriage for retaining the plurality of image forming units so that they can be removed and installed, and which rotates the plurality of image forming units between an image forming position and other positions; a laser exposing device for exposing the photosensitive member at an image forming position; an intermediate transfer belt for accepting a toner image formed on the photosensitive member at the image forming position, and forming a color image; an output shaft for coupling with at least one axis end portion of the photosensitive member in the image forming position in the axial direction of the photosensitive member, and positioning the photosensitive member at a proper position; a rotation stop portion for positioning the rotation orientation of the image forming units with respect to the axis of the photosensitive members; and a retransfer roller for transferring the color image formed on the intermediate transfer belt at a retransfer position onto recording paper. Thus, it is possible to retain the image forming unit precisely and reliably at a proper position.

57 Claims, 46 Drawing Sheets

IMAGE FORMING APPARATUS WITH PLURAL COLOR IMAGE FORMING UNITS MOVEABLE INTO IMAGE FORMING POSITION

BACKGROUND OF THE INVENTION

The present invention relates to an image forming apparatus that is applicable, for example, as a color printer, a color copying machine or a color facsimile. More specifically, the present invention relates to a color electrophotographic apparatus for forming color images by electrophotography, and to an image forming unit used in the same.

DESCRIPTION OF THE PRIOR ART

A conventional image forming apparatus is disclosed, for example, in Publication of Unexamined Patent Application (Tokkai) No. Hei 7-36246.

The following is an explanation of a conventional color image forming apparatus as disclosed in the same publication, with reference to FIG. 43. As shown in FIG. 43, an intermediate transfer belt unit 101 includes an intermediate transfer belt 102, a primary transfer roller 103, a secondary transfer roller 104, a cleaner roller 105, and a waste toner reservoir 106. Color images can be superimposed on the transfer belt 102. In the middle of the main body of this image forming apparatus, a group of image forming units 108 is provided. Four image forming units 107Bk, 107Y, 107M and 107C for black, yellow, magenta and cyan, each unit being of sector shape in cross section, are arranged circularly to form the group of image forming units 108. When an image forming unit 107Bk, 107Y, 107M or 107C is installed properly in the color image forming apparatus, mechanical driving systems and electrical connection systems are coupled between the image forming units 107Bk, 107Y, 107M and 107C and other portions of the color image forming apparatus via mutual coupling members, so that both sides are mechanically and electrically connected. The image forming units 107Bk, 107Y, 107M and 107C are supported by a supporter and collectively rotated by a motor, so that they can revolve around a non-rotatable cylindrical shaft 109. For image formation, the image forming units 107Bk, 107Y, 107M and 107C are successively moved by rotation to an image forming position 110, where they oppose the primary transfer roller 103 spanning the intermediate transfer belt 102. The image forming position 110 is also the exposure position for exposure with a laser signal beam 111.

Inside this image forming apparatus, a laser exposing device 112 is arranged horizontally below the group of image forming units 108. The laser signal beam 111 passes through a light path opening 113 between the image forming units 207M and 207C, and through an opening provided in the shaft 119, and enters a mirror 114, which is fixed inside the shaft 119. The laser signal beam 111 reflected by the mirror 114 enters the black image forming unit 107Bk positioned at the image forming position 110 through an exposure opening 115. Then, the laser signal beam 111 passes through a light path between a developing device 116 and a cleaner 117, arranged on the upper and the lower side in the image forming unit 107Bk, enters an exposure portion on the left side of a photosensitive member 118, and scans for exposure along the direction of the axis of the photosensitive member 118. The toner image formed on the photosensitive member 118 is transferred to the intermediate transfer belt 102. Then, the group of image forming units 108 rotates 90 degrees, so that the yellow image forming unit 107Y moves into the image forming position 110. An operation similar to the above formation of the black image is performed to form a yellow toner image overlaying the black toner image previously formed on the intermediate transfer belt 102. Similar operations as explained above are performed using the magenta and cyan image forming units 107M and 107C to compose a full color image on the intermediate transfer belt 102. After the full color image on the intermediate transfer belt 102 is completed, a recording paper is conveyed by a secondary transfer roller 104 and a tertiary transfer roller 119, and the color image is simultaneously transferred onto the recording paper. The recording paper onto which the color image has been transferred is conveyed to a fuser 120, which fuses the color image on the recording paper.

The above relates to an image forming apparatus as disclosed in Tokkai Hei 7-36246 etc., but these prior art examples do not disclose particular structures for retaining the image forming units precisely and reliably in the image forming apparatus, so that there is a need for the realization of such technological means.

Moreover, a color image forming apparatus for forming a color image with four image forming units by superimposing toner images on an intermediate transfer belt is known from Tokkai Hei 9-304996.

The following is an explanation of the conventional color image forming apparatus disclosed in this publication, with reference to FIGS. 44 and 45. FIG. 44 is a cross sectional view showing a positioning and driving mechanism for a photosensitive member in a conventional color image forming apparatus. FIG. 45 is a perspective view of the same.

As shown in FIGS. 44 and 45, flanges 402 are attached to both end portions of a drum-shaped photosensitive member 401, and one photosensitive member shaft 403 is attached to both flanges 402. A concave tapered surface 404 is formed on the right end of the photosensitive member shaft 403, and a coupling plate 406 having eight tongues 405 is attached around the photosensitive member shaft 403 forming the concave tapered surface 404. Thus, the photosensitive member 401 can be rotated by rotating the coupling plate 406.

The photosensitive member driving mechanism, which is provided at the apparatus main body, comprises a driving shaft 411, a coupling plate 412 rotating together with the driving shaft 411, a driving gear 413, and a driving motor. On the tip of the driving shaft 411, a convex tapered surface 414 is formed, which mates with the convex tapered surface 404 formed on the right end of the photosensitive member shaft 403.

The coupling plate 412 is provided with eight coupling tongues 418, which mesh with the coupling plate 406 on the side of the photosensitive member 401. The coupling plate 412 is fixed in rotation direction to the driving shaft 411 by a pin 415, but the coupling plate 412 is movable in the axial direction within a predetermined distance. Thus, the coupling plate 412 retreats temporarily when the tips of the coupling tongues 418 abut the tips of the coupling tongues 405. The coupling plate 412 is forced by a compression spring 416 to abut a tip stopper 417, which holds it in a certain position.

The driving shaft 411 is supported rotatably and displaceably in the thrust direction by bearings 422 that are fixed to a hosing-side plate 420 and a driving base plate 421. A driving shaft gear 413 meshing with a motor-side gear 423 is attached to the driving shaft 411 between the housing-side plate 420 and the driving base plate 421. A compression spring 424 is inserted between the bearing 422 and the driving shaft gear 413, and this compression spring 424 biases the driving shaft 411 in a direction separating it from the photosensitive member 401. By moving a thrust bearing 425, the driving shaft 411 can be moved against the force of the compression spring between a separated position and a coupling position When the image forming unit in the image forming position is being changed, the driving shaft 411 is positioned in a separated position, where it is separated from the photosensitive member shaft 403. Then, during the image forming operation, the driving shaft 411 is positioned in a coupling position, where the concave tapered surface 401 is coupled with the convex tapered surface 414, as shown in FIG. 44. In this coupling position, the coupling tongues 405 mesh with the coupling tongues 418, so that a driving force can be transmitted.

The above relates to a color image forming apparatus as disclosed for example in Tokkai Hei 9-304996, but in order to suppress relative positional misalignments in such a color image forming apparatus, there is a need for reliability and reproducibility of the positioning of the photosensitive member in this image forming apparatus as well as the matching of rotational speed variations. Moreover, there is also a need for making the apparatus smaller.

However, in such conventional configurations, the coupling portions are easily misaligned, and the retention of the photosensitive member is unreliable, which causes the problem that the precision of the positioning of the photosensitive member is low, and there are variations in the position of the photosensitive member due to external forces such as the driving force for the photosensitive member and the developing device.

The reason for these problems is that the concave tapered surface 404 and the convex tapered surface 414 have the same shape and mate with each other. It is difficult to make the photosensitive member 401 and the driving shaft 411 completely coaxial at the image forming position. As is shown in FIG. 46, if the central axes of the driving shaft 411 and the photosensitive member shaft 403 are tilted against each other, their two cone-shaped surfaces cannot be contacted over the entire peripheral direction. In this case, the concave tapered surface 404 and the convex tapered surface 414 contact each other only at the two points P1 and P2, of which P1 is on a surface including the two tilting center axes. If the concave tapered surface 404 and the convex tapered surface 414 contact each other only at two points like this, the contact area is small, so that the coupling portion easily shifts away, and the retention of the photosensitive member 401 becomes unreliable. Moreover, the rotation center of the photosensitive member 401 cannot be positioned with good reproducibility.

Moreover, in order to press the long convex tapered surface 414 against the concave tapered surface 404, the stroke over which the driving shaft 411 is shifted becomes long. As a result, a large waiting space has to be provided in the width direction inside the apparatus, which causes the problem that the width of the apparatus housing becomes larger, so that the apparatus main body becomes undesirably large.

Moreover, when the driving shaft 411 rotates the photosensitive member 401, a counterforce against the rotation driving acts on the tapered coupling portion. Thus, an unreliable coupling portion will shift away, and the rotation center of the photosensitive member 401 shifts undesirably.

Moreover, when the coupling portions of the photosensitive member shaft 403 and the driving shaft 411 are misaligned, the rotation speed of the photosensitive member 401 changes, which causes the problem that the positions at which the colors are superimposed on the intermediate transfer belt vary for each color.

Moreover, when the center axes of the photosensitive member shaft 403 and the driving shaft 411 are misaligned, the difference in the angular speed that is transmitted from the driving shaft 411 to the photosensitive member shaft 403 increases, which causes the problem that the positions at which the colors are superimposed on the intermediate transfer belt vary for each color.

Moreover, when the center axes of the photosensitive member shaft 403 and the driving shaft 411 are misaligned, the contact points between the coupling tongues 405 and 418 cannot be adjusted precisely, which causes the problem that the difference in the shapes of the contacting surfaces causes variations in the rotation speed for the photosensitive member 401, and the speed variations are different for each color.

Moreover, since the coupling tongues 405 and 418 that establish contact during the rotation driving change, there is the problem that variations in the pitch between the coupling tongues 405 and 418 cause variations in the angular speed of the photosensitive member 401, and as a result, different rotation variations are caused for each color, and relative positional misalignments occur for each color.

Moreover, while the driving shaft 411 is being moved toward the photosensitive member 401, when the tips of the coupling tongues 405 hit the tips of the coupling tongues 418, the photosensitive member 401 is moved in a direction that is perpendicular to the rotation axis so that the concave tapered surface 404 moves, and the driving shaft 411 cannot be coupled with the concave tapered surface 404, and as a result, there is the problem that it becomes impossible to position the photosensitive member 401 and to rotate Moreover, since the angle of the concave tapered surface 404 and the convex tapered surface 414 is large, there is the problem that their coupling becomes incomplete and unreliable. Furthermore, since the aperture circle at the end portion of the concave tapered surface 404 is small, sometimes it becomes impossible to insert the driving shaft 411 into the concave tapered surface 404.

Moreover, in order to make the coupling plate 412 movable on the driving shaft, a clearance is provided between the coupling plate 412 and the driving shaft 411, but to suppress too much play between the coupling plate 412 and the driving shaft 411, the sliding fitting portion between the coupling plate 412 and the driving shaft 411 has to be made long. As a result, there is the problem that the distance from the bearing 422 of the driving shaft 411 to the tip becomes longer, and the width of the apparatus housing becomes larger, so that the apparatus main body becomes undesirably large.

Moreover, when the driving shaft 411 moves in the direction of the photosensitive member 401, the inner peripheral surface of the coupling tongues 418 on the side of the driving shaft 411 may abut the outer peripheral surface of the coupling tongues 405 on the side of the photosensitive member 401, which causes the problem that the photosensitive member 401 cannot be moved in a direction perpendicular to the rotation axis. Moreover, conversely, the outer peripheral surface of the coupling tongues 418 on the side of the driving shaft 411 may abut the inner peripheral surface of the coupling tongues 405 on the side of the photosensitive member 401, which causes the problem that the photosensitive member 401 cannot be positioned in its proper position, even if pressure is applied to the driving shaft 411.

Moreover, load variations due to the meshing of the coupling tongues 405 and 418 bring about speed variations of the intermediate transfer belt, which causes the problem that the positions of the images that are superimposed on the intermediate transfer belt become misaligned.

SUMMARY OF THE INVENTION

It is an object of the present invention to solve the problems of the prior art, and to provide an image forming apparatus for outputting color images that successively changes a plurality of image forming units, wherein the image forming units can be retained precisely and reliably at their proper position within the image forming apparatus main body, and which can output high-quality images, and to provide an image forming unit for the same.

Moreover, it is an object of the present invention to provide a small image forming apparatus and image forming unit used in the same, wherein the reproducibility of the positioning of the photosensitive member in the image forming position as well as the conformance of the rotation speed variations for each color are improved, and with which relative positional misalignments for each color can be suppressed.

In order to achieve these objects, a first configuration of an image forming apparatus in accordance with the present invention comprises a plurality of image forming units having a rotator; image forming unit conveying means for switching the plurality of image forming units by moving them successively between an image forming position and a waiting position; a rotator support member for positioning the rotator that is in the image forming position in a proper position in an apparatus main body by coupling with at least one axial end portion of the rotator in the axial direction of the rotator and supporting the image forming units in a freely rotatable manner; and a rotation stop portion for positioning the rotational orientation of an axis of the rotator of the image forming units.

Examples of suitable rotators include a photosensitive member or a developing roller.

With this first configuration of an image forming apparatus, it is possible to precisely and reliably retain image forming units at their proper position in the apparatus main body with a simple configuration, even when a plurality of different image forming units is used. As a result, it is possible to realize an image forming apparatus that can output high-quality color images.

Moreover, it is preferable that the image forming apparatus according to the first configuration further comprises a rotator driving means for driving the rotator, the rotation stop portion being provided on the same side of the rotator in the axial direction as the rotator driving means. With this preferable configuration, it is possible to concentrate the parts on which loads act close to each other, so that by raising the precision and the robustness of these parts, the positioning can be made more reliable. As a result, it is possible to realize an image forming apparatus that can output high-quality color images. Moreover, it is preferable that one supporting position of the rotator axis, a driving force transmission position for driving force transmission with the driving means, and a rotation stop position for stopping rotation with the rotation stop portion are substantially on the same plane, which is perpendicular to the axis of the rotator. With this preferable configuration, the torque on one support position of the axis is cancelled, and the driving force due to the driving means hardly influences the other support position of the axis, so that it is possible to precisely and reliably retain image forming units at their proper position in the apparatus main body with a simple configuration. As a result, it is possible to realize an image forming apparatus that can output high-quality color images.

Moreover, it is preferable that in the image forming apparatus according to the first configuration, the rotator is a photosensitive member; the image forming units further comprise a developer, which is driven by a developer driving means; and the rotation stop portion is provided on the same side of the rotator in an axial direction as the developer driving means. With this preferable configuration, it is possible to concentrate the parts on which loads act even closer to each other, so that by raising the precision and the robustness of these parts, the positioning can be made more reliable. As a result, it is impossible to realize an image forming apparatus that can output high-quality color images. Moreover, in this case, it is preferable that one supporting position of the rotator axis, a driving force transmission position for driving force transmission with the driving means, and a rotation stop position for stopping rotation with the rotation stop portion are substantially on the same plane, which is perpendicular to the axis of the rotator.

Moreover, it is preferable that in the image forming apparatus according to the first configuration, the rotation stop portion stops the rotation of the image forming units on a surface that is substantially parallel to a line connecting the axis of the rotator and a rotation stop position. With this preferable configuration, no excessive counter-forces act on the support portion of the rotator axis, so that the rotator can be retained even more reliably.

Moreover, it is preferable that in the image forming apparatus according to the first configuration, the rotator is a photosensitive member; the image forming apparatus further comprises a developer and a developer driving means for driving the developer; and the rotation stop portion stops the rotation of the image forming units on a surface that is substantially parallel to a direction of a driving force exerted by the developer driving means. With this preferable configuration, no excessive counter-forces act on the support portion of the rotator axis, so that the rotator can be retained even more reliably. Moreover, in this case, it is preferable that the rotation stop portion stops the rotation of the image forming units near an action line of the driving force exerted by the developer driving means. With this preferable configuration, there are almost no excessive counter-forces on the support portion of the rotator axis, so that the rotator can be retained even more reliably.

Moreover, it is preferable that in the image forming apparatus according to the first configuration, the rotation stop portion is provided in the image forming unit conveying means. With this preferable configuration, a rotation stop portion can be provided at a position close to the image forming unit, so that the rotation of the image forming unit can be stopped reliably without providing, for example, a large protrusion in the image forming unit or the apparatus main body.

Moreover, it is preferable that in the image forming apparatus according to the first configuration, the rotator is a photosensitive member; the image forming apparatus further comprises a developer, a developer driving means for driving the developer, and a photosensitive member driving means for driving the photosensitive member; and at the time of image formation, the developer driving means starts to drive the developer after the photosensitive member driving means has started to drive the photosensitive member. With this preferable configuration, it is possible to precisely and reliably retain image forming units at their proper position in the apparatus main body with a simple configuration, even when the rotator axis is not sufficiently supported. As a result, it is possible to realize an image forming apparatus that can output high-quality color images.

Moreover, it is preferable that the image forming apparatus according to the first configuration further comprises a thrust stop portion for positioning the axial direction of the rotator of the image forming units, which is provided near the axis of the rotator. With this preferable configuration, the torque on the support position of the rotator axis becomes small, so that it is possible to smoothly support the axis, even when the image forming unit is tilted. Moreover, in this case, it is preferable that the rotation stop portion and the thrust stop portion are provided on the same side of the rotator in the axial direction. With this preferable configuration, the members relating to the positioning can be concentrated close to each other, so that the positioning precision can be improved.

Moreover, it is preferable that in the image forming apparatus according to the first configuration, the rotator is a photosensitive member; the image forming apparatus further comprises a developer, a developer driving means for driving the developer, and a photosensitive member driving means for driving the photosensitive member; and the direction of the torque on the axis of the photosensitive member due to the gravitational force of the image forming unit acting on the image forming unit is opposite to the direction of the torque on the axis of the photosensitive member due to the developer driving means, and the size of the torque due to the gravitational force of the image forming unit is smaller than the size of the torque due to the driving gear for the developer. With this preferable configuration, the rotation stop force of the image forming unit on the rotation stop portion is reduced, and the influence of gravity is reduced, so that a more reliable positioning becomes possible.

A first configuration of an image forming unit in accordance with the present invention comprises a rotator. The image forming unit is retained in a manner that it can be installed in or removed from an apparatus main body; a rotator support member on an apparatus main body side is coupled with at least one axial end portion of the rotator positioned in an image forming position, in the axial direction of the rotator to position the rotator in a proper position in an apparatus main body; and positioning of the rotational orientation of an axis of the rotator is performed with a rotation stop portion on the side of the apparatus main body. With this first configuration of an image forming unit, it is possible to realize an image forming unit that can be retained precisely and reliably at a proper position in the apparatus main body.

A second configuration of an image forming apparatus in accordance with the present invention comprises a plurality of image forming units having a rotator with flanges on both ends; a unit retaining member, which retains the plurality of image forming units, and switches the plurality of image forming units by moving them successively between an image forming position and a waiting position; an intermediate transfer member, which contacts the image forming unit positioned in the image forming position and successively accepts toner images of various colors from the image forming units, so as to form a colored toner image on its surface; and a positioning member for coupling with at least one of the flanges of the rotator by advancing and receding in the axial direction when being substantially coaxial with the rotator of the image forming unit that is positioned in the image forming position; wherein a coupling part for coupling with the positioning member is provided at the center of end surfaces of the flanges; wherein the coupling part is a concave tapered surface with a circular cross section having the axis of the rotator as a center axis; and wherein a tip of the positioning member is a convex spherical surface, whose rotation center is the center axis. With this second configuration of an image forming apparatus, it is possible even when the positioning member and the rotator are coupled while their axes are tilted against each other, the contact portions of the coupling portions are circles formed by the intersection between a plane perpendicular to the axis of the rotator and the concave tapered surface. Consequently, the rotator can be held and controlled over the entire periphery. As a result, it is possible to hold and position the rotator reliably.

It is preferable that in the image forming apparatus according to the second configuration, the tip of the concave tapered surface at the coupling part contacting the positioning member during positioning and coupling is provided with a tapered surface with circular cross section, whose tip angle is larger than that of the concave tapered surface, and which is in close opposition to a tip of the positioning member. With this preferable configuration, even when the concave tapered surface is deformed and the positioning member attempts to enter the concave tapered surface beyond a certain position, the tip of the positioning member abuts the tapered surface, which has a large tip angle. Consequently, it can be prevented that the positioning member enters much beyond a certain position into the tapered portion. Therefore, it is possible to set a small moving stroke in the axial direction for the positioning member. As a result, even when the moving stroke for the positioning member in the axial direction is small, the rotator is pressed securely by the positioning member, and the rotator can be retained securely.

It is preferable that in the image forming apparatus according to the second configuration, the tip of the concave tapered surface at the coupling part contacting the positioning member during positioning and coupling is provided with a flat surface, which is in close opposition to a tip of the positioning member. With this configuration, even when the concave tapered surface is deformed and the positioning member attempts to enter the concave tapered surface beyond a certain position, the tip of the positioning member abuts the flat surface. Consequently, it can be prevented that the positioning member enters much beyond a certain position into the tapered portion. Therefore, it is possible to set an even smaller moving stroke in the axial direction for the positioning member. As a result, the moving stroke for the positioning member in the axial direction can be set to be short while retaining the rotator securely, so that the apparatus main body can be made smaller.

It is preferable that in the image forming apparatus according to the second configuration, the positioning member is made of a conductive material and is electrically grounded; the flange coupling with the positioning member is made of an insulating material; a center of a coupling part of the flange is provided with a through hole connecting an inner portion of the rotator with an outer portion thereof; and an electrode member is provided inside the through hole, which is retained while being biased in the direction of the positioning member, and which establishes conduction between the rotator and the positioning member by contacting the positioning member. With this preferable configuration, the electrode member contacts the positioning member at the rotation center of the coupling portion where the relative displacement amount is the smallest, so that a secure electrical conduction can be established also during rotation. In addition, the flange and the positioning member rotate together, and there is no relative movement in the rotation direction between the two, so that an even more secure electrical conduction can be established.

It is preferable that in the image forming apparatus according to the second configuration, the convex spherical tip of the positioning member is provided with a flat portion that is perpendicular to the rotation axis. With this preferable configuration, the contact between the electrode member and the positioning member, which contact each other elastically, can be made more reliable, so that electrical conduction can be established more securely. Furthermore, even when the stroke in the axial direction of the positioning member is short, it is possible to pull out the positioning member from the concave tapered surface of the flange. Moreover, since the concave tapered surface of the flange contacts the spherical surface of the positioning member over the entire perimeter of a circle, it is possible to retain the photosensitive member securely, even when the spherical surface of the positioning member is short. As a result, the apparatus main body can be made smaller, since the moving stroke of the positioning member can be made short.

It is preferable that the image forming apparatus according to the second configuration further comprises a driving motor for generating a rotation force for the rotator; and a rotation transmission member provided in one piece with one positioning member, wherein transmission and disconnection of the rotation force is performed by substantially coaxial rotation with that rotator that is positioned in the image forming position, and advancing and receding in the axial direction of the rotator; wherein the flange opposing the rotation transmission member has, on an end surface, a rotation follower portion to which a rotation force is transmitted when it contacts the rotation transmission member. With this preferable embodiment, the coupling portion on the driving side for transmitting the angular speed does not vary, and the rotation center of the rotator can be defined reliably. As a result, variations of the rotation speed of the rotator can be suppressed, and it is possible to obtain a good image without color misalignments. Moreover, in this case, it is preferable that a contact portion for contact between the rotation transmission member and the rotation follower portion extends through a center of the convex spherical surface of the tip of the positioning member, and is at a position perpendicular to a rotation center axis of the rotation transmission member. With this preferable embodiment, positional misalignments due to speed variations are suppressed, and a high-quality image can be obtained. Moreover, in this case, it is preferable that at least one of the contact faces where the rotation transmission member contacts the rotation follower portions is provided with a protrusion. With this configuration, the contact point is usually the tip of the protrusion and does not change, so that rotation speed variations of the rotator, which are caused by the contact portion where the rotation transmission member contacts the rotation follower portion, can be suppressed. As a result, positional misalignments for each color due to speed variations can be suppressed, and it is possible to obtain a high-quality image.

A third configuration of an image forming apparatus in accordance with the present invention comprises a plurality of image forming units having a rotator with flanges on both ends; a unit retaining member, which retains the plurality of image forming units, and switches the plurality of image forming units by moving them successively between an image forming position and a waiting position; an intermediate transfer member, which contacts the image forming unit positioned in the image forming position and successively accepts toner images of various colors from the image forming units, so as to form a colored toner image on its surface; a positioning member for coupling at a coupling part at a center of an end surface of at least one of the flanges of the rotator by advancing and receding in the axial direction when being substantially coaxial with the rotator of the image forming unit that is positioned in the image forming position; a driving motor for generating a rotation force for the rotator; and a rotation transmission member provided in one piece with one positioning member, for which transmission and disconnection of the rotation force is performed by substantially coaxial rotation with the rotator that is positioned in the image forming position, and advancing and receding in the axial direction of the rotator; wherein an end surface of the flange opposing the rotation transmission member is provided with rotation follower portions made of a plurality of concave and convex portions; and wherein the rotation transmission member is provided with one transmission tongue for transmitting a rotation force by meshing with the rotation follower portions. With this third configuration of an image forming apparatus, the angular speed is always transmitted by the same tongue, so that there are no variations in the angular speed transmitted to the photosensitive member.

It is preferable that in the image forming apparatus according to the third configuration, the rotation transmission member is provided with at least one protrusion portion of the same height as the transmission tongue; and during rotation, the at least one protrusion portion enters a concave portion of the rotation follower portions, but does not contact the rotation follower portions. With this preferable configuration, there is no resulting counter-force on the rotation transmission member when the transmission tongue hits the tips of the tongues on the flange. Thus, it is possible to move the rotation transmission member smoothly in the axial direction. As a result, the transmission tongue can be meshed securely with the rotation follower portions when the rotation starts.

A fourth configuration of an image forming apparatus in accordance with the present invention comprises a plurality of image forming units having a rotator with flanges on both ends; a unit retaining member, which retains the plurality of image forming units, and switches the plurality of image forming units by moving them successively between an image forming position and a waiting position; an intermediate transfer member, which contacts the image forming unit positioned in the image forming position and successively accepts toner images of various colors from the image forming units, so as to form a colored toner image on its surface; a positioning member for coupling at a coupling part at a center of an end surface of at least one of the flanges of the rotator by advancing and receding in the axial direction when being substantially coaxial with the rotator of the image forming unit that is positioned in the image forming position; a driving motor for generating a rotation force for the rotator; and a rotation transmission member provided in one piece with one positioning member, for which transmission and disconnection of the rotation force is performed by substantially coaxial rotation with the rotator that is positioned in the image forming position, and advancing and receding in the axial direction of the rotator; wherein an end surface of the flange opposing the rotation transmission member is provided with rotation follower portions made of a plurality of concave and convex portions; wherein the rotation transmission member is provided with a transmission tongue for transmitting a rotation force by meshing with the rotation follower portions; and wherein, when a tip of the transmission tongue reaches a tip position of the rotation follower portions during the transition from a disconnected state to a connected state for the rotation force, the positioning member has advanced inside beyond an edge portion of the coupling part. With this fourth configuration of an image forming apparatus, when the transmission tongue reaches the tip position of the rotation follower portions, the tip of the positioning member enters beyond an edge portion of the coupling part of the flange, so that at the portion where the tongue abuts, the rotator can be moved in a radial direction, and the positioning member can be coupled securely with a coupling part of the flange.

It is preferable that in the image forming apparatus according to the fourth configuration, the coupling part comprises a concave tapered surface with circular cross section, which contacts the positioning member during positioning and coupling; and a tapered surface with circular cross section, which is provided at a tip of the concave tapered surface, and whose tip angle is greater than that of the concave tapered surface.

It is preferable that in the image forming apparatus according to the fourth configuration, at least a tip of the transmission tongue of the rotation transmission member is movable in a rotation direction with respect to the positioning member and biased toward the rotator. With this preferable configuration, the radial movement of the rotator is not hindered when the positioning member abuts the coupling part. Consequently, the rotator can be positioned even more securely in the image forming position, and the rotation speed can be transmitted precisely. Moreover, in this case, it is preferable that the transmission tongue of the rotation transmission member is formed only in a portion in a rotation circumferential direction, and the rotation transmission member is retained rotatably with respect to the positioning member around a rotation shaft that is provided perpendicularly to the rotation center axis at a peripheral portion where the transmission tongue is not formed. With this preferable configuration, it does not become long in the rotation axial direction, even when the coupling and sliding portion between the rotation center and the rotation transmission member is set to be long. As a result, the length from the bearing of the positioning member to its tip can be set short and without clearance, so that the apparatus main body can be made smaller. In this case, it is furthermore preferable that the rotation transmission member is provided with a posture defining means for defining a posture of the rotation orientation of the rotation transmission member. With this preferable configuration, the tip of the transmission tongue does not hit the bottom of the rotation follower portions of the flange, and the transmission tongue and the rotation follower portions of the flange usually mesh at the proper position. Moreover, in this case, it is furthermore preferable that the rotation shaft is provided at a position directly near an end surface of the flange that opposes the rotation transmission member during positioning and coupling. With this configuration, even when there is an intersection angle $\theta$ between the center axis of the driving shaft and the center axis of the rotator, the distance between the contact point where the transmission tongue contacts the rotation follower portions and the center axis of the driving shaft can be maintained substantially constant.

It is preferable that in the image forming apparatus according to the fourth configuration, a surface that opposes in the circumferential direction a surface where the transmission tongue and at least one of the rotation follower portions contact during rotation and driving is oblique in the circumferential direction. With this preferable configuration, the impact at the time of coupling during the moving in the axial direction can be reduced, and as a result, collision noise can be avoided.

It is preferable that in the image forming apparatus according to the fourth configuration, when a tip of the rotation transmission member reaches a tip position of the rotation follower portions while being moved toward the rotator, coupling between the positioning member and the coupling part is incomplete; and that at least one portion of the transmission tongue of the rotation transmission member is normally positioned between an outermost peripheral portion and an innermost peripheral portion of the rotation follower portions. With this preferable configuration, when the positioning member is moved toward the rotator and the rotator is being positioned, the inner peripheral surface of the tongues on the side of the positioning member cannot abut the outer peripheral surfaces of the tongues on the side of the rotator. Furthermore, the inner peripheral surface of the tongues on the side of the rotator cannot abut the outer peripheral surfaces of the tongues on the side of the positioning member. As a result, the rotator is moved securely in a radial direction, and the rotator can be positioned at its correct position.

A fifth configuration of an image forming apparatus in accordance with the present invention comprises a plurality of image forming units having a rotator with flanges on both ends; a unit retaining member, which retains the plurality of image forming units, and switches the plurality of image forming units by moving them successively between an image forming position and a waiting position; an intermediate transfer member, which contacts the image forming unit positioned in the image forming position and successively accepts toner images of various colors from the image forming units, so as to form a colored toner image on its surface; a driving motor for generating a rotation force for the rotator and the intermediate transfer member, which stops when the unit retaining member is being moved; a detection means for detecting a reference position of the intermediate transfer member after the driving motor has started; an exposure means for forming a latent image on the rotator, based on a detection signal from the detection means; a rotation transmission member for which transmission and disconnection of the rotation force is performed by substantially coaxial rotation with the rotator that is positioned in the image forming position, and advancing and receding in the axial direction of the photosensitive member; wherein an end surface of one of the flanges is provided in the circumferential direction with rotation follower portions made of a plurality of concave and convex portions, which transmit a rotation force by meshing with the rotation transmission member; wherein a pitch between neighboring concave and concave portions of the rotation follower portions is smaller than a rotation angle of the driving transmission member from the start of the driving motor until the generation of the detection signal. With this fifth configuration of an image forming apparatus, the reference position of the intermediate transfer member is detected after the driving tongue has meshed with the rotation follower portions, and after the speed of the intermediate transfer member has stabilized. As a result, the position of the image can be aligned precisely on the intermediate transfer member, because anomalous speed variations do not occur after the reference position has been detected.

It is preferable that in the image forming apparatus according to the fifth configuration, the pitch between neighboring concave and concave portions of the rotation follower portions is smaller than a rotation angle of the driving transmission member from the start of the driving motor until the acceleration of the driving motor to a predetermined speed. With this preferable configuration, the driving tongue and the rotation follower portions mesh while the driving motor is being accelerated. Therefore, the time from the meshing of the driving tongue and the rotation follower portions until the speed variations due to load variations have subsided becomes short. As a result, after the meshing of the driving tongue and the rotation follower portions, the speed of the intermediate transfer member stabilizes in a short time. As a result, if the reference position of the intermediate transfer member is detected after the driving motor is started, anomalous speed variations do not occur after the position has been detected, so that the positions of the images on the intermediate transfer member can be aligned precisely.

A second configuration of an image forming unit in accordance with the present invention comprises a rotator with flanges on both ends, and can be installed in and removed from an image forming apparatus comprising a unit retaining member, which retains a plurality of image forming units, and switches the plurality of image forming units by moving them successively between an image forming position and a waiting position; an intermediate transfer member, which contacts the image forming unit positioned in the image forming position and successively accepts toner images of various colors from the image forming units, so as to form a colored toner image on its surface; and a positioning member for coupling with at least one of the flanges of the rotator by advancing and receding in the axial direction when being substantially coaxial with the rotator of the image forming unit that is positioned in the image forming position, the tip of the positioning member being a convex spherical surface whose rotation center is the center axis; wherein a coupling part for coupling with the positioning member of the image forming apparatus is provided at the center of an end surface of the flanges; and wherein the coupling part is a concave tapered surface with a circular cross section having the axis of the rotator as a center axis.

It is preferable that in the image forming unit according to the second configuration, the tip of the concave tapered surface at the coupling part contacting the positioning member of the image forming apparatus during positioning and coupling is provided with a tapered surface with circular cross section, whose tip angle is larger than that of the concave tapered surface, and which is in close opposition to a tip of the positioning member.

It is preferable that in the image forming unit according to the second configuration, the tip of the concave tapered surface at the coupling part contacting the positioning member of the image forming apparatus during positioning and coupling is provided with a flat surface, which is in close opposition to a tip of the positioning member.

It is preferable that in the image forming unit according to the second configuration, the flange is made of an insulating material; a center of a coupling part of the flange is provided with a through hole connecting an inner portion of the rotator with an outer portion thereof; and an electrode member is provided inside the through hole, which is retained while being biased in the direction of the positioning member of the image forming apparatus, and which establishes conduction between the rotator and the positioning member by contacting the positioning member.

It is preferable that the image forming unit according to the second configuration further comprises a driving motor for generating a rotation force for the rotator; and a rotation transmission member provided in one piece with one positioning member, wherein transmission and disconnection of the rotation force is performed by substantially coaxial rotation with the rotator that is positioned in the image forming position, and advancing and receding in the axial direction of the rotator; and that the flange opposing the rotation transmission member has, on an end surface, a rotation follower portion to which a rotation force is transmitted when it contacts the rotation transmission member. Moreover, in this case, it is preferable that the contact portion between the rotation transmission member and the rotation follower portion goes through a center of the convex spherical portion of the tip of the positioning member at a coupling position, and is at a position perpendicular to a rotation center axis of the rotation transmission member. In this case, it is even more preferable that at least one of the contact faces where the rotation transmission member contacts the rotation follower portions is provided with a protrusion.

A third configuration of an image forming unit in accordance with the present invention comprises a rotator with flanges on both ends, and the image forming unit can be installed in and removed from an image forming apparatus comprising a unit retaining member, which retains a plurality of image forming units and switches the plurality of image forming units by moving them successively between an image forming position and a waiting position; an intermediate transfer member, which contacts the image forming unit positioned in the image forming position and successively accepts toner images of various colors from the image forming units, so as to form a colored toner image on its surface; a positioning member for coupling with at least one of the flanges of the rotator by advancing and receding in the axial direction when being substantially coaxial with the rotator of the image forming unit that is positioned in the image forming position; a driving motor for generating a rotation force for the rotator; and a rotation transmission member provided in one piece with one positioning member, and which has a transmission tongue for performing transmission and disconnection of the rotation force by substantially coaxial rotation with the rotator that is positioned in the image forming position, and advancing and receding in the axial direction of the rotator; wherein a coupling part for coupling with the positioning member of the image forming apparatus is provided at the center of an end surface of the flanges; wherein an end surface of the flange that opposes the rotation transmission member is provided with rotation follower portions made of a plurality of concave and convex portions; and wherein, when a tip of the transmission tongue reaches a tip position of the rotation follower portions during the transition from a disconnected state to a transmission state of the rotation force, the positioning member has advanced inside beyond an edge portion of the coupling part.

It is preferable that in the image forming unit according to the third configuration, the coupling part comprises a concave tapered surface with circular cross section, which contacts the positioning member during positioning and coupling; and a tapered surface with circular cross section, which is provided at the tip of the concave tapered surface, and whose tip angle is greater than that of the concave tapered surface.

It is preferable that in the image forming unit according to the third configuration, a surface that opposes in a circumferential direction a surface of the rotation follower portion that contacts the transmission tongue during rotation and driving is oblique in a circumferential direction.

It is preferable that in the image forming unit according to the third configuration, when a tip of the transmission tongue reaches a tip position of the rotation follower portions while being moved toward the rotator, coupling between the positioning member and the coupling part is incomplete; and that at least one portion of the transmission tongue of the rotation transmission member is normally positioned between an outermost peripheral portion and an innermost peripheral portion of the rotation follower portions.

A fourth configuration of an image forming unit in accordance with the present invention comprises a rotator with flanges on both ends, and the image forming unit can be installed in and removed from an image forming apparatus comprising a unit retaining member, which retains the plurality of image forming units and switches the plurality of image forming units by moving them successively between an image forming position and a waiting position; an intermediate transfer member, which contacts the image forming unit positioned in the image forming position and successively accepts toner images of various colors from the image forming units, so as to form a colored toner image on its surface; a driving motor for generating a rotation force for the rotator and the intermediate transfer member, which stops when the unit retaining member is being moved; a detection means for detecting a reference position of the intermediate transfer member after the driving motor has started; an exposure means for forming a latent image on the image forming unit, based on a detection signal from the detection means; a rotation transmission member for which transmission and disconnection of the rotation force is performed by substantially coaxial rotation with the rotator that is positioned in the image forming position, and advancing and receding in the axial direction of the photosensitive member; wherein an end surface of one of the flanges is provided in circumferential direction with rotation follower portions made of a plurality of concave and convex portions, which transmit a rotation force by meshing with the rotation transmission member; wherein a pitch between neighboring concave and concave portions of the rotation follower portions is smaller than a rotation angle of the driving transmission member from the start of the driving motor until the generation of the detection signal.

It is preferable that in the image forming unit according to the fourth configuration, a pitch between neighboring concave and concave portions of the rotation follower portions is smaller than a rotation angle of the driving transmission member from the start of the driving motor until the acceleration of the driving motor to a predetermined speed.

DESCRIPTION OF THE PREFERRED EMBODIMENTS

The following is a detailed explanation of the invention with reference to the preferred embodiments.

First Embodiment

The following is an explanation of a first embodiment of an image forming apparatus in accordance with the present invention, with reference to FIGS. 1 to 4.

Figure 1:
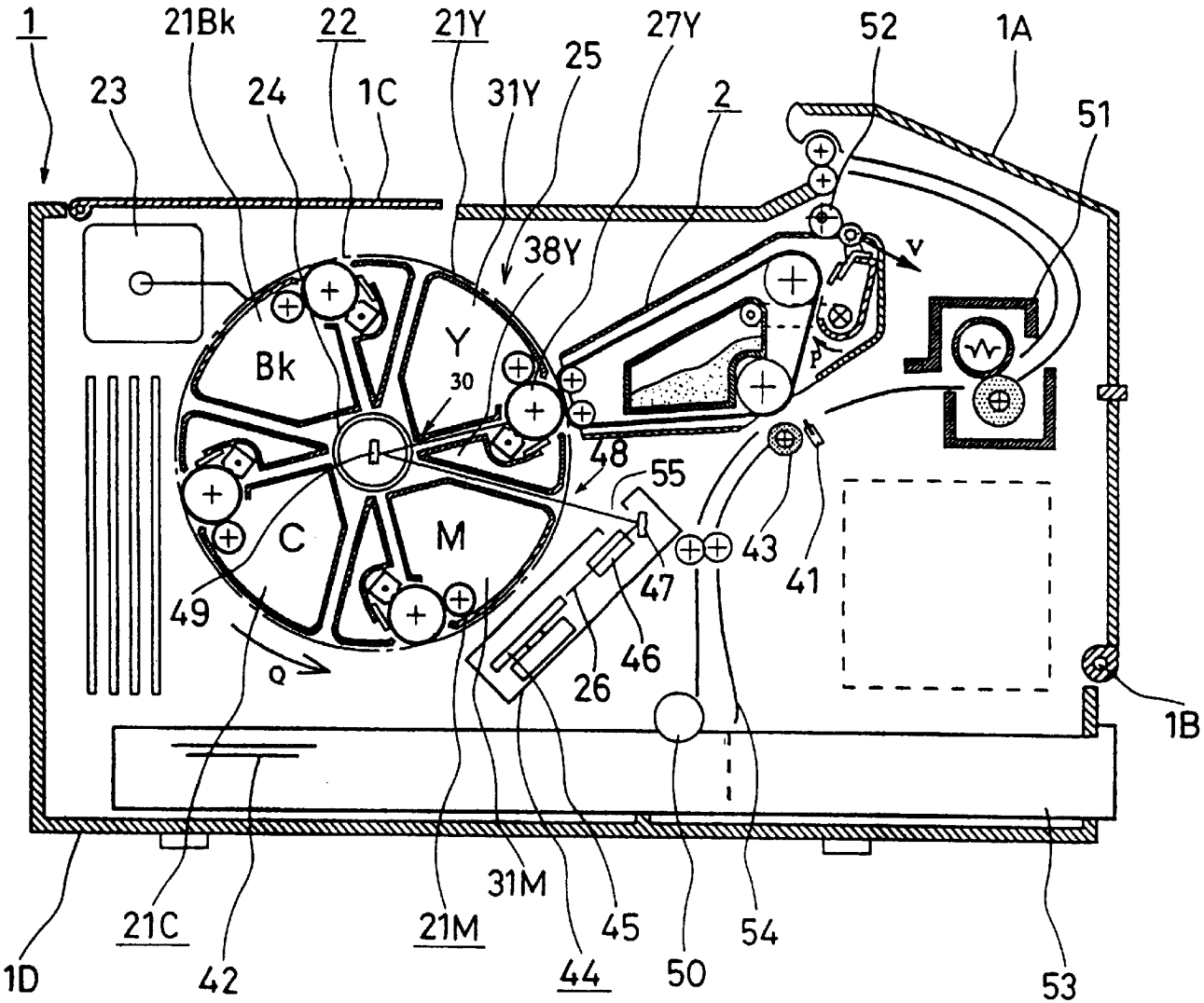
FIG. 1 is a diagrammatic cross sectional view illustrating the configuration of a first embodiment of an image forming apparatus according to the present invention.
Figure 2:
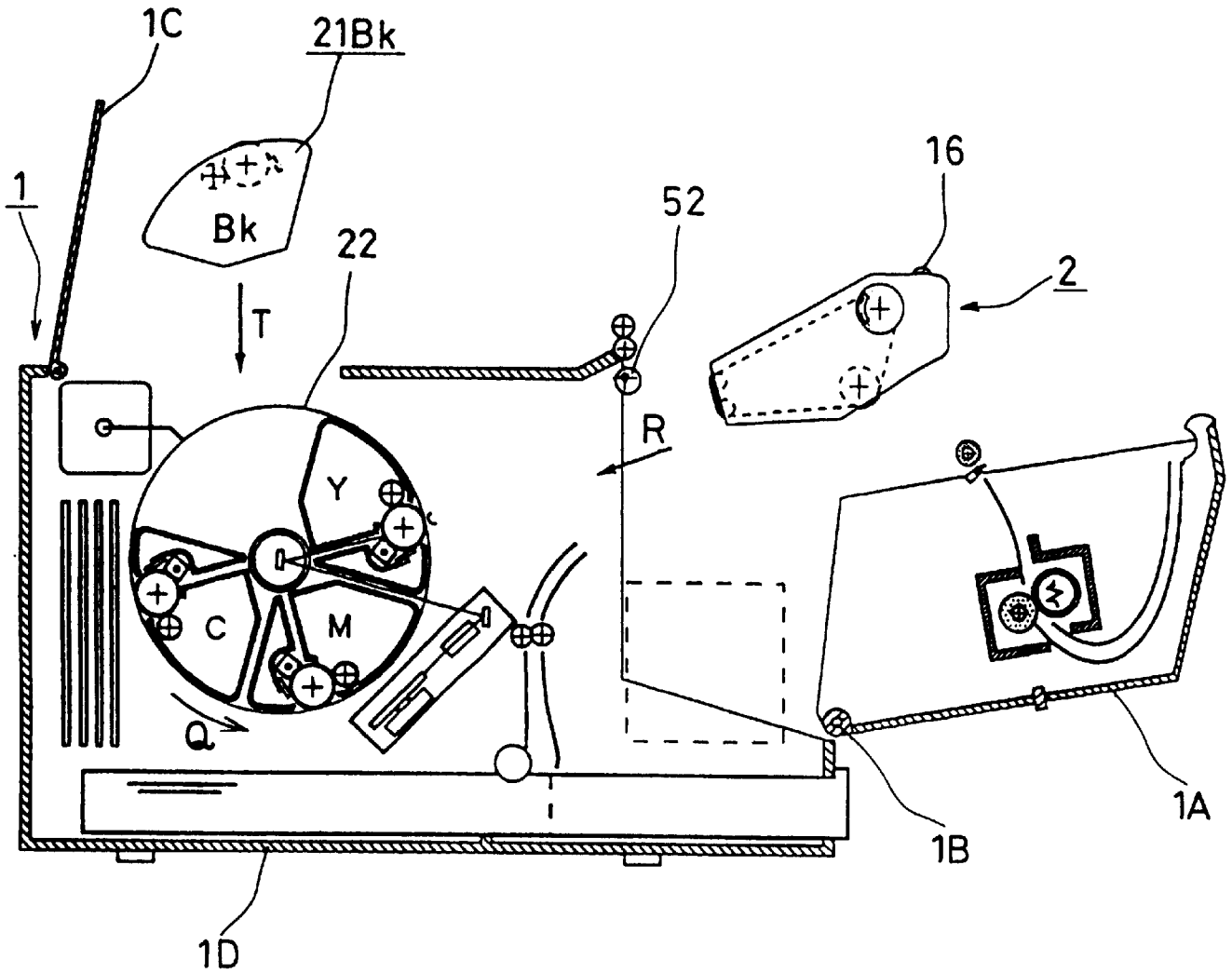
FIG. 2 is a diagram showing how the image units can be installed in and removed from the first embodiment of an image forming apparatus according to the present invention.

In FIG. 1, numeral 1 denotes the printer main body of an image forming apparatus, with the right-hand face being the front face of the apparatus. Numeral 1A denotes a printer front panel. The printer front panel is hinged on a hinge axis 1B on the lower side of an outer printer housing 1D, and can be tilted and opened toward the front. FIG. 2 shows the situation when the printer front panel 1A is tilted and opened. For maintenance of the printer internal parts, such as during the removal of paper jams, the printer front panel 1A is opened, and the internal parts of the printer are laid open.

Figure 3:
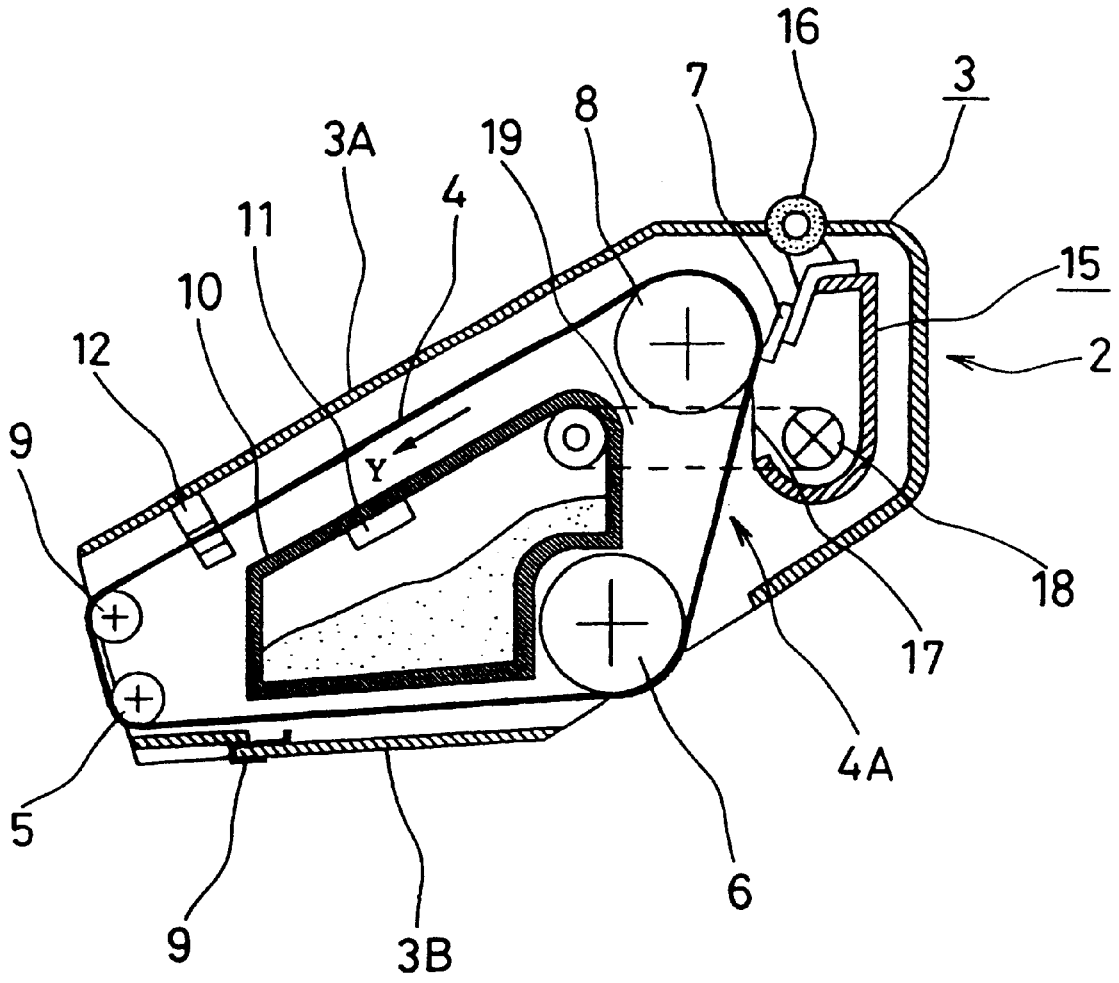
FIG. 3 is a cross sectional view illustrating the configuration of the intermediate transfer belt unit used in the first embodiment of an image forming apparatus according to the present invention.
Figure 4:
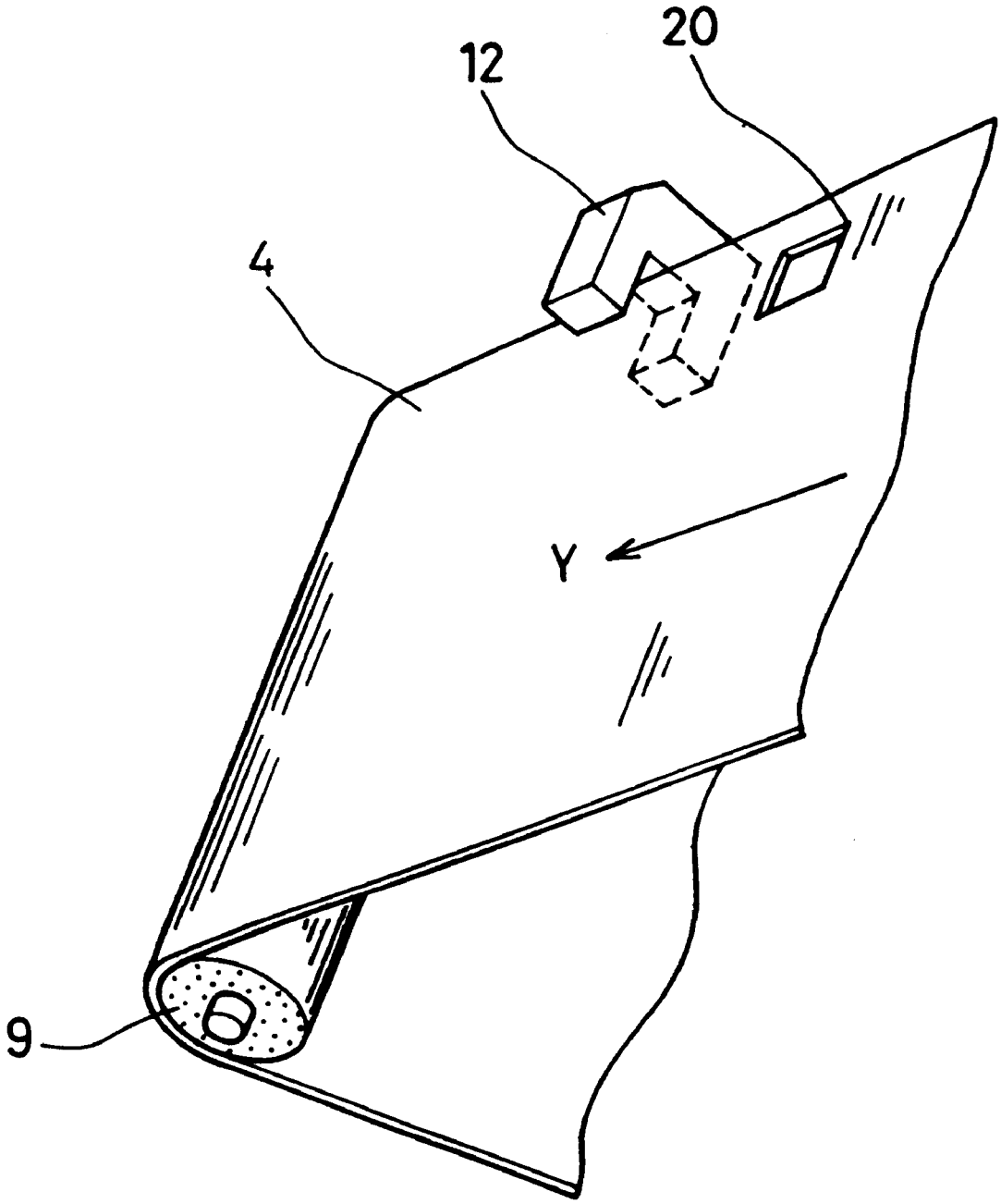
FIG. 4 is a perspective view illustrating the configuration of the intermediate transfer belt used in the first embodiment of an image forming apparatus according to the present invention.

FIG. 3 shows an intermediate transfer belt unit. As is shown in FIG. 3, the intermediate transfer belt unit 2 includes a unit case 3, an intermediate transfer belt 4, a transfer guide roller 9, a retransfer backup roller 6, a driving roller 8, and a tension roller 5 for suspending the intermediate transfer belt 4, a waste toner reservoir 10 for collecting waste toner, a waste toner overflow detector 11, a position detector 12, and a cleaner unit 15. The driving roller 8 receives its driving power from a driving means (not shown in the drawings) in the printer main body 1, and drives the intermediate transfer belt 4 in the arrow direction Y. The cleaning unit 15 includes a cleaning blade 7, a toner catcher 17, and a cam follower 16, and is attached rockably around a rocking axis 18. The cleaning unit 15 is biased against the driving roller 8 by means of, for example, a spring (not shown in the drawings), so that the cleaning blade 7 abuts the driving roller 8 through the intermediate transfer belt. A disjunction cam is provided in the printer main body 1 (see FIGS. 1 and 2), and this disjunction cam is coupled with the cam follower 16 when the intermediate transfer belt unit 2 is installed in the printer main body. The cleaner unit 15 and the waste toner reservoir 10 are connected via a communicating hole 19, and waste toner that a cleaning blade 7 has scraped off by a known means, such as a screw shaft, is transported into the waste toner reservoir 10, which is arranged inside the intermediate transfer belt 4.

The intermediate transfer belt 4 has a thickness of 100–500 μm and is made of a urethane film of a semiconducting (medium electrical resistance) endless belt, which is coated with a fluororesin such as PFA or PTFE.

The perimeter of the intermediate transfer belt 4 is 377 millimeters, which corresponds to the length of the maximally acceptable A4 recording paper size (297 mm) plus a little bit more (80 mm) than half the perimeter of the photosensitive member (30 mm diameter), so that A4 size and letter size recording paper sheets can be used for full color printing. With this arrangement, the perimeter of the intermediate transfer belt 4 from the retransfer position of the retransfer backup roller 6 to position where the cleaning blade 7 abuts the driving roller 8 is set to 75 mm, thus a little shorter than 80 mm.

The travel speed of the intermediate transfer belt 4 is about 1.5% faster than the image forming speed of the image forming units (100 mm/s, which is equal to the circumferential speed of the photosensitive member), which prevents the thinning out of the toner image in the middle.

During the transfer of the toner image onto the photosensitive member, a high voltage source, which is not shown in the drawings, applies a voltage of about +2.5 kV (about 100 μA) to the transfer guide roller 9 and the tension roller 5. Sometimes when the transfer guide roller 9 abuts against the photosensitive member, and the toner image is being transferred onto the intermediate transfer belt 4, the intermediate transfer belt 4 "jumps forward" before it contacts the photosensitive member, thereby corrupting the image, and it is difficult to adjust the contact pressure between the transfer guide roller 9 and the photosensitive member to be constant. However, with the configuration of the present embodiment, in which the intermediate transfer belt 4 is suspended between the transfer guide roller 9 and the tension roller 5 and contacts the photosensitive member, such problems do not occur.

The diameter of the driving roller 8 and the retransfer backup roller 6 is 30 mm. Moreover, the diameter of the tension roller 5 and the transfer guide roller 9 is 15 mm. The perimeter of the intermediate transfer belt 4 is set to be an integer multiple of the outer perimeter of each roller. This way, misalignments of the colors can be prevented. Numeral 20 in FIG. 4 denotes a detection hole for detecting the position of the intermediate transfer belt 4. A position detector 12 optically detects the passing of this detection hole 20 to determine the start position of the toner image. Thus, it is possible to align the position of the color images on the intermediate transfer belt 4.

Here, an optical position detection means is used for the position detection means, but there is no limitation to this, and it is also possible to use a position detection means that does not use an optical detection method, but for example a mechanical, electrical, magnetic or any other method. carriage 22 and a transport motor 23, constituting an image forming unit conveying means, are arranged on the center left side of the printer main body 1. Four image forming units 21Y, 21M, 21C and 21Bk for yellow, magenta, cyan, and black, each unit being substantially of sector shape in cross section, are arranged and retained circularly in the carriage 22. The image forming units 21 are mounted removably in certain positions in the carriage 22, and when one of the image forming units 21 needs to be replaced, it easily can be replaced with a new unit after rotating the carriage 22 so that the image forming unit 21 to be exchanged is located directly under the printer top panel 1C, and opening the printer top panel 1C to exchange the image forming unit 21 through the insertion port, as shown in FIG. 2. As will be explained below, when the image forming units 21 are set properly in the printer main body 1, mechanical driving systems and electrical connection systems are established between the image forming units 21 and the other parts in the printer main body 1 via mutual coupling members, so that both sides are mechanically and electrically connected. The carriage 22 is driven by the transport motor 23, and can be rotated around the fixed non-rotating cylindrical shaft 24, while retaining the image forming units. At the time of image formation, each image forming unit is successively rotated to an image forming position 25, where it opposes a transfer position between a transfer guide roller 9 and a tension roller 5, supporting the intermediate transfer belt 4. The image forming position 25 is also the exposure position for exposure by a pixel laser signal beam 26. The image forming units 21 perform the image forming operation only in this position, and do not operate at other positions (waiting positions).

Figure 10:
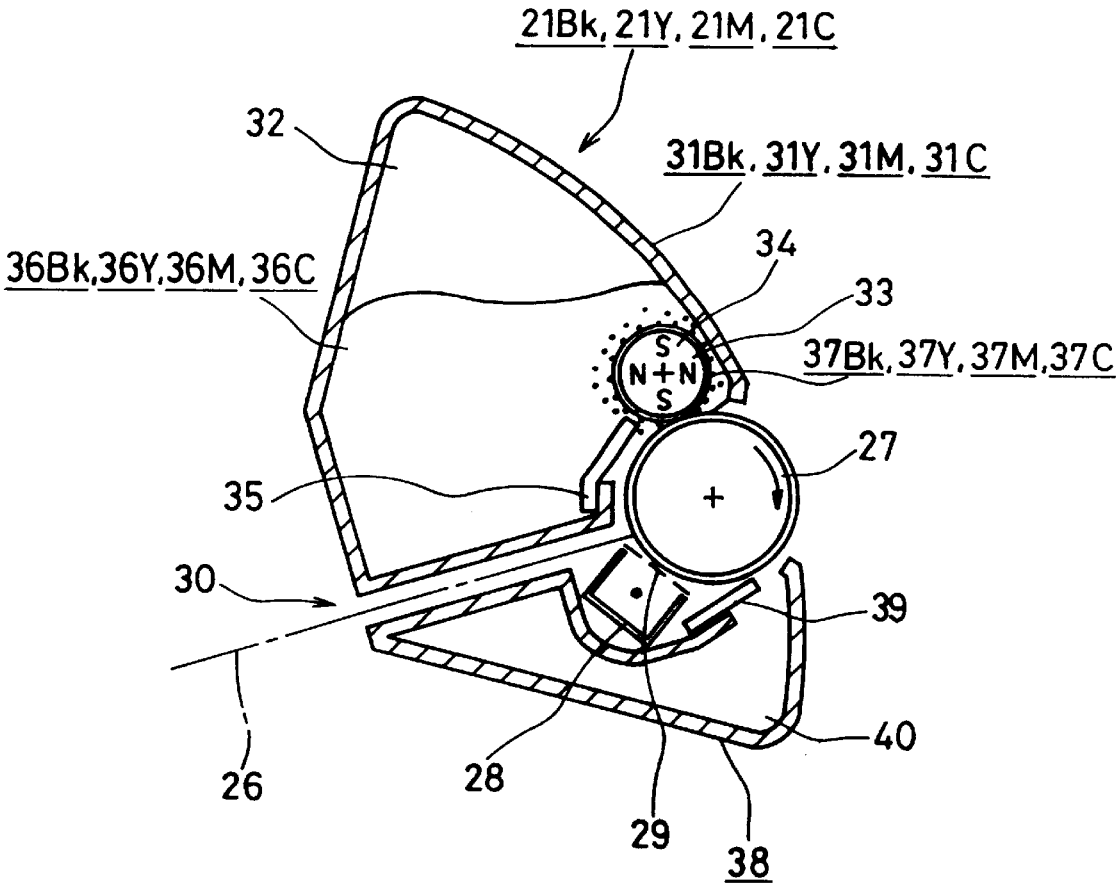
FIG. 10 is a diagrammatic cross sectional view illustrating the configuration of a first embodiment of an image forming unit according to the present invention.

FIG. 10 shows an image forming unit. The image forming units differ only with respect to the developer they contain, and all other structural aspects are the same, so that the following explanations only relate to the image forming unit 21Bk for black, and the explanation for all other colors have been omitted for brevity. The same parts have the same numbers for all colors, and where it is necessary to make a distinction, letters indicating the color are supplemented to the number. In FIG. 10, numeral 26 denotes the pixel laser signal beam also shown in FIG. 1, numeral 27 denotes an organic photosensitive member using phtalocyanine as the photosensitive material and having a polycarbonate binder resin as a main component, numeral 28 denotes a corona charger for charging the photosensitive member 27 with a negative charge, numeral 29 denotes a grid for keeping the charge potential of the photosensitive member 27 constant, numeral 30 denotes an exposure window that is opened so that the pixel laser signal beam 26 can enter the image forming unit 21, and numeral 31Bk denotes a black developer. The developer 31 includes a toner hopper 32, a developing roller 33, a magnet 34, and a doctor blade 35. Negatively charged black toner 36Bk, including a polyester resin in which a black pigment has been dispersed, is filled into the toner hopper 32. This black toner 36Bk is mixed with a ferrite carrier of 50 μm particle size, whose surface is coated with a silicon resin, and is supported by the surface of the developing roller 33 as a two-component developer 37Bk, where it develops the photosensitive member 27. Numeral 38 denotes a cleaner for cleaning off toner that remains on the surface of the photosensitive member 27 after the transfer. This cleaner 38 includes a cleaning blade 39 made of rubber, and a waste toner reservoir 40 for collecting waste toner. The diameter of the photosensitive member 27 is 30 mm, and it rotates with a speed of 100 mm/s in the direction indicated by the arrow. The diameter of the developing roller 33 is 16 mm, and it rotates with a speed of 140 mm/s. The sector angle of the image forming units 21 is 90°, which breaks down into about 30° for the cleaner 38 and about 60° for the developer 31.

The following is a further explanation of FIG. 1. In FIG. 1, numeral 41 denotes a discharging needle, which prevents the toner image on the recording paper 42 from being corrupted when the recording paper 42 is separated from the intermediate transfer belt 4 (see FIG. 3). Numeral 43 denotes a retransfer roller, serving as a retransfer means, which abuts the retransfer backup roller 6 (see FIG. 3) through the intermediate transfer belt 4. This retransfer roller 43 rotates 1.5% faster than the intermediate transfer belt 4, in order to prevent the thinning out of the toner image in the middle.

Numeral 53 denotes a paper feed unit for storing recording paper 42. This paper feed unit 53 is installed in the lower part of the printer main body 1. Numeral 54 denotes a paper guide, which serves as a paper conveying path for conveying the recording paper 42 from the paper feed unit 53 to the retransfer roller 43. Numeral 50 denotes a feeding roller.

Numeral 44 denotes a laser exposure device, which includes a semiconductor laser (not shown in the drawings), a polygon mirror 45, a lens system 46, an intermediate mirror 47, and a laser beam emission window 55. The laser exposure device 44 is arranged in the space within the outer printer housing 1D that is enclosed by the carriage 22, the intermediate transfer belt unit 2, the paper feed unit 53, and the paper guide 54. Numeral 49 denotes a center mirror, whose reflective surface is fixed within a shaft 24, so that it is less than 30 from the horizontal plane. The laser exposure device 44 irradiates a pixel laser signal beam 26 corresponding to a transient serial electrical pixel signal of image information onto the intermediate mirror 47. The pixel laser signal beam 26 reflected at the intermediate mirror 47 is irradiated into the beam path window 48 that is formed between the cleaner 38Y of the yellow image forming unit 21Y and the developer 31M of the magenta image forming unit 21M, through a window that is opened in one portion of the shaft 24, and onto the center mirror 49 at an elevation angle of 18°, where it is reflected and enters the image forming unit 21Y, which is positioned at the image forming position 25, through an exposure window 30 of the image forming unit 21Y. Then, this pixel laser signal beam 26 is irradiated through a path between the developer 31Y and the cleaner 38Y located in an upper and a lower portion in the image forming unit 21Y, and at an elevation angle of 12° onto an exposure portion of the left side surface of the photosensitive member 27Y, so as to scan and expose the photosensitive member 27Y in a main the axial direction.

Since the gap between the wall surfaces of the image forming units 21Y and 21M is used for the beam path from the beam path window 48 to the center mirror 49, almost no space in the carriage 22 is wasted. Moreover, since the center mirror 49 is employed in the center of the carriage 22, it can be made of a fixed single mirror, which allows a simple configuration with easy alignment etc. Moreover, since the laser exposure device 44 is arranged in the space enclosed by the carriage 22, the intermediate transfer belt unit 2, the paper feed unit 53, and the paper guide 54, and the rotation plane of the polygon mirror 45 is tilted with respect to the horizontal plane, the space inside the device is used efficiently, which facilitates its miniaturization.

It is preferable that the angle of incidence of the pixel laser signal beam 26 onto the intermediate mirror 47 and the center mirror 49 is not more than 30°. If it is 30° or more, the aberrations of the laser beam in the reflection plane become large, which may lead to a deterioration of the image quality. Moreover, since the image forming position 25 and the laser exposure device 44 have to be arranged so as to be separated from each other, miniaturization becomes difficult.

There is no particular restriction with regard to the orientation of the reflection planes of the intermediate mirror 47 and the center mirror 49, but it is preferable that they are tilted downward with respect to the horizontal plane, so as to minimize possible staining with toner.

The pixel laser signal beam 26 is irradiated onto the center mirror 49 through the gap between the wall faces of the image forming units 21Y and 21M. In other words, sandwiching the beam path of the pixel laser signal beam 26 (i.e. the path between the developer 31Y and the cleaner 38Y), which is reflected at the center mirror 49 and irradiated onto the photosensitive member 27Y, the pixel laser signal beam 26 is irradiated onto the center mirror 49 from the opposite side of the developer 31Y of the image forming unit 21Y. With this arrangement, it is also possible to increase the capacity of the toner hopper 32Bk of the black image forming unit 21Bk without changing the arrangement of the other structural elements, which can be useful to make the capacity of the black image forming unit, which is used more frequently, larger than that of the other image forming units. For example, the sector angle of the black image forming unit 21Bk can be 120°, and that of the yellow, magenta, and cyan image forming units 21Y, 21M, and 21C can be 80° each, breaking down into 90° for the developer 31Bk, 30° for the cleaner 38Bk, 50° for the developers 31Y, 31M, and 31C, and 30° for the cleaners 38Y, 38M, and 38C.

Numeral 51 denotes a fixing device, which is arranged in an upper portion within the printer main body.

The following is an explanation of a positioning mechanism and a driving mechanism for performing precise color alignment of all colors in the image forming position, with reference to FIGS. 5 to 9.

Figure 5:
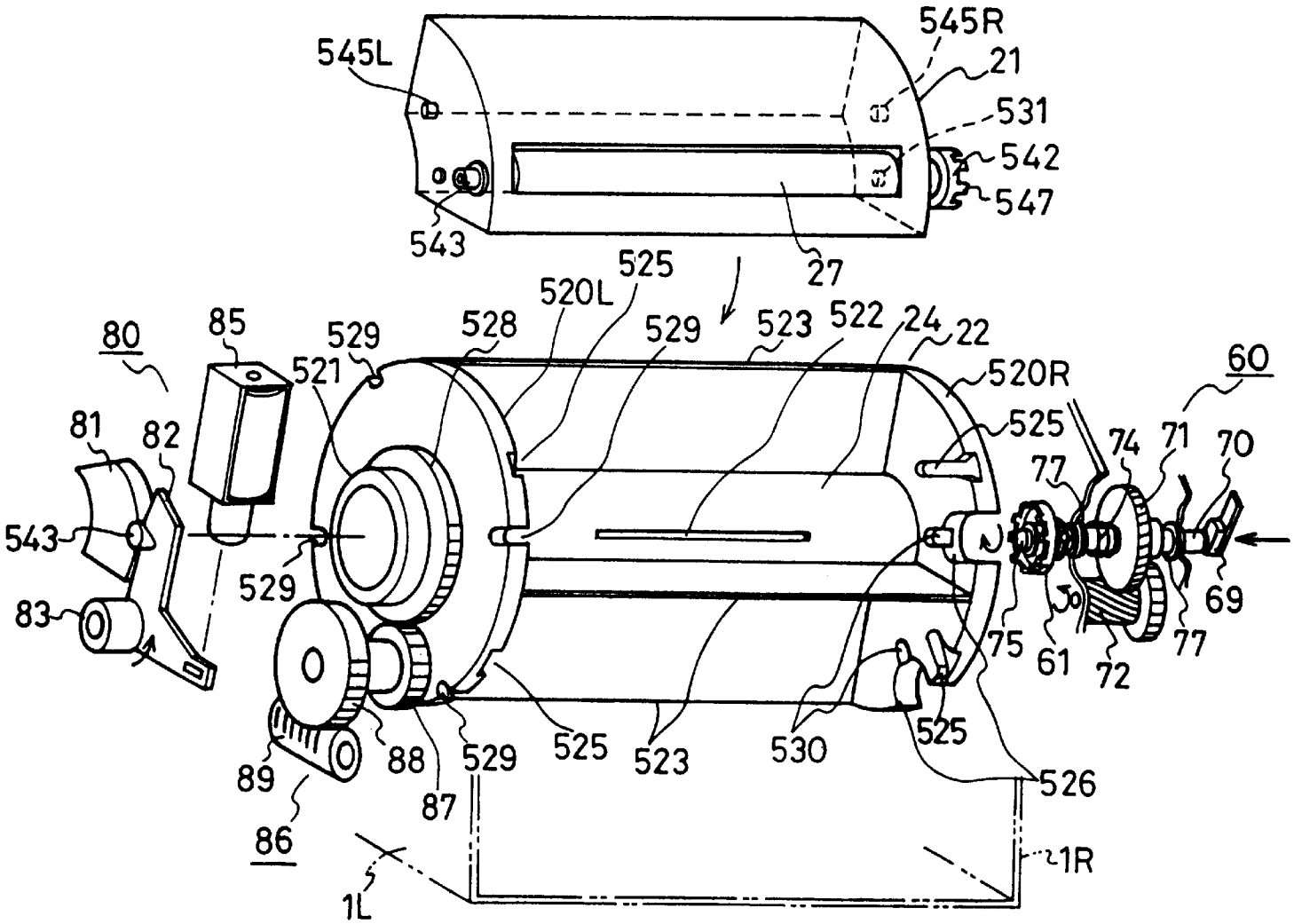
FIG. 5 is an exploded perspective view showing the positioning mechanism and the driving mechanism for the carriage and the photosensitive members of the image forming units in the first embodiment of an image forming apparatus according to the present invention.
Figure 6:
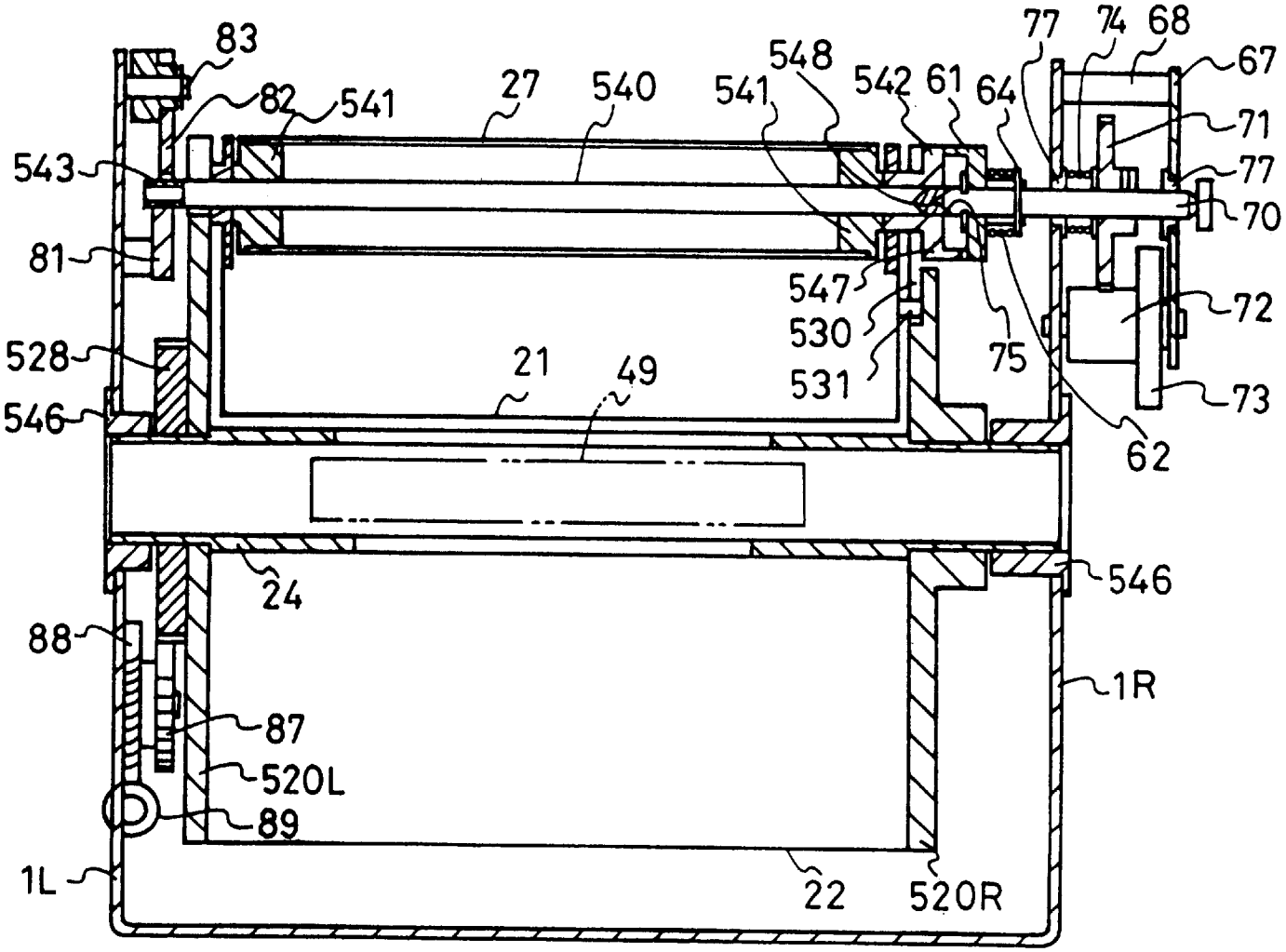
FIG. 6 is a cross sectional view of the carriage of the first embodiment of an image forming apparatus according to the present invention, taken along the plane through the image forming position.
Figure 7:
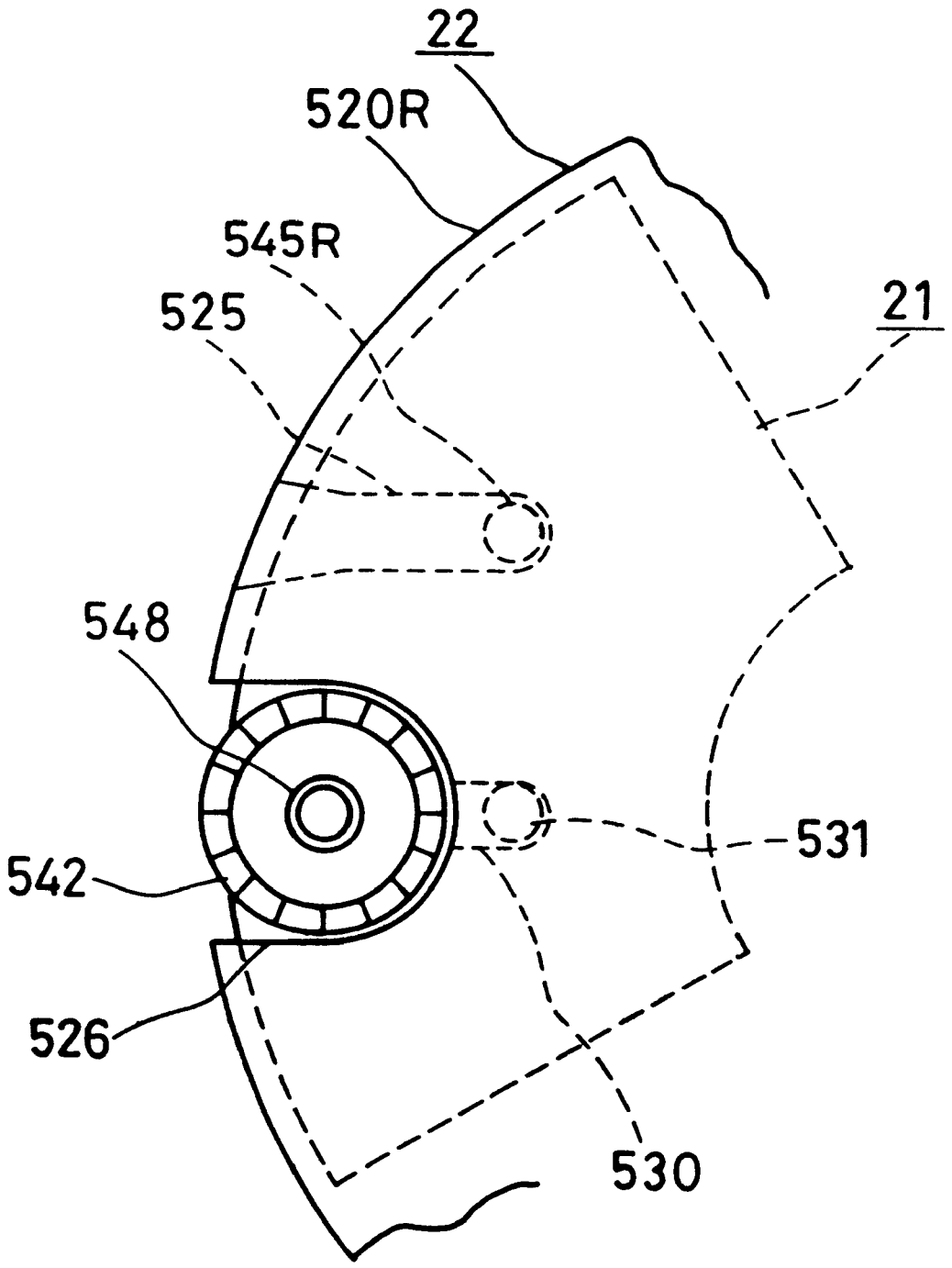
FIG. 7 is a lateral view of an image forming unit and the carriage in the first embodiment of an image forming apparatus according to the present invention, seen from the right.
Figure 8:
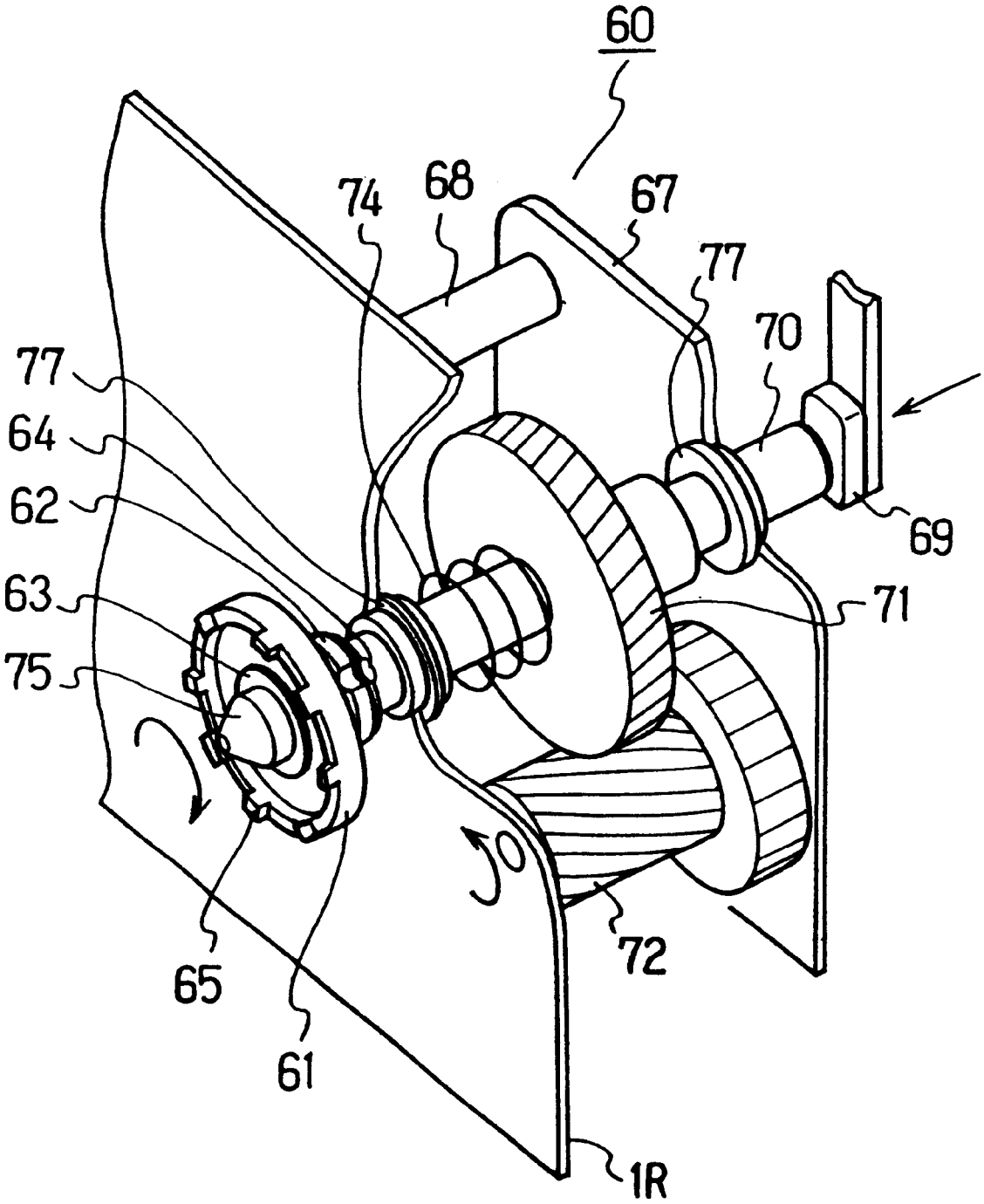
FIG. 8 is a perspective view showing a photosensitive member driving mechanism in the first embodiment of an image forming apparatus according to the present invention, which is a photosensitive member driving means for driving the photosensitive member positioned in the image forming position.
Figure 9:
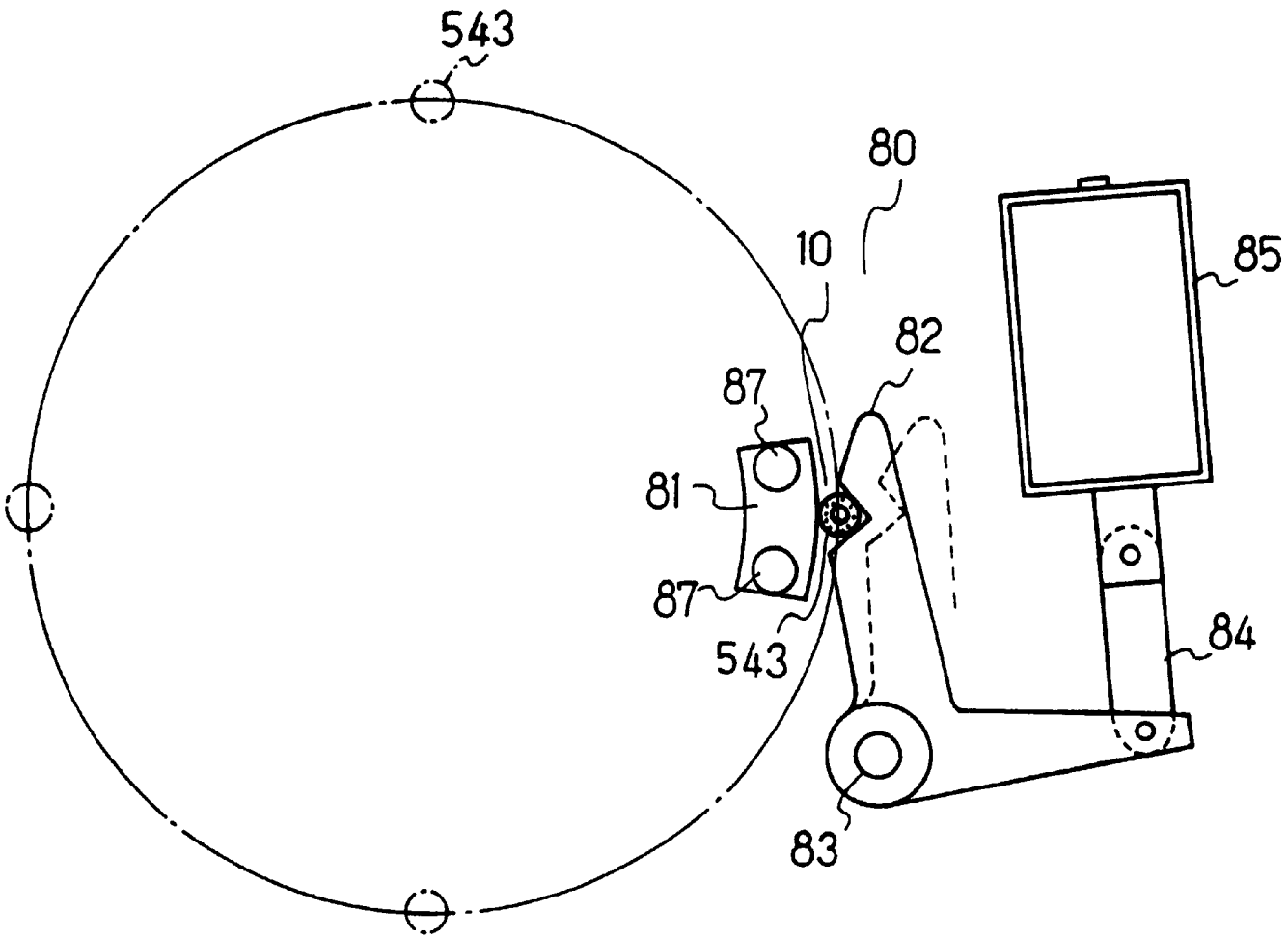
FIG. 9 is a lateral view showing a mechanism for positioning the shaft of the photosensitive member at an end surface opposite from the driving mechanism in the first embodiment of an image forming apparatus according to the present invention.

FIG. 5 is an exploded perspective view of the carriage, the positioning mechanism and the driving mechanism for the photosensitive member of the image forming unit. FIG. 6 is a cross sectional view of the carriage, taken at a plane through the image forming position. FIG. 7 is a lateral view of an image forming unit and the carriage, taken from the right. FIG. 8 is a perspective view showing a photosensitive member driving mechanism, which is a photosensitive member driving means for driving the photosensitive member positioned in the image forming position. FIG. 9 is a lateral view showing a mechanism for positioning the shaft of the photosensitive member at an end surface opposite from the driving mechanism.

As can be seen in FIGS. 5 and 6, the carriage 22 has a right wall 520R and a left wall 520L, which are fixed to the central shaft 24. Partition plates 523 for partitioning the carriage 22 into four sections are provided at four places between these walls 520R and 520L. An image forming unit 21 for each color is installed in each space in the carriage 22, which is partitioned with the partition plates 523. Two partition plates 523 each are fixed in four places inside the carriage 22. Between each pair of partition plates 523, a light path is formed, through which the pixel laser signal beam 26 passes. The shaft 24 has a total of eight exposure windows 522, at positions corresponding to the light path, and at positions where the pixel laser signal beam 26 leaves the shaft 24 after being reflected by the center mirror 49.

A coupling plate 542 is fixed to the photosensitive member 27 of the image forming unit 21, and right cutouts 526 for accepting the coupling plate 542 are provided on a portion of the right wall 520R. A gap is provided between the coupling plate 542 and the right wall 520R, so that the coupling plate 542 and the right wall 520R are not in contact at a regular position. The periphery of the left wall 520L is provided with left cutouts 529 for receiving a collar 543 that is provided at the left end of the photosensitive member shaft. The left cutouts 529 are larger than the outer diameter of the collar 543, so that the collar 543 and the left cutouts 529 are not in contact at a regular position.

Numeral 525 denotes guide grooves formed on the inner side of the right and left walls 520R and 520L. These guide grooves 525 guide the guide pins 545R and 545L provided on both side walls of the image forming unit 21, which is thus positioned roughly in the carriage 22.

Numeral 530 denotes rotation stop portions, which are connected to the right cutouts 526 in the right wall 520R of the carriage 22 on the side of the photosensitive member driving mechanism in the axial direction of the photosensitive member 27. These rotation stop portions 530 couple with the rotation stop pins 531 provided in the right wall of the image forming units 21, and perform the rotational positioning around the axis of the photosensitive member 27 of the image forming unit 21 at the time of image formation.

The rotation stop portions 530 have a surface that is substantially parallel to the line that connects the axis of the photosensitive member 27 when it is supported at the proper position in the image forming position 25 and the center of the rotation stop pin 531, and this surface stops the rotation stop pin 531.

Moreover, when the image forming unit 21 is in the image forming position 25 and performs image formation, clearances are provided between the image forming unit 21 and the carriage 22, between the coupling board 542 and the right cutout 526, between the collar 543 and the left cutout 529, between the guide pins 545R and 545L and the guide grooves 525, and between the outer surface of the image forming unit 21 and all parts of the carriage 22, as shown in FIG. 7. In other words, the image forming unit 21 and the carriage 22 do not contact each other except with the rotation stop portion 530 and the rotation stop pin 531.

Not shown in the drawings are protrusions for preventing the image forming units 21 from dropping out in the centrifugal direction, which are provided at the outer peripheral surface of the right and left walls 520R and 520L and which can be advanced and retracted.

Numeral 528 denotes a carriage gear, which is fixed to the left wall 520L, and which can be connected to a carriage driving mechanism 86 on the main body side, which constitutes a unit conveying means. This carriage driving mechanism 86 comprises a worm gear 89 connected to a driving motor, a worm wheel 88, and a gear 87 that is formed in one piece with the worm wheel 88 and meshes with the carriage gear 528.

The carriage 22 is rotatably mounted on the right and left main walls 1R and 1L with bearings 546 so that it is parallel to the laser exposing device 44 and the center mirror 49. The center mirror 49 is fixed to the right and left main walls 1R and 1L by supporting members (not shown in the drawings).

The photosensitive member 27 of the image forming unit 21 shown in FIG. 6 comprises flanges 541, which are rigidly fixed to each end of the photosensitive member shaft 540. The photosensitive member shaft 540 is rotatably mounted to the side walls of the image forming unit 21. A concave tapered surface 548 is formed on the right side of the photosensitive member shaft 540. The coupling plate 542 is fixed to the photosensitive member shaft 540 and has eight tongues 547 (see FIG. 5) that are disposed around the tapered surface 548. When the coupling plate 542 with this configuration rotates, the photosensitive member shaft 540 is caused to rotate, and at the same time the flanges 541 and the photosensitive member 27 are rotated as well. The collar 543, which serves as a radial bearing, is attached rotatably on the left edge of the photosensitive member shaft 540.

A photosensitive member driving mechanism 60 and a detent mechanism 80, which are both photosensitive member driving means, are employed at the side walls 1R and 1L of the printer main body 1, as shown in FIGS. 5–8, to position the photosensitive member 27 precisely at the image forming position 25.

The photosensitive member driving mechanism 60, which is attached to the right main wall 1R, includes an output shaft 70, which is a photosensitive member supporting member, a coupling plate 61 that rotates together as one piece with the output shaft 70, an output shaft driving gear 71, and a driving mechanism for driving these elements. The output shaft 70 is supported rotatably and displaceably in the thrust direction by bearings 77 that are fixed between the right main wall 1R and a base plate 67 fixed thereto.

One end of the output shaft 70 has a tip-tapered portion 75, which has a convex tapered surface matching the tapered surface 548 of the photosensitive member shaft 540. The other end of the output shaft 70 has a spherical shape so as to abut on a thrust bearing 69 with little area. The output shaft driving gear 71, which is fixed to the output shaft 70, is a left-handed helical gear, having the same direction as the rotation direction. This output shaft driving gear 71 meshes with a motor-side gear 72.

Numeral 74 denotes a compression spring 74, which is inserted between the bearing 77 and the output shaft driving gear 71. This compression spring 74 is steadily energized toward the position where the output shaft 70 and the coupling plate 61 are separated from the coupling plate 542 of the photosensitive member 27 (position indicated in FIG. 8). The output shaft 70 can be moved axially against the spring force by the driving means that moves the thrust bearing 69, between a separated position shown in FIG. 8 and a coupling position shown in FIG. 6 where the tapered surface 548 is coupled with the tip-tapered portion 75. The motor-side gear 72 has a sufficient length in the axial direction so that the output shaft driving gear 71 engages the motor-side gear 72 in both positions. When the output shaft 70 is moved along the thrust direction, the output shaft driving gear 71 and the motor-side gear 72 slide against each other on the tooth faces.

The coupling plate 61 meshes with the coupling plate 542 on the side of the photosensitive member 27 for the transmission of motive power. The coupling plate 61 has eight coupling tongues 65, as does the coupling plate 542, that are disposed on its end. A pin 64 impedes rotation of the coupling plate 61 with respect to the output shaft 70, but the coupling plate 61 is movable in the thrust direction within a predetermined distance. This way, the coupling plate 61 can retreat temporarily when the tips of the coupling tongues 65 hit the tips of the coupling tongues 547 of the coupling plate 542. Moreover, this way, the meshing action of the tip-tapered surfaces is not impeded. The compression spring 62 forces the coupling plate 61 against a tip stopper 63.

Next, the detent mechanism 80, which is attached to the left main wall 1L, is explained.

The detent mechanism 80 comprises a guide plate 81, a detent lever 82, and a solenoid 85 for moving the detent lever 82. The guide plate 81, which is fixed to the left main wall 1L, guides the collar 543 arranged at the left end of the photosensitive member shaft 540 to position the collar 543 at a proper centrifugal distance from the center of the carriage 22 when the photosensitive member is located near the image forming position 25. The detent lever 82 is pivoted rotatably on the left main wall 1L by a stop pin 83 and pushes the collar 543 to the guide plate 81 with a frontal V-groove so as to position the collar 543 correctly in the image forming position 25.

The detent lever 82 is connected to a plunger of the solenoid 85 via a lever 84. With this configuration, the solenoid actuates the detent lever 82 by magnetic attraction and the V-groove of the detent lever 82 forces the collar 543 strongly against guide plate 81.

The output shaft 70 of the photosensitive member driving mechanism 60 and the position of the V-groove of the detent mechanism 80 are kept precisely parallel to the laser exposing device 44 and the center mirror 49. For this reason, play of the bearings is minimized, so that the photosensitive member 27 is usually located precisely at the image forming position 25 when the photosensitive member driving mechanism 60 and the detent mechanism 80 are actuated.

The following is an explanation of the operation of an image forming apparatus with the above configuration.

First, a full-color image forming process is explained. FIG. 1 shows an image forming apparatus as it is forming an image. First, a yellow image is formed. The operation of the image forming unit 21Y is explained with reference to FIG. 10. At the time of image formation, a voltage of −450V is applied to the grid 29 of the charger 28, which charges the photosensitive member 27 to −450V. When the pixel laser signal beam 26 is irradiated onto the photosensitive member 27, a static latent image is formed. After the pixel laser signal beam 26 has passed a lens system 46, it is reflected twice, once at the intermediate mirror 47 and once at the center mirror 49, thereby defining a Z-shape (seen in reverse in FIG. 1), and reaches the photosensitive member 27. At this time, the exposure potential of the photosensitive member 27 is −50V. The photosensitive member 27 is developed with a developing roller 33 carrying a yellow two-component developer 37Y. A DC voltage of −250V is applied from a high-voltage source to the developing roller 33 when it passes a region of the photosensitive member 27 that is not yet charged. Thus, a negative-positive reversed yellow toner image is formed only at an image portion on the photosensitive member 27. At this time, the carriage 22 is in the position shown in FIG. 1, the yellow image forming unit 21Y is in the image forming position 25, and the photosensitive member 27 is in contact with the intermediate transfer belt 4. With this image forming process with the image forming unit explained above, an image is formed with yellow toner. The transfer speed of the intermediate transfer belt 4 is set to be about 1.5% faster than the speed of the photosensitive member 27, which prevents the thinning out of the toner image in the middle. Thus, a yellow toner image is transferred to the intermediate transfer belt 4 simultaneously with the image formation. Moreover, at this time, a DC voltage of +1.0 kV is applied to the transfer guide roller 9 and the tension roller 5.

After the yellow toner image has been transferred completely onto the intermediate transfer belt 4, the entire carriage 22 is driven by the transport motor 23, rotated for 90° in arrow direction Q, and stopped when the image forming unit 21M has reached the image forming position 25.

When the carriage 22 stops rotating and the image forming unit 21M reaches the image forming position 25, the laser exposure device 44 irradiates a signal beam into the image forming unit 21M, as before but this time with a magenta signal, so that a magenta toner image is formed and transferred. Up to this point, the intermediate transfer belt 4 has rotated once, and the signal from the position detector 12 controls the timing with which the writing of the magenta signal beam is started, so that the magenta toner image is superimposed onto the previously transferred yellow toner image with positional alignment. During that time, the retransfer roller 43 is retracted to a position where it is not in contact with the intermediate transfer belt 4, so that the toner image on the intermediate transfer belt 4 is not corrupted.

As is shown in FIGS. 1 and 3, the disjunction cam 52 of the printer main body 1 presses down the cam follower 16, and the cleaning unit 15 rotates in the direction of the arrow P with the rocking axis 15 as the fulcrum, whereby the cleaning blade 7 and the toner catcher 17 are separated from the intermediate transfer belt 4, so that the toner image on the intermediate transfer belt 4 is not corrupted. Moreover, the cleaning blade 7 contacts an overhanging portion 4A of the intermediate transfer belt 4 and during the separation of the cleaning blade 7 the toner catcher 17 is further on the side of the intermediate transfer belt 4 than the tip of the cleaning blade 7, so that when the cleaning blade is separated, waste toner adhering to the cleaning blade 7 does not spill and fall down.

Then, the entire carriage 22 is again driven by the transport motor 23, rotated 90° in the arrow direction Q in FIG. 1, and stopped when the image forming unit 21C reaches the image forming position 25. Then, the same operation as for yellow and magenta is repeated for cyan.

Finally, the entire carriage 22 is driven by the transport motor 23, rotated 90° in the arrow direction Q in FIG. 1, and stopped when the image forming unit 21Bk reaches the image forming position 25, and image formation is performed with black toner. Superimposing the four color toner images on the intermediate transfer belt 4 with positional alignment, a full-color image is formed. After the final black toner image has been transferred onto the intermediate transfer belt 4, the retransfer roller 43 is pressed against the retransfer backup roller 6, a voltage of +3 kV is applied to it, and the four-color toner image is transferred in one piece onto the recording paper 42, which has been conveyed from the paper feed unit 53, guided by the paper guide 54. The recording paper 42 onto which the toner image has been transferred is fixed by passing the fixing device 51, and ejected from the apparatus.

Then, the entire carriage 22 is driven by the transport motor 23, rotated 90° in the arrow direction Q in FIG. 1, until the image forming unit 21Y reaches the image forming position 25 again, and the process for forming a new full-color image can be started.

In this manner, 2.5 full-color A4-sized print-outs can be obtained per minute.

The following is an explanation of how the intermediate transfer belt unit and the image forming unit can be installed and removed.

As is shown in FIG. 2, when the printer front panel 1A is tilted and opened, an aperture portion is opened. When an intermediate transfer belt unit 2 is inserted into this aperture portion, the intermediate transfer belt unit 2 is guided into a predetermined storage position by a guide member, which is not shown in the drawings, in the direction of the arrow R.

The aperture portion for the removal of paper jams is also an insertion port for inserting the intermediate transfer belt unit 2, so that there is no need to provide a separate insertion port for the intermediate transfer belt unit 2, which has a large projected upper surface, in the upper surface of the printer main body 1. The guiding direction is obliquely downwards, seen from the user, and the intermediate transfer belt unit 2 can be mounted in a natural posture without difficulty. Moreover, since the insertion direction is toward the center mirror 49, the photosensitive member 27 and the intermediate transfer belt 4 are not damaged, even if it comes to an orthogonal contact between the intermediate transfer belt 4 and the photosensitive member 27, and the photosensitive member 27 is not retracted while the intermediate transfer belt unit is installed or removed. The intermediate transfer belt unit 2 has a cross-sectional shape that becomes narrower toward the center mirror 49, so that it can be easily inserted through the aperture portion. Moreover, while reducing the axial distance between the transfer guide roller 9 and the tension roller 5, so that the positioning of the intermediate transfer belt 4 and the contact pressure with regard to the photosensitive member 27 can be adjusted easily, the capacity of the waste toner reservoir 10 can be enlarged.

In conjunction with the insertion of the intermediate transfer belt unit 2, the disjunction cam 52 of the printer main body 1 is coupled with the cam follower 16, and the cleaning blade 7 is separated from the intermediate transfer belt 4. Therefore, when being stopped or retracted, the cleaning blade 7 is separated from the intermediate transfer belt 4, so that a deformation of the cleaning blade 7 can be prevented. Only when cleaning is necessary is the disjunction cam 52 rotated, and the cleaning blade 7 contacts the intermediate transfer belt 4.

When the intermediate transfer belt unit 2 is removed, the coupling between the disjunction cam 52 and the cam follower 16 is released, the cleaning blade 7 contacts the intermediate transfer belt 4, and the scattering of waste toner is prevented. The angle defined by the removing direction (direction opposite to arrow R) and the direction in which the disjunction cam 52 is pressed, as indicated by the arrow V, is less than 90°, so that the intermediate transfer belt unit 2 can be removed smoothly and without applying unnecessary resistance.

Moreover, to install or remove an image forming unit 21, the printer top panel 1C is opened, and a unit other than that in the image forming position 25 (here, the black image forming unit 21Bk positioned above) can be installed or removed. Therefore, the photosensitive member 27 and the intermediate transfer belt 4 are not damaged, even if the photosensitive member 27 is not retracted while an image forming unit is installed or removed. In this embodiment, the image forming units are inserted substantially in the direction of gravity. Since their projected upper surface area is smaller than that of the intermediate transfer belt unit 2, they also can be operated easily from the front of the apparatus. It is preferable that this direction of installation and removal is at least 30° and at most 90° with the respect to the direction of installation and removal of the intermediate transfer belt unit 2. If it is less than 30°, the capacity of the toner hopper 32 of the developer 31 in the image forming position 25 cannot be sufficiently ensured, and if it is more than 90°, then the user has to insert from the back toward the front, which is very inconvenient.

The following is an explanation of the operation of the device with the driving mechanism.

When all image units 21 are installed in the carriage 22, the worm gear 89 is rotated by actuating the transport motor 23, and the carriage 22 is rotated in the arrow direction to position the yellow image forming unit 21Y in the image forming position 25. When the carriage 22 rotates, the output shaft 70 of the photosensitive member driving mechanism 60 retreats due to the energization of the spring 74, so that the tip-tapered portion 75 and the coupling board 61 are separated from the coupling board 542 on the photosensitive member side. Furthermore, in this situation, the solenoid 85 of the detent mechanism 80 is turned off, and the detent lever 82 recedes to the position indicated by the dashed line in FIG. 9. Furthermore, in this situation, the motor driving the photosensitive member driving mechanism 60, which is not shown in the drawings, stops. The yellow photosensitive member 27Y slides and moves along the surface of the intermediate transfer belt 4, and when it comes near the image forming position 25, the transport motor 23 stops, the worm gear 89 stops, and the carriage 22 is locked in this position.

When the carriage 22 stops, the solenoid 85 of the detent mechanism 80 is immediately turned on, so that the detent lever 82 forces the collar 543 of the photosensitive member shaft 540 against the guide plate 81. A specified position is assumed while holding the collar 543 with the V-groove of the detent lever 82.

Simultaneously, the thrust bearing 69 pushes the output shaft 70 against the resistance of the spring force to the left in FIG. 6. As the output shaft 70 is pushed to the left in FIG. 6, the tip-tapered portion 75 of the output shaft 70 starts to couple with the tapered surface 548 of the photosensitive member shaft 540 and advances while shifting the photosensitive member shaft 540 so as to align it with the center of the output shaft 70. When the thrust bearing 69 pushes the output shaft 70 further to the left in FIG. 6, the tip-tapered portion 75 engages the tapered surface 548, and the center of the photosensitive member shaft 540 aligns completely with the center of the output shaft 70. Thus, the photosensitive member 27Y is positioned precisely in the image forming position 25. In this situation, the thrust from the output shaft 70 pushes the end of the flange 541 against the side wall bearings of the image forming unit 21Y, and abuts on the left side wall 520L of the carriage 22, so that it is stopped by the left side wall 520L. Furthermore, when the tip-tapered portion 75 engages the tapered surface 548, the coupling plates 542 and 61 engage each other, so that a rotational force can be transmitted between the two.

In this manner, the yellow photosensitive member 27Y is positioned precisely by the detent mechanism 80 and the photosensitive member driving mechanism 60. Then, the image forming unit 21Y, which includes the photosensitive member 27Y, is moved with the photosensitive member 27Y in the carriage 22. Since the image forming unit 21Y is retained freely inside the carriage 22, the carriage 22 does not hinder the movement of the image forming unit 21Y when it is being positioned. Although the carriage 22 has some clearance in the rotation direction such as a backlash between the spur gear 528 and the gear 87, this does not affect the precise positioning of the photosensitive member 27Y, since the photosensitive member 27Y is positioned by the positioning mechanism on the main body side and not with the carriage 22.

In this situation, the image forming unit 21Y is supported to be freely rotatable with the photosensitive member 27Y in the center.

After the positioning of the photosensitive member 27Y is completed, the motor for driving the photosensitive member starts to rotate the photosensitive member 27Y. As the motor and the photosensitive member start to move, all process elements start to operate, and subsequently a yellow toner image is formed on the photosensitive member 27Y, which is subsequently transferred onto the intermediate transfer belt 4.

During this image forming operation, the output shaft 70 is still pushed by the thrust bearing 69 to the left, and the solenoid 85 is still actuated, so that the detent lever 82 retains the collar 543. Moreover, the rotation load of the photosensitive member 27Y tends to rotate the image forming unit 21Y counterclockwise around the photosensitive member shaft 540, but the coupling between the rotation stop portion 530 and the rotation stop pin 531 determines the rotational orientation of the image forming unit 21Y. At this time, the image forming unit 21 and the carriage 22 are retained in a manner that they do not contact each other at other places than the rotation stop portion 530 and the rotation stop pin 531. The rotation stop portion 530 couples with the rotation stop pin 531 in a plane that is parallel to the line connecting the axis of the photosensitive member 27Y and the center of the rotation stop pin 531, so that no excessive reactive force acts on the coupling portion of the tip-tapered portion 75 and the tapered surface 548.

It is also preferable that the rotation stop portion 530 and the rotation stop pin 531 do not contact each other while the image forming unit 21Y is being positioned, and that they are devised so as not to disturb the positioning operation.

When the intermediate transfer belt 4 has performed one full rotation (while the photosensitive member 27Y rotates four times), the yellow image formation is complete, the motor stops, and the intermediate transfer belt 4 stops at its initial position.

When the intermediate transfer belt 4 and the photosensitive member 27Y have stopped, the solenoid 85 is turned off, thus releasing the detent lever 82. Simultaneously, the thrust bearing 69 retreats to the right. The driving shaft 70 recedes due to the force of the spring 74, and the coupling plate 61 and the tip-tapered portion 75 are separated from the coupling plate 542 and the photosensitive member shaft 540. Thus, the positioning of the photosensitive member 27Y is released and it becomes possible to rotate the carriage 22.

The output shaft 70 is rotated counterclockwise when facing the photosensitive member 27Y, but when the motor stops and the photosensitive member 27Y is stopped, there is a rotation load on the photosensitive member 27Y, so that in some cases there is still a pressure force on the side faces of the coupling tongues 65 and the coupling tongues 547 on the photosensitive member side. In this situation, friction forces act on the side faces of the tongues, and it becomes difficult to pull out the coupling plate 61 from the coupling plate 542. In this embodiment, the output shaft driving gear 71 is made of a helical gear, which is left-handed, the same as the rotation direction, so that the coupling plate 61 is pulled out while rotating by only the twisting amount of the tooth faces in a direction that is opposite to the driving direction of the photosensitive member 27. As a result, there are no friction forces on the side faces of the tongues, so that the coupling plate 61 can be pulled out easily from the coupling plate 542.

Moreover, in this embodiment, the coupling operations of the detent mechanism 80 and the output shaft 70 in the thrust direction are performed simultaneously, but when a force acts in the lateral direction on the coupling tongues 65 and the coupling tongues 547 on the photosensitive member side, a friction force acts between the tongues, and attaching and removing it becomes a little bit difficult. Consequently, it is preferable that the axes of the output shaft 70 and the photosensitive member shaft 540 are aligned as good as possible at the time of coupling. Therefore, at the time of attachment, the detent mechanism 80 is operated first to position the photosensitive member shaft 540, and then the output shaft 70 is moved, and the attaching and removing operation can be performed more precisely and smoothly than when the output shaft 70 is operated before the detent mechanism 80. Especially in a configuration where at the time of removing the output shaft 70 is separated by the force of the spring 74, it is difficult to separate the tongues when there is a load on the coupling portion, so that it is effective to have the operation of the detent mechanism 80 performed after the operation the output shaft 70.

Moreover, in this embodiment, the output shaft 70 is returned with the force of the spring 74, but it is also possible to force it back with a driving mechanism on the side of the thrust bearing 69.

After the coupling between the photosensitive member shaft 540 and the output shaft 70 is released, the worm gear 89 is rotated again, and the carriage 22 is rotated 90° in the arrow direction indicated in FIG. 1. This moves the next, magenta image forming unit 21M near the image forming position 25, where it is stopped. Then, the photosensitive member driving mechanism 60 and the detent mechanism 80 are actuated, and the magenta photosensitive member 27M is positioned. After this, the photosensitive member shaft 540 and the output shaft 70 are coupled, and the image forming operation for the second color begins.

In this manner, the switching operation and the image forming operation are repeated in sequence, so that a four-color image is formed on the intermediate transfer belt 4, which is then transferred onto the recording paper 42.

In the present embodiment, a 90 degree rotation of the carriage 22 takes about 0.6 sec, and the attach and the detach operation for coupling and decoupling the output shaft 70 take 0.2 sec each.

Thus, in this embodiment, the tip-tapered portion 75 of the output shaft 70 is coupled with the tapered surface 548 of the photosensitive member 27, and the photosensitive member 27 is positioned at the proper position inside the printer main body 1. Moreover the image forming units 21 are supported freely rotatably, and the rotation stop portion 530 couples with the rotation stop pin 531, which determines the rotational orientation of the image forming unit 21, whereby it is possible to precisely and reliably retain photosensitive members 27 and image forming units 21 at their correct position in the printer main body with a simple configuration, even when a plurality of different photosensitive members 27 is used. As a result, it is possible to realize an image forming apparatus that can output high-quality color images.

Moreover, by providing rotation stop portions 530 on the photosensitive member driving mechanism side, the parts where loads act can be concentrated in the vicinity thereof, so that by raising the precision and the robustness of this part, the positioning can be made more reliable. As a result, it is possible to realize an image forming apparatus that can output high-quality color images.

Moreover, the rotation stop portion 530 couples with the rotation stop pin 531 in a plane that is parallel to the line connecting the axis of the photosensitive member 27 and the center of the rotation stop pin 531, so that no excessive reactive forces act on the output shaft 70 and the tip-tapered portion 75, and the photosensitive member 27 can be retained even more reliably.

Moreover, since the rotation stop portions 530 are arranged in the carriage 22, the rotation stop portions can be provided in a position near to the image forming units 21. As a result, it is possible to stop the rotation of the image forming units 21 reliably and without providing large protrusions or the like in the image forming units 21 or the apparatus main body.

Second Embodiment

Figure 11:
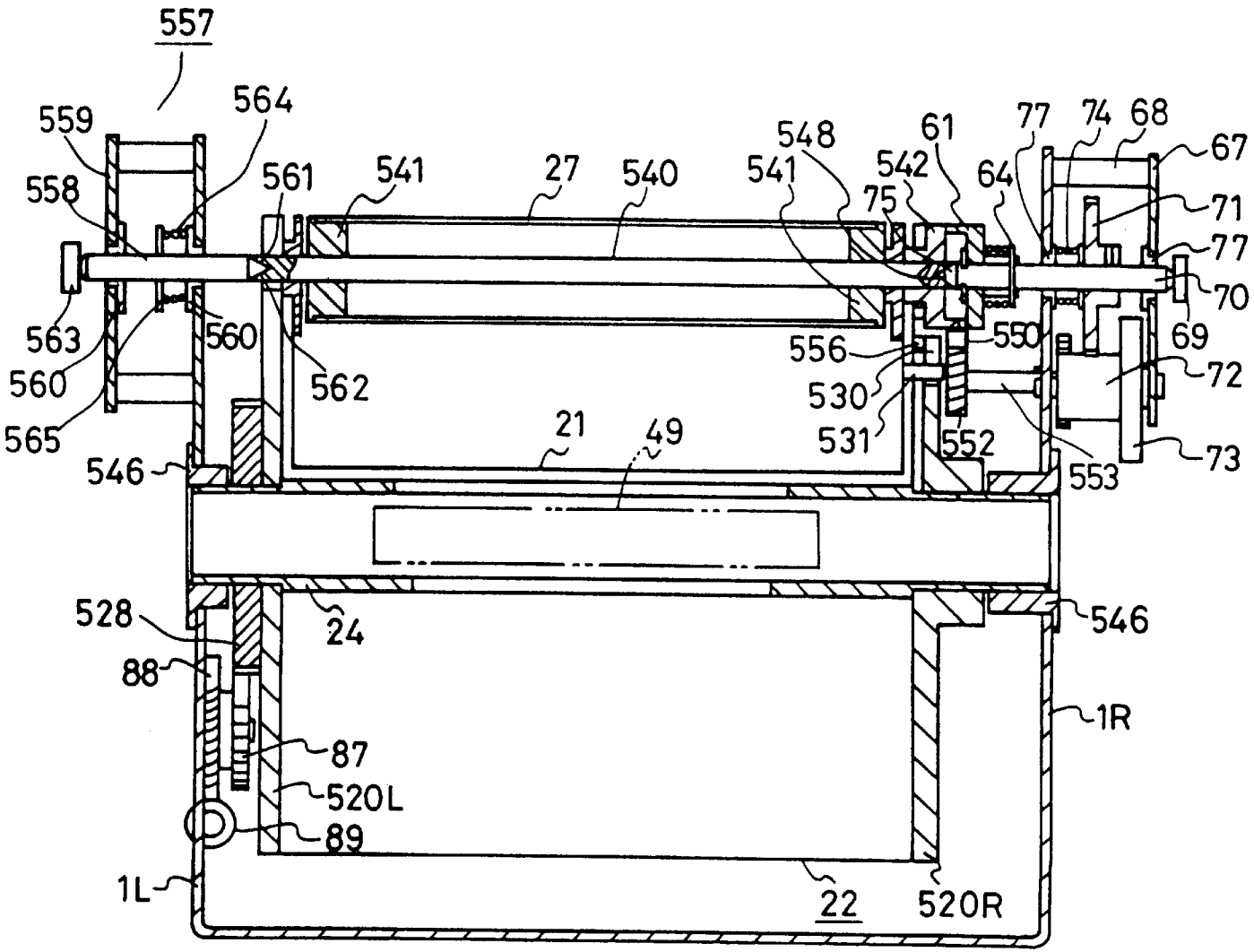
FIG. 11 is a cross sectional view of the carriage of a second embodiment of an image forming apparatus according to the present invention, taken along the plane through the image forming position.
Figure 12:
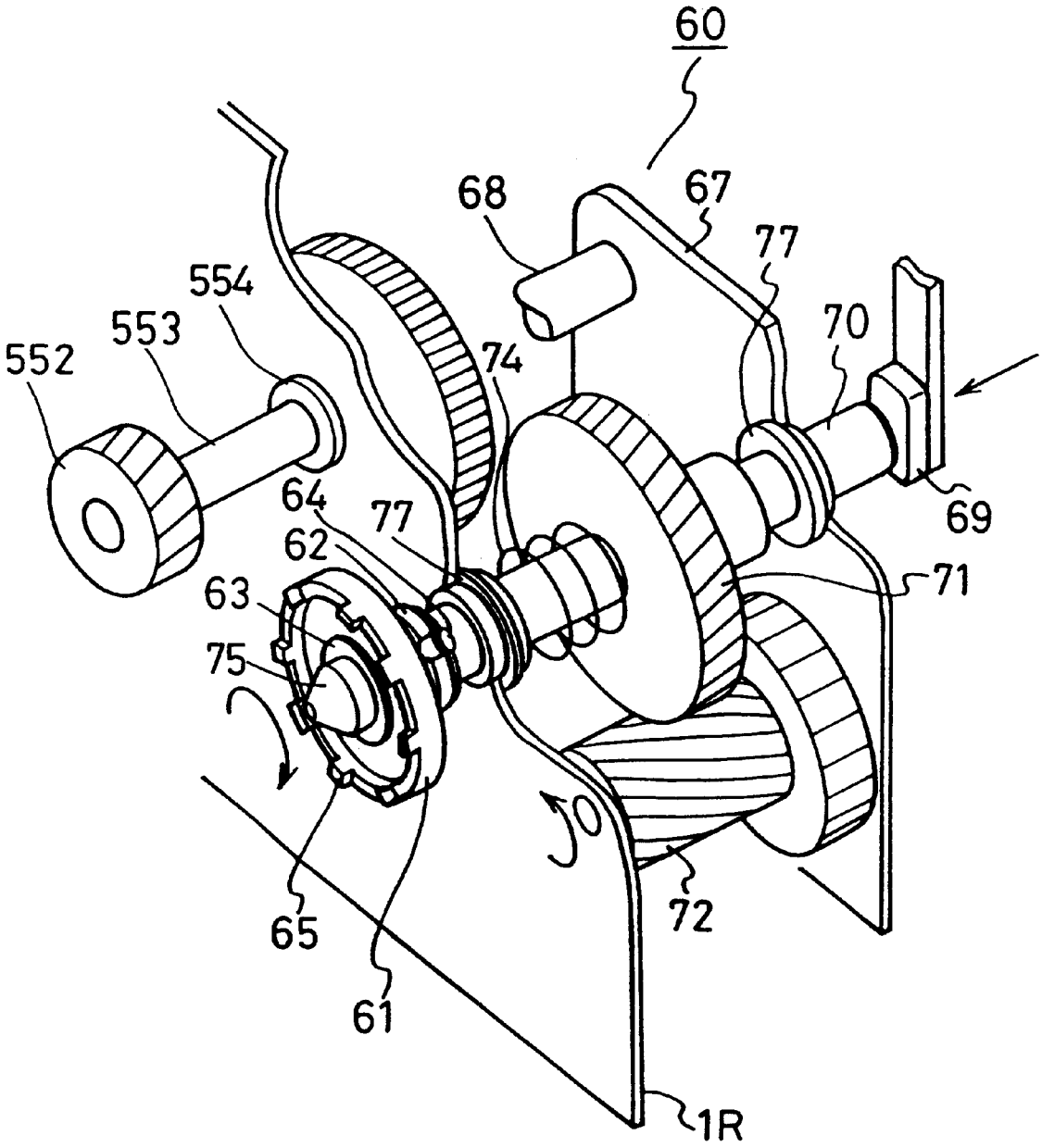
FIG. 12 is a perspective view showing the photosensitive member driving mechanism, which is a photosensitive member driving means for driving the photosensitive member positioned in the image forming position, and the developer driving mechanism, which is a developer driving means for driving the developer in the second embodiment of an image forming apparatus according to the present invention.
Figure 13:
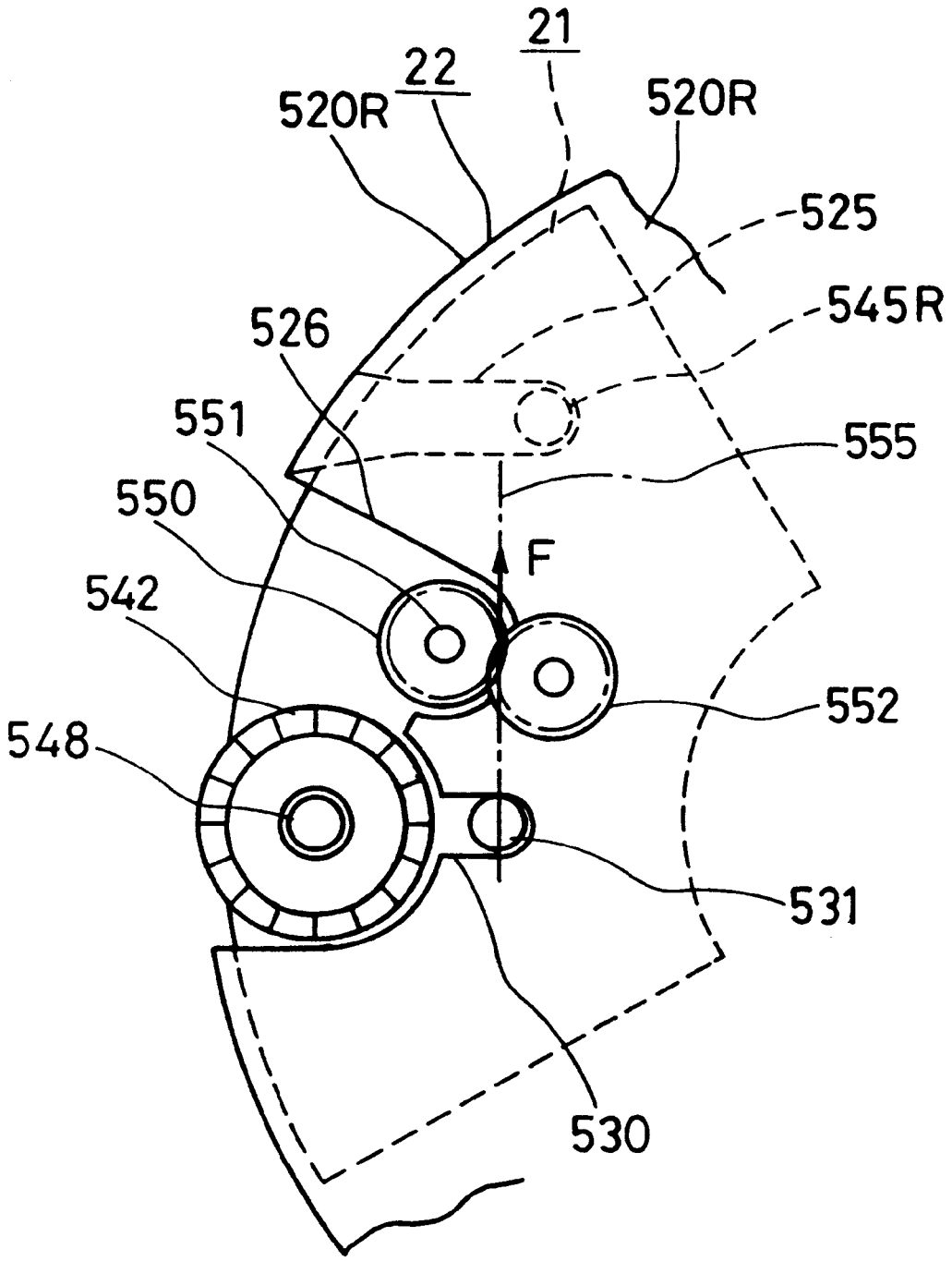
FIG. 13 is a lateral view of an image forming unit and a portion of the carriage in the second embodiment of an image forming apparatus according to the present invention, taken from the right side.

The following is an explanation of a second embodiment of an image forming apparatus in accordance with the present invention, with reference to FIGS. 11 to 13.

FIG. 11 is a cross sectional view of the carriage, taken through the image forming position. FIG. 12 is a perspective view showing the photosensitive member driving mechanism, which is a photosensitive member driving means for driving the photosensitive member positioned in the image forming position, and the developer driving mechanism, which is a developer driving means for driving the developer. FIG. 13 is a lateral view of an image forming unit and the carriage, taken from the right side.

Numeral 550 denotes a developer driving input gear for inputting from the apparatus main body a motive force that drives the developer 31. This developer driving input gear 550 is attached to an input shaft 551, which protrudes from the right surface of the image forming unit 21. The right cutout 526 (see FIG. 5) provides a cutout shape, which ensures that the coupling plate 542 and the developer driving input gear 550 are not in contact at the correctly positioned position. Numeral 552 denotes a developer driving gear, which, together with the remaining developing driving mechanism, constitutes a developer driving means. Numeral 554 denotes a bearing fixed to the right main wall 1R, which rotatably supports the driving shaft 553. The developer driving gear 552 is attached to a driving shaft 553, is driven by a driving motor not shown in the drawings, and meshes with the developer driving input gear 550 of the image forming unit 21 positioned in the image forming position 25.

As shown in FIG. 11, the rotation stop pin 531, which is on the side of the developer driving means, is a little bit more elongated than in the first embodiment, and the tapered surface 548, which is at the supporting position in the axis of the photosensitive member 27, the position where the developer driving input gear 550, which is in the driving force transmission position, meshes with the developer driving gear 552, and the position where the rotation stop portion 530 stops the rotation are arranged on substantially the same plane, which is perpendicular to the axis of the photosensitive member 27.

The arrow F in FIG. 13 indicates the direction of the driving force of the developer driving gear 552 when the developer driving input gear 550 in the image forming position 25 meshes with the developer driving gear 552, and numeral 555 indicates the action line in which this driving force F acts. The rotation stop portion 530 stops the rotation stop pin 531 substantially perpendicularly to the action line 555 and near the action line 555.

Numeral 556 denotes a thrust guide, which is a thrust stop portion, and this thrust guide 556 is provided at the right wall 520R near the axis of the photosensitive member 27.

Moreover, at the left end of the photosensitive member shaft 540, which forms the axis of the photosensitive member 27, a tapered surface 561 is formed, similar to the tapered surface 548 on the right end.

Numeral 557 denotes a detent mechanism provided in the left main wall 1L. The detent mechanism 557 includes a detent shaft 558, which is a photosensitive member supporting member, and a driving mechanism for driving the same. A bearing 560, which is fixed between the left main wall 1L and the panel 559 attached thereto supports the detent shaft 558 so that it is movable in the thrust direction. A tip-tapered portion 562 having a convex tapered surface that matches the tapered surface 561 is formed on one end of the detent shaft 558, whereas the other end has a spherical shape so as to abut on a thrust bearing 563 with little area. Numeral 564 denotes a compression spring that is inserted between the bearing 560 and a stop ring 565. The compression spring 564 is steadily energized in the position where the detent shaft 558 is separated from the tapered surface 561 on the left end of the photosensitive member shaft 540. A driving means for moving the thrust bearing 563 can move the detent shaft 558 into a coupling position shown in FIG. 11 where the tapered surface 561 engages the tip-tapered portion 562 and a position where it is separated by the compression spring 564.

The following is an explanation of the operation of an image formation apparatus configured as above. Explanations for parts that are the same as in the first embodiment have been omitted.

The carriage 22 rotates and carries the yellow image forming unit 21Y into the image forming position 25. At this time, the output shaft 70 of the photosensitive member driving mechanism 60 and the detent shaft 558 of the detent mechanism 557 are receded due to the energization of the springs 74 and 564, and the tip-tapered portion 75 with the coupling plate 61 is separated from the coupling plate 54 on the photosensitive member side. Also the tip-tapered portion 562 of the detent shaft 558 and the tapered surface 561 of the photosensitive member shaft 540 are separated. The motor for driving the photosensitive member driving mechanism 60, which is not shown in the drawings, is stopped. The yellow photosensitive member 27Y slides and moves along the surface of the intermediate transfer belt 4, and when it comes near the image forming position 25, the transport motor 23 stops, the worm gear 89 stops, and the carriage 22 is locked in this position.

When the carriage 22 stops, the thrust bearings 69 and 563 immediately push the output shaft 70 and the detent shaft 558 against the spring forces toward the photosensitive member shaft 540. As the output shaft 70 and the detent shaft 558 are pushed toward the photosensitive member shaft 540, the tip-tapered portions 75 and 562 start to engage the tapered surfaces 548 and 561 of the photosensitive member shaft 540 and advance while the output shaft 70 and the detent shaft 558 align the photosensitive member shaft 540 with the axes of the output shaft 70 and the detent shaft 558. This aligns the tip-tapered portions 75 and 562 with the tapered surfaces 548 and 561. As the thrust bearings 69 and 563 push the output shaft 70 and the detent shaft 558 further toward the photosensitive member shaft 540, the axis of the photosensitive member. shaft 540 aligns completely with the axis of the output shaft 70 and the detent shaft 558, so that the photosensitive member 27Y is positioned precisely in the image forming position 25. In this situation, the thrust force exerted by the detent shaft 558 is set to be larger than the thrust force exerted by the output shaft 70, whereby the side wall bearing portion of the image forming unit 21Y is pushed and received by the thrust guide 556 provided in the right wall 520R of the carriage 22. Furthermore, when the tip-tapered portion 75 couples with the tapered surface 548, the coupling plates 542 and 61 couple with each other, so that a rotational force can be transmitted between the two.

Incidentally, the strength of the force pushing into the thrust direction should take into account not only the pushing forces of the output shaft 70 and the detent shaft 55, but also the pushing forces in the thrust direction due to spring-shaped electrical contacts etc.

By operating the detent mechanism 557 and the photosensitive member driving mechanism 60 in this manner, the yellow photosensitive member 27Y is positioned precisely.

Since the thrust guide 556 is provided near the photosensitive member shaft 540, the torque around the coupling portion between the tip-tapered portion 75 and the tapered surface 548 becomes small, and the tip-tapered portions 75 and 562 can be aligned smoothly with the tapered surfaces 548 and 561, even when for example a difference in the timing for the positioning of the image forming unit 21Y inside the carriage 22 and the aligning of the tip-tapered portions 75 and 562 with the tapered surfaces 548 and 561 tilts the image forming unit 21Y inside the carriage 22 during the positioning of the photosensitive member 27Y.

It is preferable that the thrust guide 556 is ring-shaped with the photosensitive member shaft 540 at its center. Moreover, it is advantageous if the coupling of the tip-tapered portion 75 and the tapered surface 548 is completed prior to the coupling of the tip-tapered portion 562 and the tapered surface 561, so that the thrust guide 556 receives the image forming unit 21Y before the tapered portion 75 is sufficiently aligned with the tapered surface 548.

Moreover, in this situation, the image forming unit 21Y is supported to be freely rotatable around the axis of the photosensitive member 27Y.

After the positioning of the photosensitive member 27Y is completed, the motor for driving the photosensitive member starts to rotate, whereby the photosensitive member 27Y starts to rotate. A very short time thereafter, the motor for driving the developer starts to rotate. As these motors start to move, all process elements start to operate, and a yellow toner image is formed subsequently on the photosensitive member 27Y, which is then transferred subsequently onto the intermediate transfer belt 4.

During this image forming operation, the output shaft 70 and the detent shaft 558 are pushed by the thrust bearings 69 and 563. Moreover, the driving force F of the developer driving gear 552 exerts a torque on the image forming unit 21Y with the axis of the photosensitive member 27Y in the center, but since the rotation stop portion 530 stops the rotation stop pin 531 on a surface that is at a position near the action line 555 of the driving force F and substantially perpendicular to it, the driving force F is cancelled by the counter-force of the rotation stop portion 530, so that it hardly influences the coupling portion between the tip-tapered portion 75 and the tapered surface 548.

Moreover, since the position where the tip-tapered portion 75 couples with the tapered surface 548, the position where the developer driving input gear 550 couples with the developer driving gear 552, and the rotation stop position of the rotation stop portion 530 are all substantially in one plane that is perpendicular to the axis of the photosensitive member 27, the torque around the position where the tip-tapered portion 75 is coupled with the tapered surface 548 is cancelled, so that it hardly influences the coupling portion between the tip-tapered portion 562 and the tapered surface 561.

In rare cases, the pushing force of the thrust bearings 69 and 563 is not enough to align the tip-tapered portions 75 and 562 with the tapered surfaces 548 and 561, but when the motor for driving the photosensitive member starts to rotate, all parts move relatively to each other, so that the tip-tapered portions 75 and 562 are sufficiently aligned with the tapered surfaces 548 and 561. Also in this case, since the motor for driving the developer starts to turn within a short time after the motor for driving the photosensitive member, this movement is not impeded.

When the intermediate transfer belt 4 has rotated once, the yellow image forming is finished, the motor stops, and the intermediate transfer belt 4 stops in its initial position.

When the intermediate transfer belt 4 and the photosensitive member 27Y have stopped, the thrust bearings 69 and 563 recede to the left and right, the springs 74 and 564 retract the output shaft 70 and the detent shaft 558, the coupling plate 61 and the tip-tapered portion 75 are separated from the coupling plate 542 and the photosensitive member shaft 540, while the tip-tapered portion 562 is separated from the tapered surface 561, and the carriage 22 becomes rotatable and shiftable.

In this embodiment, the output shaft 70 and the detent shaft 558 are returned by the force of the springs 74 and 564, but it is also possible that a driving mechanism on the side of the thrust bearings 69 and 563 forces them back.

When the coupling and the detention are released, the worm gear 89 rotates again, and the carriage 22 rotates 90°. This moves the next, magenta image forming unit 21M near the image forming position 25, where it is stopped. Then, the detent mechanism 80 and the photosensitive member driving mechanism are actuated, and the magenta photosensitive member 27M is positioned. After this, the photosensitive member shaft 540 is coupled with the output shaft 70 and the detent shaft 558, and the image forming operation for the second color begins.

In this manner, the switching operation and the image forming operation are repeated in sequence, so that a four-color image is formed on the intermediate transfer belt 4, which is then transferred onto the recording paper.

With this configuration, providing a rotation stop portion 530 on the developer driving mechanism side makes it possible to concentrate the parts on which loads act in the vicinity thereof, so that by increasing the precision and the robustness of this part, the positioning can be made more reliable. As a result, it is possible to realize an image forming apparatus that can output high-quality color images.

Moreover, letting the position where the tip-tapered portion 75 couples with the tapered surface 548, the position where the developer driving input gear 550 couples with the developer driving gear 552, and the rotation stop position of the rotation stop portion 530 be all substantially in one plane that is perpendicular to the axis of the photosensitive member 27 cancels the torque around the position where the tip-tapered portion 75 couples with the tapered surface 548, so that the driving force of the developer driving gear 225 hardly influences the coupling portion between the tip-tapered portion 562 and the tapered surface 561, and it is possible to precisely and reliably retain the photosensitive members 27 and the image forming units 21 at their correct position in the printer main body with a simple configuration. As a result, it is possible to realize an image forming apparatus that can output high-quality color images.

Moreover, employing a configuration in which the rotation stop portion 530 stops the rotation stop pin 531 at a surface that is perpendicular to the action line 555 makes it possible to retain the photosensitive members 27 more reliably and without exerting excessive counter-forces on the detent shaft 558 and the tip-tapered portion 562.

In addition, employing a configuration in which the rotation stop portion 530 stops the rotation stop pin 531 near the action line 555, makes it possible to retain the photosensitive members 27 more reliably and almost without exerting counter-forces on the detent shaft 558 and the tip-tapered portion 562.

In addition, employing a configuration in which the motor for driving the developer starts to rotate a short time after the motor for driving the photosensitive member, all parts move relatively to each other even when the pushing force of the thrust bearings 69 and 563 is not enough to align the tip-tapered portions 75 and 562 with the tapered surfaces 548 and 561, so that the tip-tapered portions 75 and 562 are sufficiently aligned with the tapered surfaces 548 and 561. Thus, it is possible to precisely and reliably retain the photosensitive members 27 and the image forming units 21 at their correct position in the printer main body 1 with a simple configuration. As a result, it is possible to realize an image forming apparatus that can output high quality color images.

Moreover, providing the thrust guide 556 near the photosensitive member shaft 540 reduces the torque around the coupling portion between the tip-tapered portion 75 and the tapered surface 548, and the tip-tapered portions 75 and 562 can be aligned smoothly with the tapered surfaces 548 and 561, even when the image forming unit 21Y is tilted inside the carriage 22.

Moreover, providing the rotation stop portion 530 and the thrust guide 556 on the same side with respect to the axis of the photosensitive member 27 makes it possible to concentrate members related to positioning in the vicinity thereof, and to increase the positioning precision.

It is also possible to provide either the developer driving input gear 550 or the developer driving gear 552 of this embodiment with play, so that they are not damaged when their teeth abut each other when meshing.

Moreover, "substantially the same plane" means to an extent where no excessive counter-force acts on the detent shaft 558 and the tip-tapered portion 562, and there is no problem in practice if it is within a distance not more than 1/20 of the distance of the supporting positions on both sides of the photosensitive member 540.

Moreover, it is also possible to provide the thrust guide 556 on the side of the image forming units 21, and it also can be provided directly in the apparatus main body.

Third Embodiment

Figure 14:
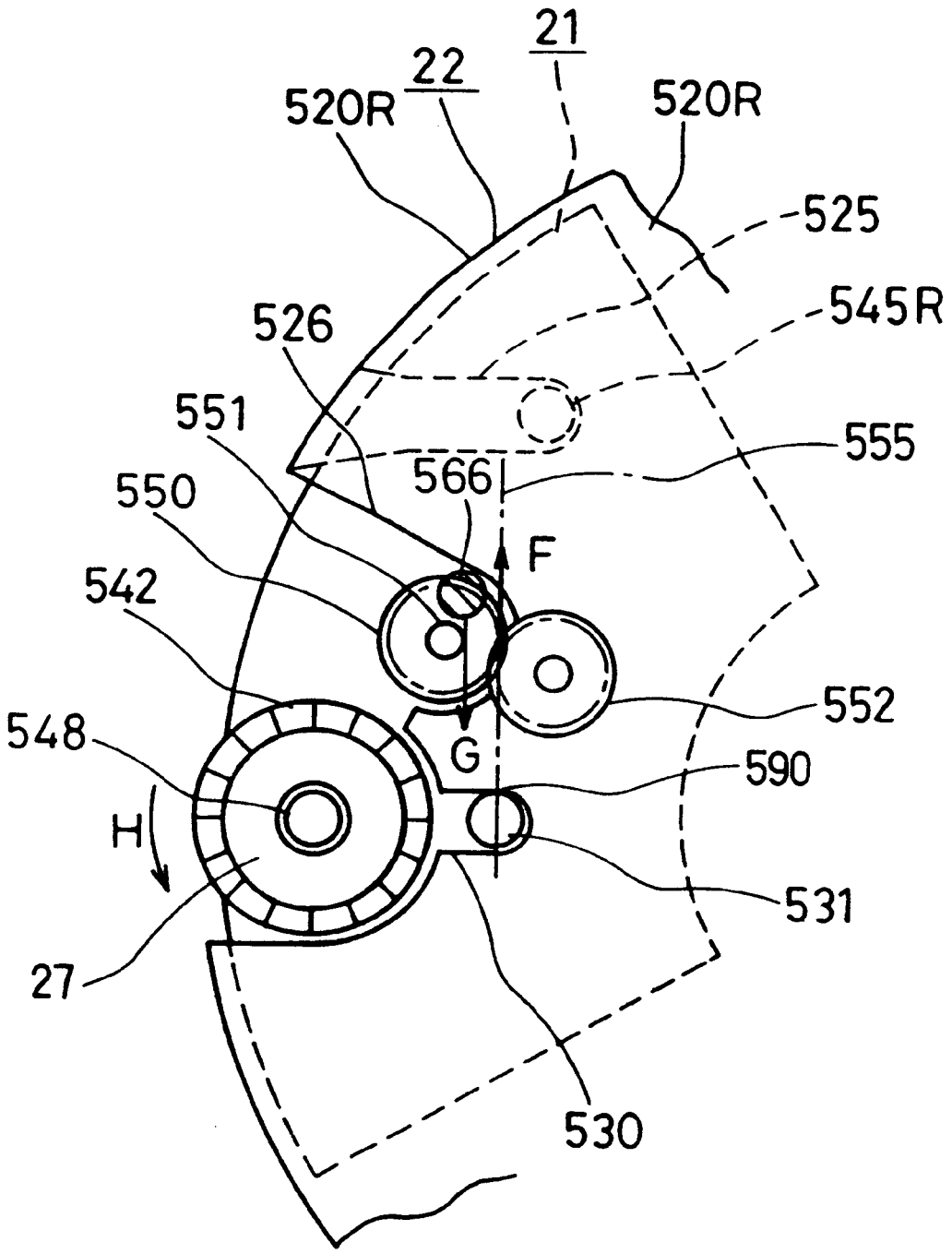
FIG. 14 is a lateral view of an image forming unit and a portion of the carriage in a third embodiment of an image forming apparatus according to the present invention, taken from the right side.

FIG. 14 is a lateral view of an image forming unit and a part of a carriage in accordance with a third embodiment of the present invention.

In FIG. 14, numeral 566 denotes the center of gravity of the image forming unit 21 positioned in the image forming position, and arrow G indicates the direction of the gravitational force acting in the center of gravity 566. In this configuration, the torque that the gravitational force G exerts on the image forming unit 21 with respect to the axis of the photosensitive member 27 is opposite to the direction of the torque on the axis of the photosensitive member 27 caused by the developer driving gear 552. Moreover, in this configuration, the size of the torque due to the gravitational force G is smaller than the size of the torque due to the developer driving gear 552. Other configurational and operational aspects are the same as in the second embodiment, so that their explanation has been omitted.

When the motor for driving the developer starts to rotate, the driving force F exerts a torque in arrow direction H on the image forming unit 2. The gravitational force G exerts a torque around the photosensitive member 27 that acts in the direction opposite to the arrow H. In this situation, since the size of the torque caused by the gravitational force G is smaller than the size of the torque caused by the developer driving gear 552, the image forming unit 21 receives a torque in the direction of arrow H that corresponds to the difference between these torques. The rotation stop force of the image forming unit 21 acting on the rotation stop portion 530 is reduced by this difference, and the danger that the position of the image forming unit 21 is displaced in the rotational orientation becomes smaller than if it receives only the driving force F, so that reliable positioning in the rotational orientation becomes possible. The center of gravity 566 changes with time, as it depends on the amount of toner in the toner hopper 32 and the amount of waste toner in the waste toner reservoir 40, and a configuration is preferable where the above-noted relation stays established during this temporal change. Moreover, it is preferable that the line running vertically through the center of gravity passes between the axis of the photosensitive member 27 and the contact point 590 where the rotation stop portion 530 contacts the rotation stop pin 531, because this way the temporal change of the torque due to the gravitational force G can be reduced.

With this embodiment, the torque around the photosensitive member 27 caused by the gravitational force G acts in the direction opposite to the direction of the torque around the photosensitive member caused by the developer driving gear 552, and the size of the torque caused by the gravitational force G is smaller than the size of the torque caused by the developer driving gear 552, whereby the rotation stop force of the image forming unit 21 on the rotation stop portion 530 can be reduced, and positioning can be performed reliably, because the rotation stop portion is not separated due to the torque around the axis of the photosensitive member 27 caused by the gravitational force G.

The above examples have been explained by way of examples relating to the case of four image forming units 21 of the colors black, yellow, magenta and cyan, but there is no limitation on the type of colors and their number. Moreover, it is also possible to use image forming units with different capacities.

The diameter of the photosensitive members 27 has been given as 30 mm and its circumferential speed as 100 mm/s, but there is no limitation on the diameter and the peripheral speed of the photosensitive members 27. Moreover, the process conditions, such as the developing method, the applied voltages, the circumferential speed of the intermediate transfer belt 4, are not limited to those given as examples in the above embodiments. For example, it is also possible to use a non-magnetic one-component developing process.

Moreover, the configuration of the intermediate transfer belt unit 2 is also not limited to the configuration shown in the above embodiments. There are no limitations on the number of rollers spanning the intermediate transfer belt 4, or their diameters. Moreover, a cleaning blade 7 is used for the belt cleaning means, but the belt cleaning means and its position are arbitrary. Moreover, if the life-expectancy of the intermediate transfer belt 4 is more or less the same as the life-expectancy of the printer main body 1, and there is no need to exchange the intermediate transfer belt 4, a configuration is also possible to have the intermediate transfer belt unit 2 is not removable from the printer main body 1.

Moreover, a retransfer roller 43 is used as a retransfer means, but it is also possible to use another transfer means, such as a coroner charger.

Moreover, the photosensitive member shaft 540 does not have to be a pierced shaft. For example, it is also possible that it is provided as one piece with the left and right flanges 541.

Moreover, the tapered surfaces 548 and 561 do not have to be provided at the ends of the protruding photosensitive member shaft 540. For example, it is also possible that tapered surfaces are provided as holes in the left and right flanges 541 or in the coupling plate 542.

Moreover, the above-noted embodiments have been explained by way of examples relating to cases in which the rotator of the positioned image forming units 21 is the photosensitive member 27, but the rotator is not limited to the photosensitive member 27, and also can be, for example, the developing roller 33, which is a structural member of the image forming unit 21.

Fourth Embodiment

The following is an explanation of the entire configuration and operation of a fourth embodiment of an image forming apparatus in accordance with the present invention, with reference to FIGS. 15 to 21.

Image Forming Units

Figure 15:
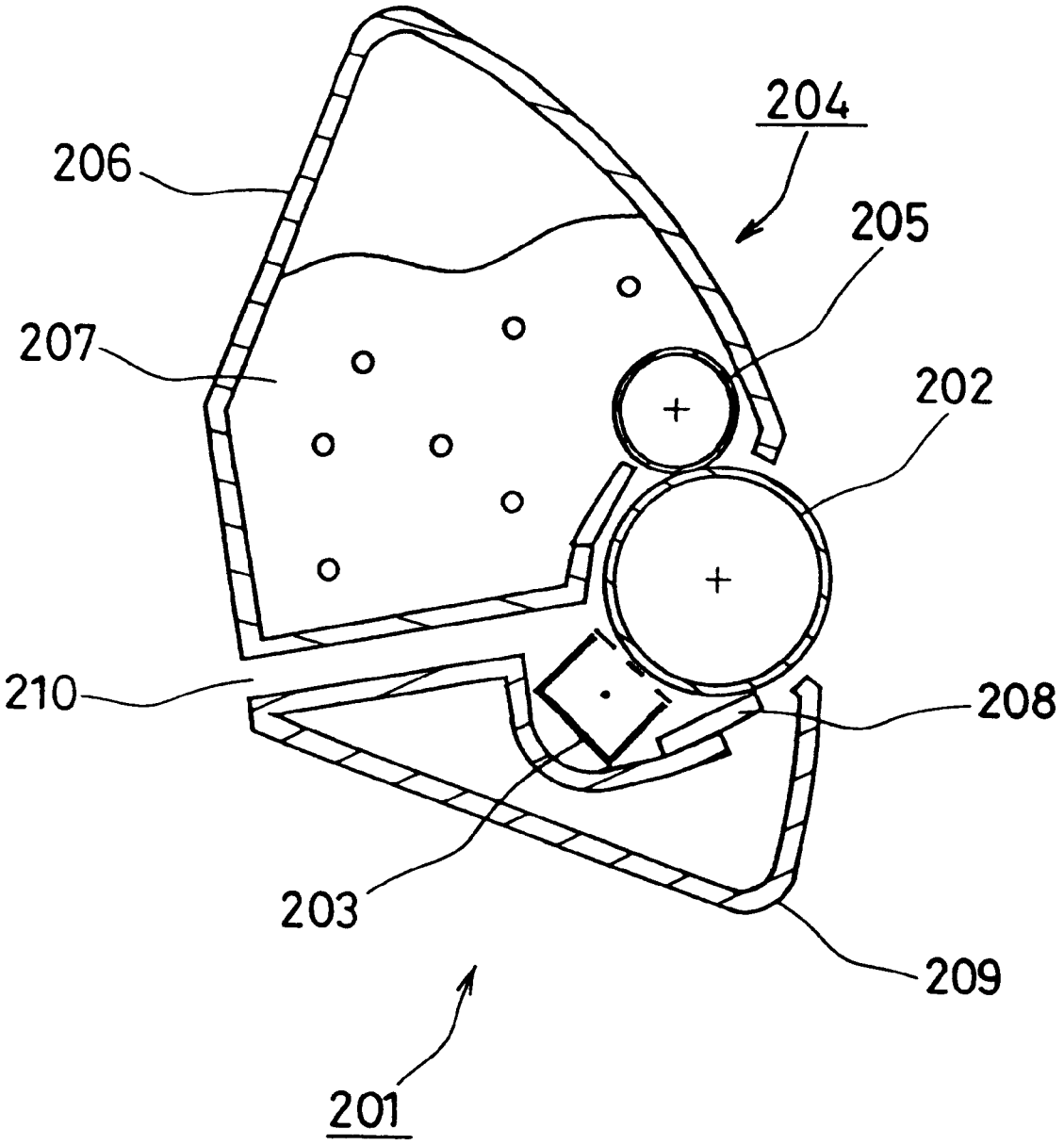
FIG. 15 is a cross sectional view of a fourth embodiment of an image forming unit according to the present invention.

In FIG. 15, numeral 201 denotes an image forming unit, integrating the process elements that are arranged around each of the various photosensitive members 202 of the colors yellow, magenta, cyan, and black. Each image forming unit is made of the following parts.

The photosensitive member 202 is made of a cylinder of aluminum, onto whose surface an organic photosensitive layer is formed. Numeral 203 denotes a corona charger for evenly charging the photosensitive member 202 with a negative charge. Numeral 204 denotes a developer including a developing roller 205 for carrying toner. Numeral 206 denotes a toner hopper. The toner hopper 206 contains a toner 207 that can be negatively charged and is made of polyester resin and a pigment dispersed in the resin.

While contacting the photosensitive member 202, the developing roller 205 rotates at a higher speed than the photosensitive member 202. In the contact portion, latent images on the photosensitive member 202 are developed. Numeral 208 denotes a cleaning blade made of rubber for cleaning off toner remaining on the surface of the photosensitive member 202 after the transfer. Numeral 209 denotes a waste toner reservoir for collecting waste toner. Numeral 210 denotes an exposure window, which is opened so that a laser beam can enter the image forming unit 201. The photosensitive member 202 has a diameter of 30 mm, and the developing roller 205 has a diameter of about 16 mm. The photosensitive member 202 and the developing roller 205 are mounted rotatably on side walls of the image forming unit 201.

Structure of the Entire Apparatus

Figure 16:
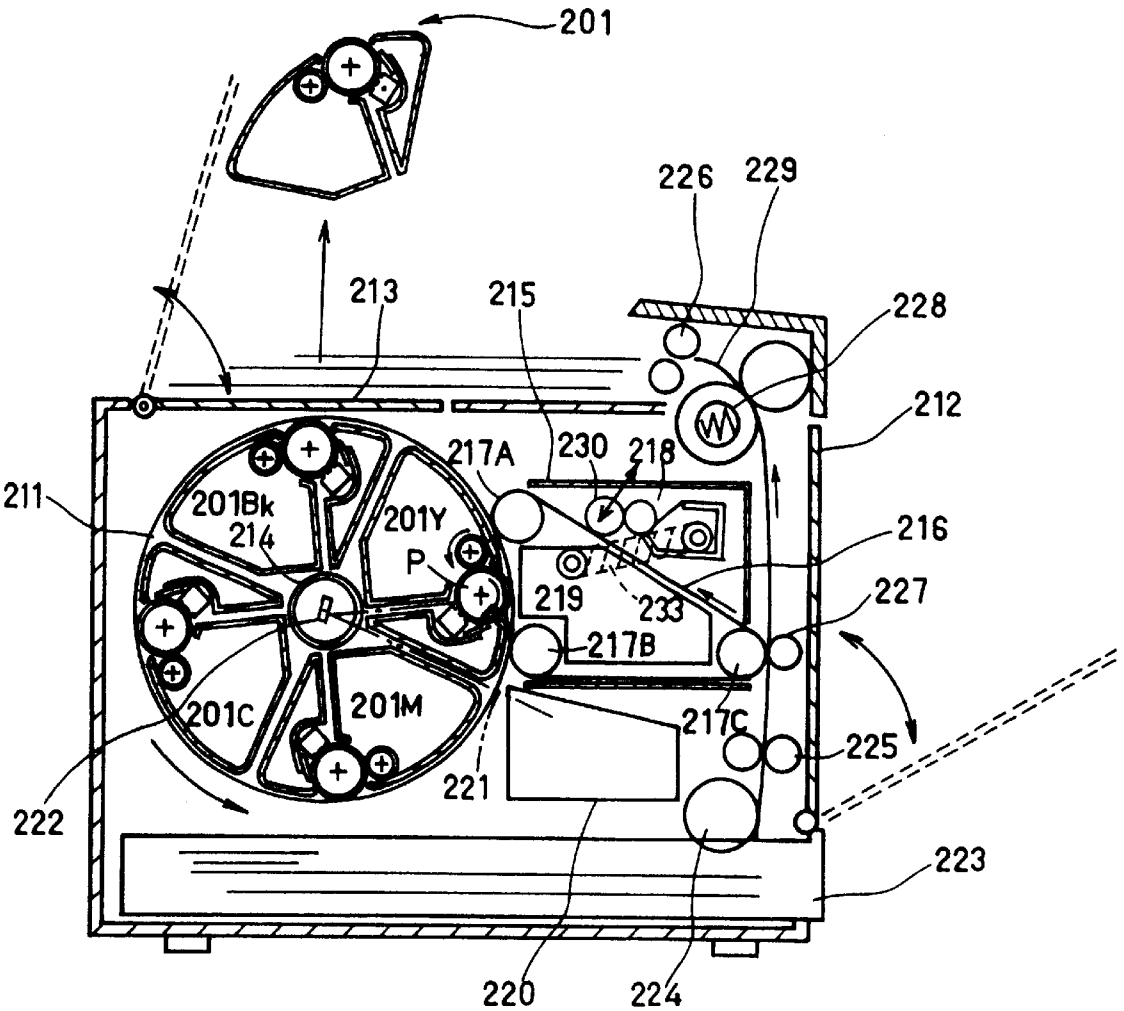
FIG. 16 is a cross sectional view of a fourth embodiment of an image forming apparatus according to the present invention.

As shown in FIG. 16, the right side of which corresponds to the front side of the apparatus, a carriage 211 is provided in the back, a front door 212 is provided in the front and a top door 213 is provided at the top of the apparatus main body.

The carriage 211 carries four color image forming units 201Y, 201M, 201C, and 210Bk for yellow, magenta, cyan, and black. The carriage 211 is mounted so as to be rotatable around a cylindrical shaft 214. Thus, each image forming unit 201 can be rotated successively between the image forming position P and waiting positions, so as to switch the image forming units 201. The image forming units 201 operate only when they are located at the image forming position P, where the intermediate transfer belt unit 215 and the photosensitive member 202 are in contact. All other positions are waiting positions, where the image forming units 201 do not operate.

A clearance of about 2 mm is provided in the radial direction and the in circumferential direction between the image forming units 201 and the carriage 211, whereby the image forming units 201 are retained movably in the carriage 211. Consequently, the carriage 211 moves the image forming units 201 near the image forming position, but it does not perform the precise positioning of the image forming units 201.

The image forming units 201 are mounted removably in the apparatus main body. When an image forming units 201 needs to be replaced, it can be replaced by a new unit after rotating the carriage 211 so that the image forming unit 201 to be exchanged is located underneath the top door 213, and opening the door 213.

The transfer belt unit 215 includes an intermediate transfer belt 216, a driving roller 217A, a tension roller 217B, and a supporting roller 217C for suspending the intermediate transfer belt 216, a cleaner 218, and a waste toner case 219 for collecting waste toner. When the transfer belt unit 215 is mounted in the apparatus main body, the intermediate transfer belt 216 contacts the photosensitive member 202 that is positioned in the image forming position P. At the same time, each portion of the transfer belt unit 215 is electrically connected to the main body and the driving roller 217A is connected to a driving means on the main body side, so that the intermediate transfer belt 216 can rotate.

Numeral 220 denotes an exposure device for emitting a laser signal beam 221 in correspondence with the image information. The laser signal beam 221 passes through the light path formed between the yellow image forming unit 201Y and the magenta image forming unit 201M. Then, the laser signal beam 221 passes a window (not shown in the drawing) in a portion of the cylindrical shaft 214, and is irradiated onto a mirror 222 (fixed to the apparatus main body) inside the cylindrical shaft 214, where it is reflected, and enters the image forming unit 201Y that is positioned in the image forming position P through an exposure window 210 of the yellow image forming unit 201Y. Thereby, the laser signal beam 221 is irradiated onto an exposure portion on the left side of the photosensitive member 202 and scans in the axial direction to expose the photosensitive member 202.

Numeral 223 denotes a paper feed unit. Numeral 224 denotes a paper feed roller, numeral 225 denotes a resist roller, and numeral 226 denotes a paper eject roller. These rollers form a paper path together with the contact point where the intermediate transfer belt 216 contacts the secondary transfer roller 227, and a fixing device 228.

Operation of the Apparatus

The following is an explanation of the color image forming process.

When the transfer belt unit 215 and all image forming units 201 are installed in their predetermined locations, the power for the apparatus main body is turned on, and the fixing device 228 is heated up, while the polygon mirror of the exposing device 220 starts to revolve, thus completing the preparations.

After these preparations are completed, first, an initialization operation is performed to move the image forming unit 201 of the color to be recorded to the image forming position P. In this initialization operation, the carriage 211, which retains all image forming units 201, rotates, and the image forming unit 201 of the color to be recorded first (in the present embodiment the yellow image forming unit 201Y) is moved into the image forming position P in the apparatus main body, where it stops. Thereafter, the positioning and driving mechanism, which will be explained in more detail later, engages the photosensitive member 202, which positions the photosensitive member 202 precisely, while the photosensitive member 202 is rotatable.

First of all, the image formation process of the yellow image forming unit 201Y, which is positioned in the image forming position P, begins. The motor (not shown in the drawing) that is the driving motor at the apparatus main body, starts to rotate the yellow photosensitive member 202 in the image forming position P, and at the same time, the driving roller 217A is driven from the main body, and friction forces rotate the intermediate transfer belt 216 in the arrow direction. At the same time, the charger 203 and the developer 204 start to operate as well. On the other hand, the secondary transfer roller 227 and a fur brush 230 of the cleaner are separated from the intermediate transfer belt 216.

Figure 17:
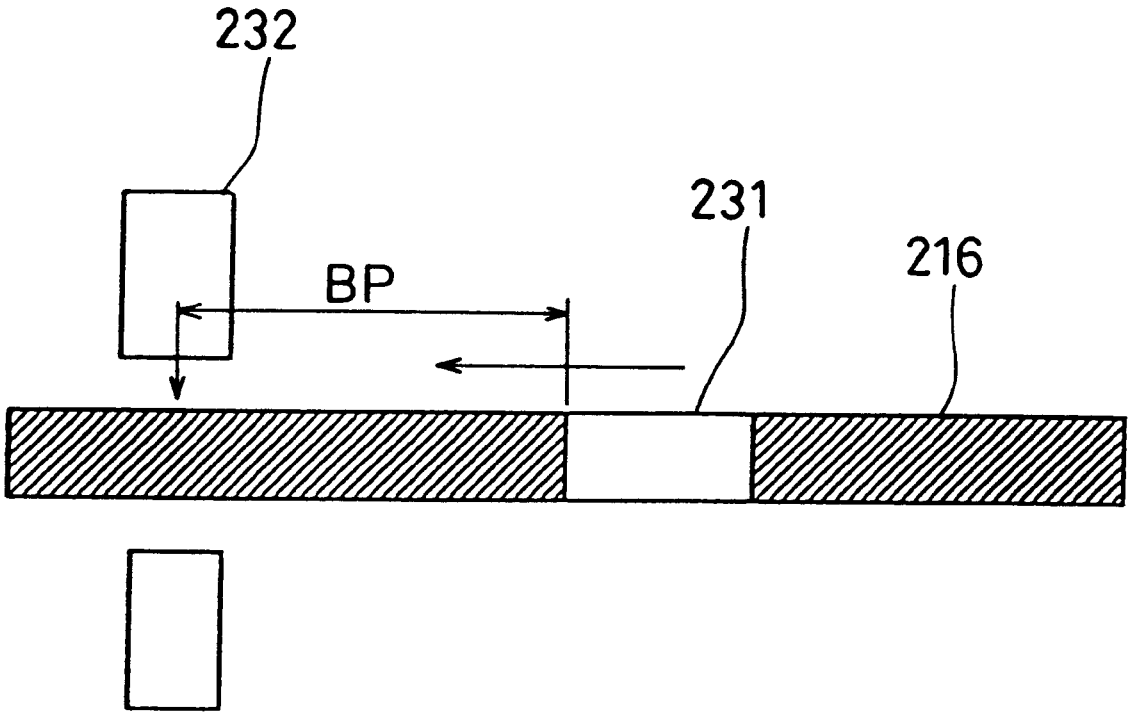
FIG. 17 is a cross sectional view showing a position detection portion for detecting the position of the intermediate transfer belt in the fourth embodiment of the present invention, including a position detection hole provided in the intermediate transfer belt and an optical position detection sensor.

FIG. 17 is a cross sectional view showing a position detection portion for detecting the position of the intermediate transfer belt, including a position detection hole provided in the intermediate transfer belt and an optical position detection sensor. After the intermediate transfer belt 216 has been started and has reached a certain speed, the position detection hole 231 provided in the intermediate transfer belt 216 passes the detection sensor 232. At this time, the position sensor 232 generates a timing reference signal. The laser signal beam 221 emitted from the exposing device 220 forms the static latent image on the photosensitive member 202 in synchronization with this reference signal.

This static latent image is subsequently made manifest by the developing device 204, and a toner image is formed. At a primary transfer position where the photosensitive member 202 contacts the intermediate transfer belt 216, this toner image is transferred onto the intermediate transfer belt 216. When the end of the image has been copied onto the intermediate transfer belt 216, the yellow image formation is finished, and the intermediate transfer belt 216 stops in the initialization position.

At the time of image formation, the charger 203 charges the photosensitive member 202 at −450V. The exposing potential of the photosensitive member 202 is −50 volts. A DC voltage of +100V is applied from a high-voltage source to the developing roller 205, when it passes a region of the photosensitive member 202 that is not yet charged. Then, when the surface of the photosensitive member 202, onto which a static latent image has been inscribed, passes the developing roller, a DC voltage of −250V is applied from a high-voltage source to the developing roller 205. A DC voltage of +1.0 kV is applied to the driving roller 217A and the tension roller 217B of the intermediate transfer belt 216, and the supporting roller 217C is maintained at ground potential.

When yellow image formation is finished and the photosensitive member 202 and the intermediate transfer belt 216 stop, the coupling between the yellow photosensitive member 202 and the positioning and driving mechanism is released, and the carriage 211 rotates 90° in the arrow direction shown in FIG. 16. This moves the yellow image forming unit 201Y away from the image forming position P, and the next, magenta image forming unit 201M is positioned and stopped in the image forming position P. Below, this operation is referred to as "switching operation" for switching the image forming units.

When the magenta image forming unit 201M stops in the image forming position P, the positioning and driving mechanism couples with the magenta photosensitive member 202. After this, the image forming unit 201M and the transfer belt unit 215 start to operate, and an image forming operation is performed, similarly as for yellow. Thus, a magenta toner image are formed overlapping a yellow toner image on the intermediate transfer belt 216.

Thus, sequential switching operations and image forming operations are repeated for cyan and black, so that four toner images are formed on the intermediate transfer belt 216. When the top of the black toner image, transferred by primary transfer, comes to the position of the secondary transfer roller 227, the secondary transfer roller 227 is moved. Then, recording paper, which is fed from the paper feed unit 223, is sandwiched and conveyed between the secondary transfer roller 227 and the intermediate transfer belt 216, and the four-color toner image is transferred in one batch onto the recording paper. During this time, a voltage of +800V is applied to the secondary transfer roller 227. The toner image transferred onto the recording paper is fixed on the recording paper by passing a fixing device 228, and is ejected out of the apparatus with the paper eject rollers 226.

During the secondary transfer, a fur brush 230 of the cleaner 218 contacts the intermediate transfer belt 216, and any toner that has remained on the intermediate transfer belt 216 is scraped off. A screw 233 collects the scraped-off toner into the waste toner case 219. During this time, a voltage of +800V is applied to the fur brush 230.

When the secondary transfer is finished, the intermediate transfer belt 216 and the image forming unit 201 are stopped again, and the carriage 211 rotates 90°. Then, the yellow image forming unit 201Y is again positioned and stopped in the image forming position P, and the color image forming operation is completed.

Positioning and Driving Mechanism

The following is an explanation of the photosensitive member 202 and the mechanism for positioning and driving the photosensitive member 202.

Figure 18:
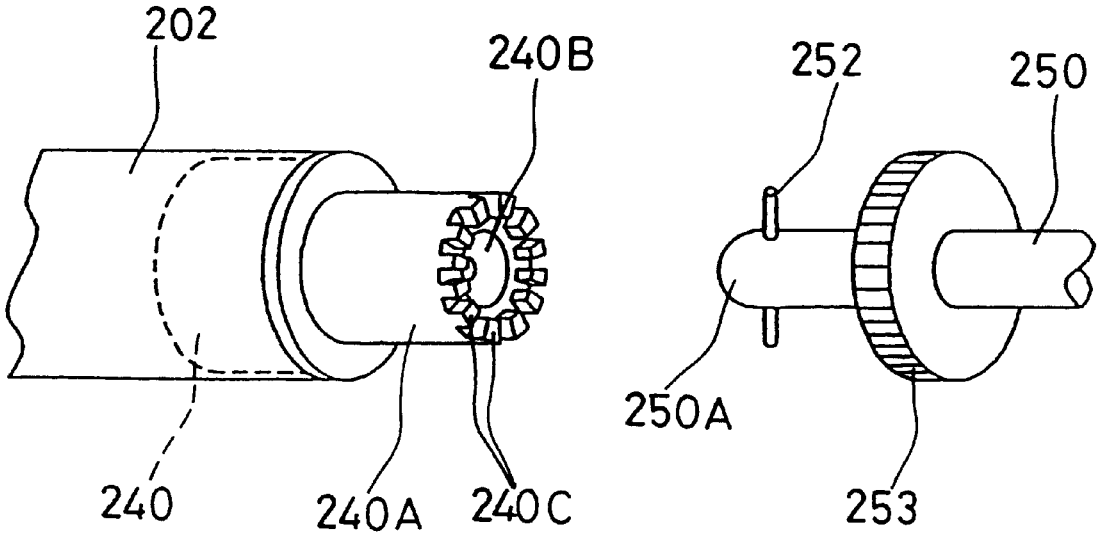
FIG. 18 is a perspective view showing a first flange on the right side of the photosensitive member and a driving shaft provided on the right side of the main body in the fourth embodiment of the present invention.
Figure 19:
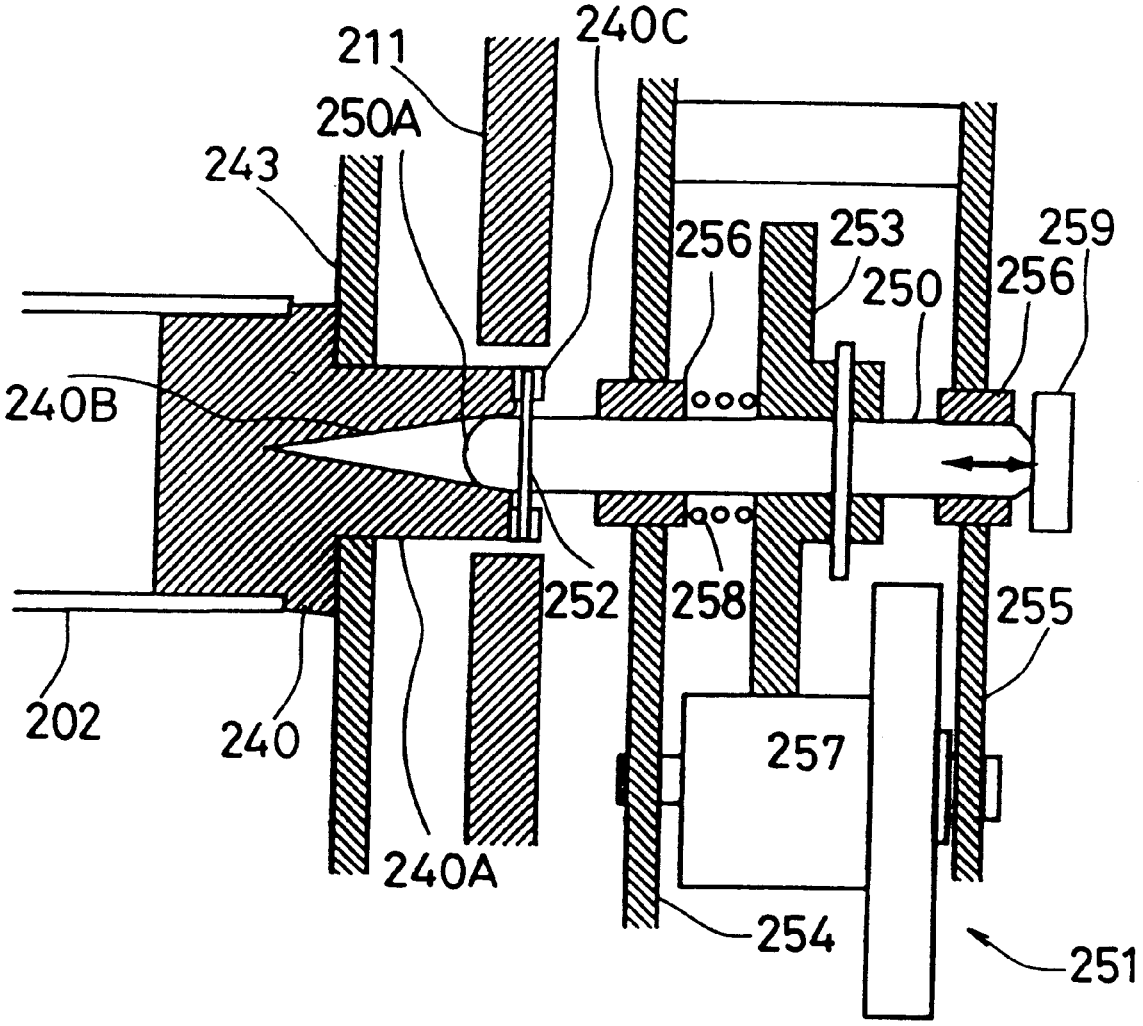
FIG. 19 is a cross sectional view taken at the rotation center of the first flange on the right side of the photosensitive member and the driving shaft provided on the right side of the main body in the fourth embodiment of the present invention.
Figure 20:
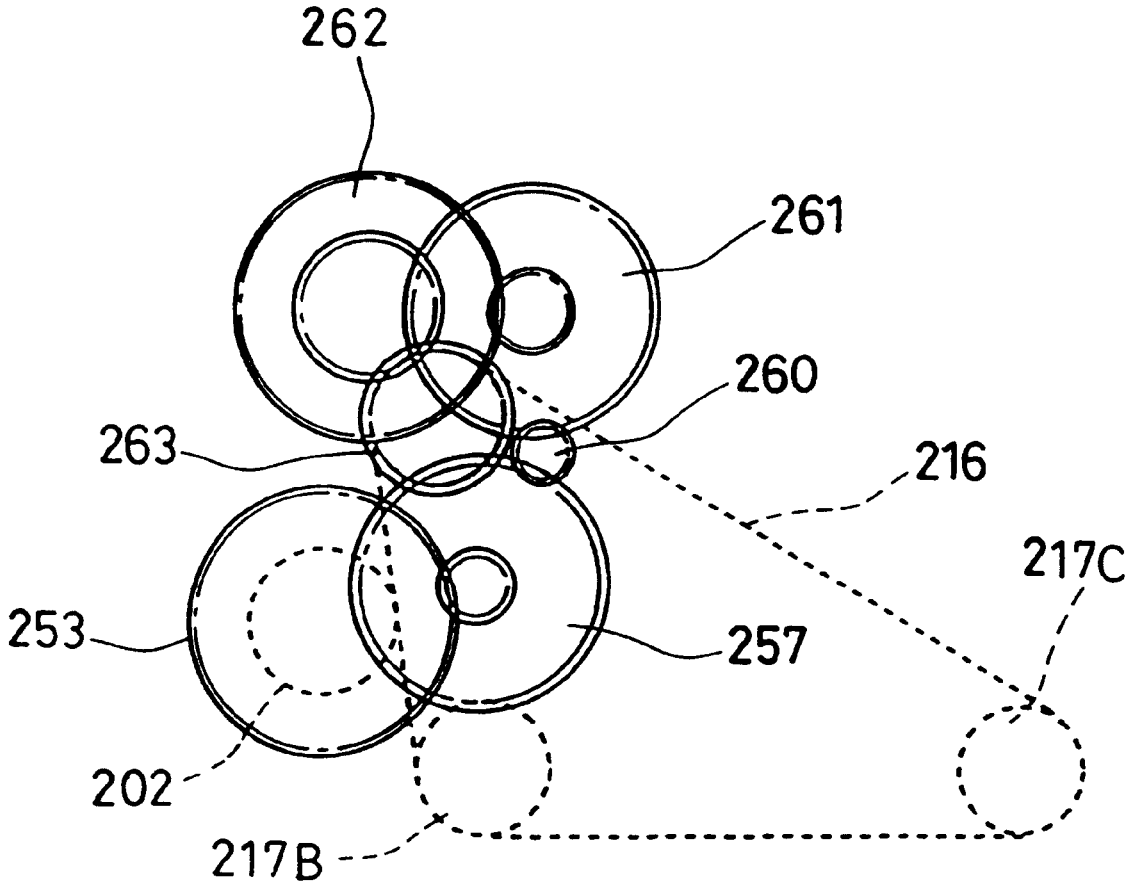
FIG. 20 is a diagram illustrating the driving mechanism on the main body side for driving the photosensitive member and the intermediate transfer belt in the fourth embodiment of the present invention.
Figure 21:
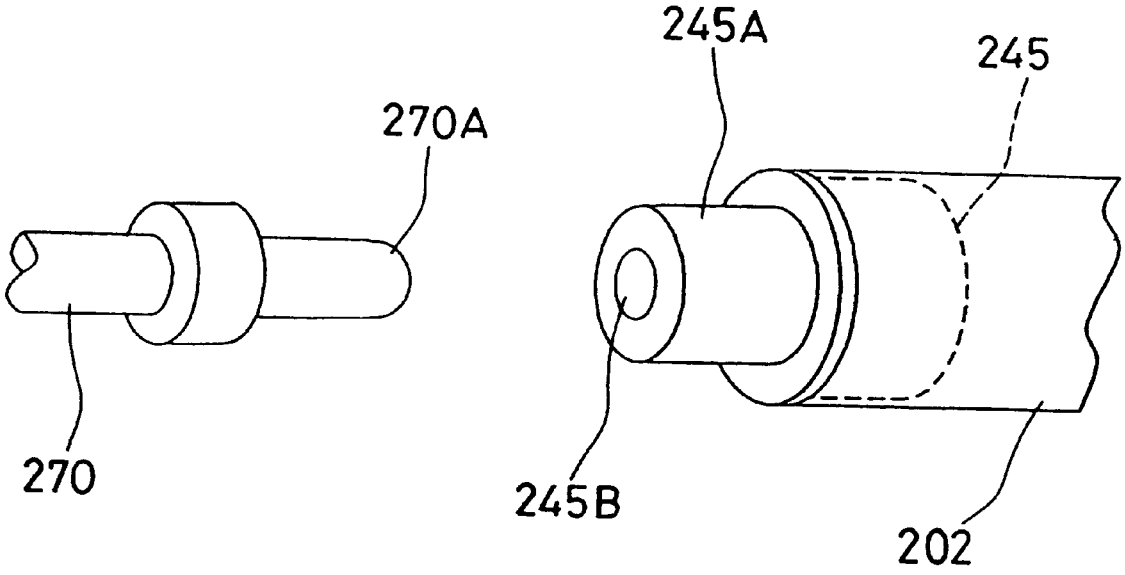
FIG. 21 is a perspective view showing a second flange on the left side of the photosensitive member and a positioning shaft provided on the left side of the main body in the fourth embodiment of the present invention.
Figure 22:
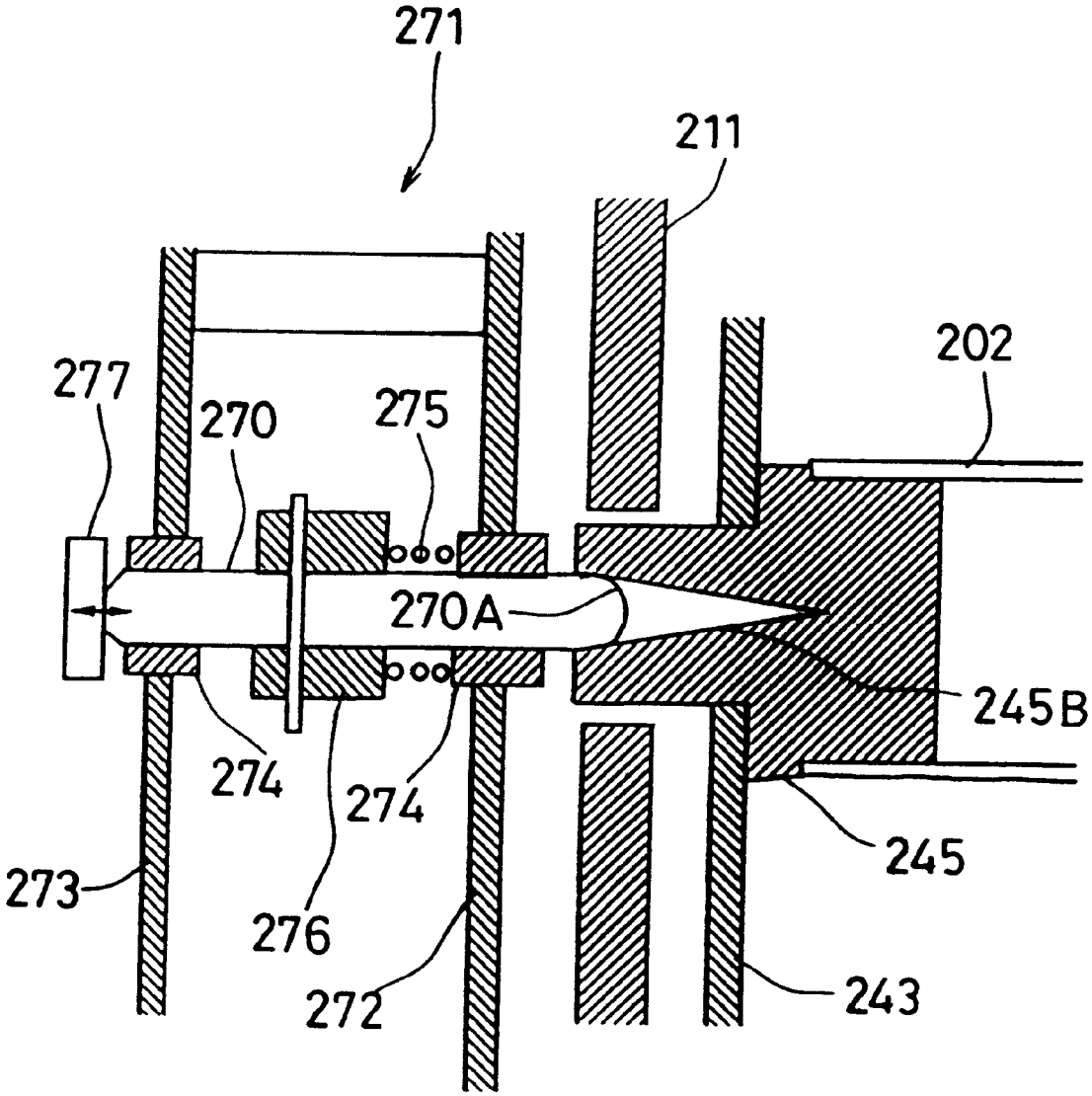
FIG. 22 is a cross sectional view taken at the rotation center of the second flange on the left side of the photosensitive member and the positioning shaft provided on the left side of the main body in the fourth embodiment of the present invention.

FIG. 18 is a perspective view showing a first flange on the right side of the photosensitive member and a driving shaft provided on the right side of the main body. FIG. 19 is a cross sectional view taken at the rotation center thereof. FIG. 20 is a diagram illustrating the driving mechanism on the main body side for driving the photosensitive member and the intermediate transfer belt. FIG. 21 is a perspective view showing a second flange on the left side of the photosensitive member and a positioning shaft provided on the left side of the main body. FIG. 22 is a cross sectional view taken at the rotation center thereof.

As is shown in FIGS. 18, 19, 21, and 22, a first flange 240 is attached to the photosensitive member 202 on the side where it is rotated and driven by the apparatus main body, and a second flange 245 is attached to the photosensitive member 202 on the opposite side thereof. A bearing surface 240A of the first flange 240 and a bearing surface 245A of the second flange 245 support the photosensitive member 202 freely rotatably in the housing 243. Here, the first flange 240 is made of a conductive resin.

A first concave tapered surface 240B is formed at the center of the end face of the first flange 240 of the photosensitive member 202, and twelve follower tongues made of convex and concave portions are arranged at equal intervals around the first concave tapered surface 240B. The first concave tapered surface 240B is coaxial with the center axis of the photosensitive member 202. Its tip angle is about 20°, and its diameter at the edge is set at about 9 mm.

Moreover, in a center portion of the end surface of the second flange 245 on the opposite side of the photosensitive member 202, a second concave tapered portion 245B is formed, which is similar to the first concave tapered portion 240B.

The following is an explanation of the positioning and driving mechanism of the photosensitive member.

As is shown in FIGS. 18 and 19, the positioning and driving mechanism 251 includes a driving shaft 250, a pin-shaped transmission tongue 252, a driving shaft gear 253, and driving mechanism for driving the same.

The driving shaft 250 is supported by bearings 256 fixed to a right panel 254 of the main body and a driving panel 255, and is rotatable and movable in a thrust direction. The diameter of the driving shaft 250 is 8 mm, and a spherical surface 250A is formed at its tip. When it is pushed into the first concave tapered surface 240B of the first flange 240, the spherical surface 250A enters the first concave tapered surface 240B. In the following, the position where the spherical surface 250A enters the first concave tapered surface 240*b* and the two are coupled is referred to as "coupling position".

The transmission tongues 252 mesh with the follower tongues 240C, to which they transmit a motive force. The transmission tongues 252 are fixed to the driving shaft 250, and rotate together with the driving shaft 250. The driving shaft gear 253 is fixed to the driving shaft 250, and this driving shaft gear 253 meshes with a motor-side gear 257 supported by the right panel 254 of the main body and the driving panel 255. Numeral 258 denotes a compression spring, which is inserted between the bearing 256 of the main body-side panel 254 and driving shaft gear 253. This compression spring 258 is steadily energized toward the position where the driving shaft 250 and the transmission tongues 252 are separated from the photosensitive member 202. The driving shaft 250 can be moved against the force of the spring with the thrust bearing 259, between a separation position and the coupling position. The motor-side gear 257 has a sufficient broad teeth width so that the driving shaft gear 253 meshes with the motor-side gear 257 in the separated position as well as in the coupling position.

As is shown in FIG. 20, the motor-side gear 257 meshes with a motor gear 260 of the driving motor, and this motor gear 260 transmits a driving force to a belt driving shaft gear 263, which is attached to the driving roller 217 A of the intermediate transfer belt 216, via a belt transmission gear 261 and a belt driving gear 262.

The following is an explanation of a positioning mechanism 271 for positioning the photosensitive member 202 on the left side of the main body, referring to FIGS. 21 and 22.

The positioning mechanism 271 includes a positioning shaft 270 and a mechanism for shifting the positioning shaft 270 into a thrust direction.

The positioning shaft 270 is supported by a bearing 274 fixed to a left panel 272 of the main body and a support panel 273, and is rotatable and movable in a thrust direction. Same as for the driving shaft 250, the diameter of the positioning shaft 250 is 8 mm, and a spherical surface 270A is formed at its tip. When it is pushed into the second concave tapered surface 245B of the second flange 245, the spherical surface 270A enters the second concave tapered surface 245B. In the following, the position where the spherical surface 270A enters the second concave tapered surface 245B and the two engage is referred to as "coupling position".

Numeral 275 denotes a compression spring, which is inserted between the bearing 274 and a thrust plate 276. This compression spring 275 is steadily energized in the position where the positioning shaft 270 is separated from the second flange 245. The positioning shaft 270 can be moved against the force of the spring with the thrust bearing 277, between a separation position and a coupling position.

Driving Operation for Positioning and Rotation

Figure 23:
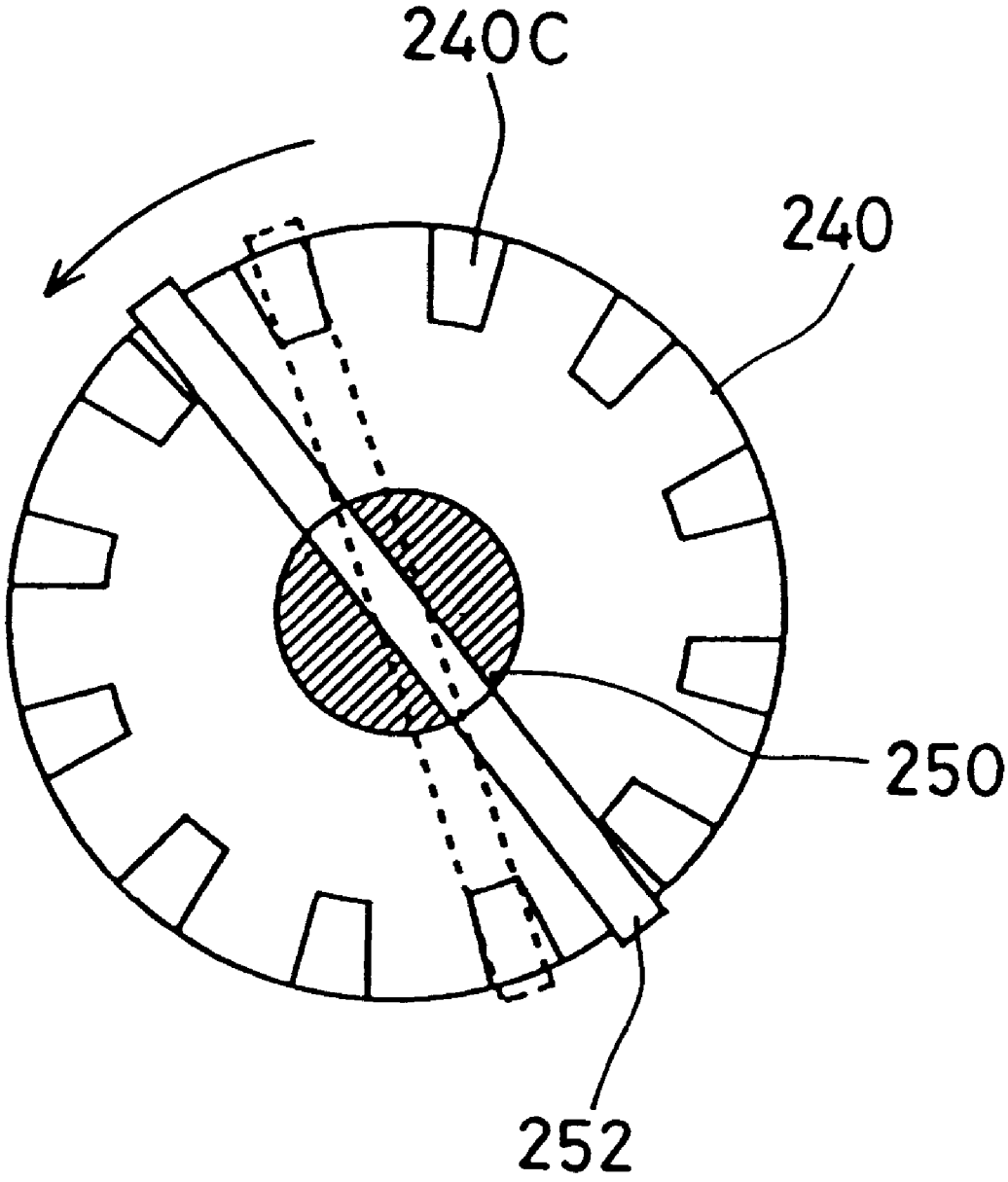
FIG. 23 is a cross sectional view of the first flange and the driving shaft in the fourth embodiment of the present invention, seen from the direction of the driving shaft.
Figure 24:
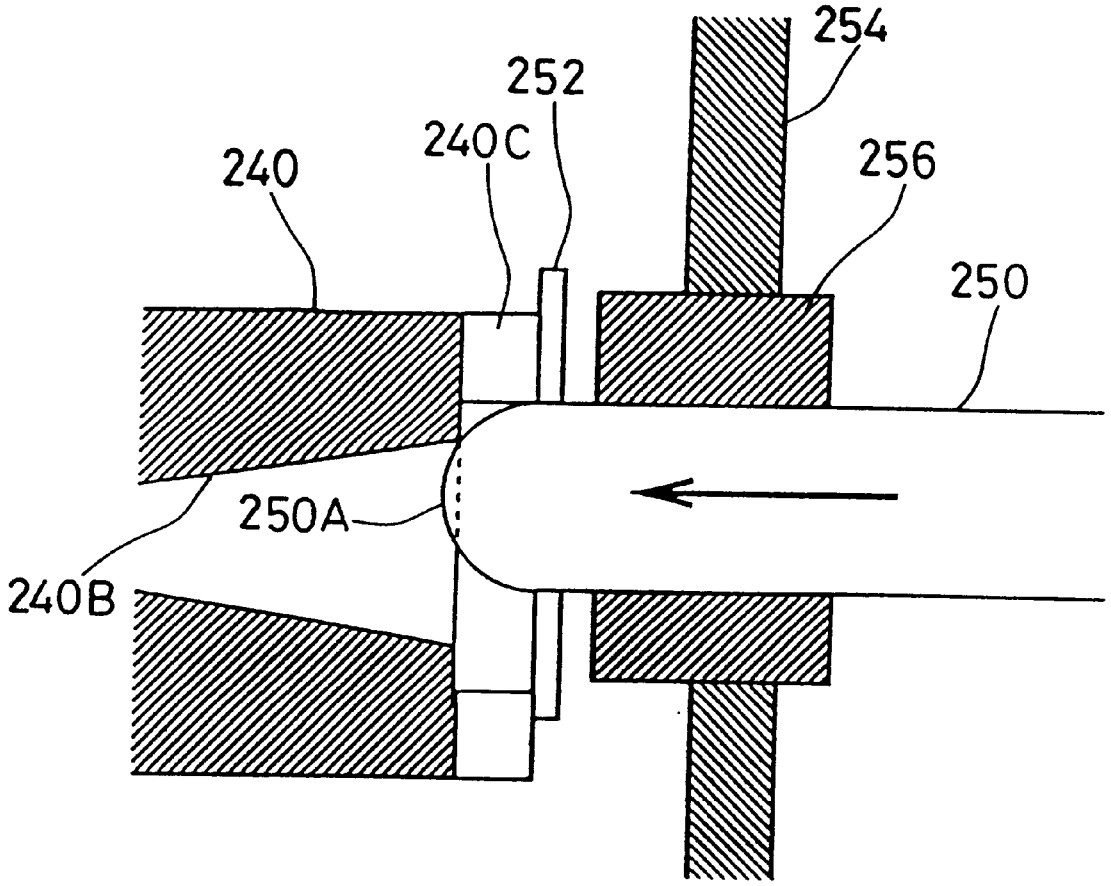
FIG. 24 is a cross sectional view through the rotation center of the first flange and the driving shaft in the fourth embodiment of the present invention, when the driving shaft is moving from the separation position to the coupling position.
Figure 25:
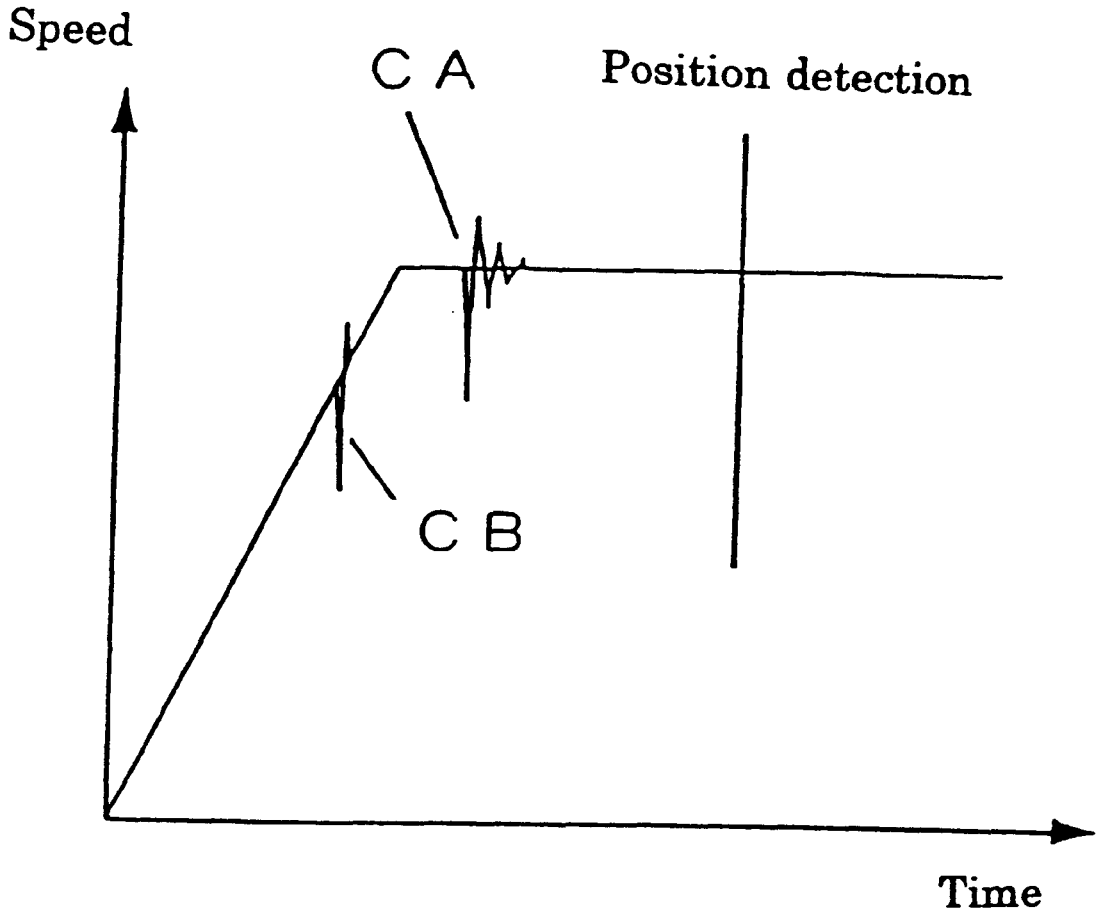
FIG. 25 is a graph illustrating the speed of the driving motor at the beginning of the image formation in the fourth embodiment of the present invention.

The following is an explanation of the driving operation for positioning and rotation of the photosensitive member. FIG. 23 is a cross sectional view of the first flange and the driving shaft, seen from the direction of the driving shaft. FIG. 24 is a cross sectional view through the rotation center of the first flange and the driving shaft, when the driving shaft is moving from the separation position to the coupling position. FIG. 25 is a graph illustrating the speed of the driving motor at the beginning of the image formation.

When the image forming unit 201 has been shifted to the image forming position P in the apparatus main body, the thrust bearing 277 moves the positioning shaft 270 of the main body side in the thrust direction, and the spherical surface 270A at the tip of the positioning shaft 270 is coupled with the second concave tapered surface 245B of the second flange 245, thereby positioning the photosensitive member. In this coupling position, the center of the spherical surface 270A has entered the second concave tapered surface 245B. When the photosensitive member 202 rotates, the second flange 245 and the positioning shaft 270 rotate together due to friction forces.

At the same time, the thrust bearing 259 shifts the driving shaft 250 with the transmission tongues 252 into the thrust direction. In this situation, if the transmission tongues 252 and the follower tongues 240C mesh with each other as shown by the solid line in FIG. 23, the follower tongues 240C and the transmission tongues 252 engage. Then, the spherical surface 250A at the tip of the driving shaft 250 engages the first concave tapered surface 240B of the first flange 240, thereby positioning the photosensitive member 202. In this coupling position, the center of the spherical surface 250A has entered the first concave tapered surface 240B.

The driving shaft 250 is rotated by the driving motor of the apparatus main body. This rotational force is transmitted onto the follower tongues 240C of the first flange 240 via the transmission tongues 252, and rotates the photosensitive member 202. As a result, the line that connects the spherical surface 250A at the tip of the driving shaft 250 with the spherical surface at the tip of the positioning shaft 270 becomes the rotation center of the photosensitive member 202.

The dashed line in FIG. 23 shows the situation when the transmission tongues 252 abut the follower tongues 240C of the first flange 240 while the driving shaft 250 is shifted in the engagement direction (direction of the photosensitive member). In this case, the driving shaft 250 temporarily stops in a position where the transmission tongues 252 abut the follower tongues 240C, as shown in FIG. 24. The transmission tongues 252 are provided at a position 5 mm away from the tip of the driving shaft 250, and the height of the follower tongues 20C is set to 3.5 mm, so that the tip of the driving shaft 250 still can enter the first concave tapered surface 240B even in this case.

If the driving motor in the apparatus main body rotates the driving shaft 250 in this situation where the follower tongues 240C and the transmission tongues 252 do not mesh with each other, at first the transmission tongues 252 rotate, but the photosensitive member 202 does not rotate. Then, as the transmission tongues 252 rotate and come into the position between the follower tongues 240C, the transmission tongues enter and mesh with the follower tongues 240C. This makes it possible to transmit a rotation force from the driving shaft 250 to the photosensitive member 202. At the same time, the positioning shaft 270 enters the second concave tapered surface 245B, and positions the photosensitive member 202. As a result, the line that connects the centers of the spherical surfaces 270A and 250A on the left and right becomes the rotation center of the photosensitive member 202.

With this operation, the positioning shaft 270 and the driving shaft 250 position the photosensitive member 202 of the image forming unit 201 that the carriage 211 has moved near the image forming position P precisely in the image forming position P. Since a clearance is provided between the carriage 211 and the image forming unit 201, the carriage 211 does not disturb the movement of the image forming unit 201 containing the photosensitive member 202.

The pitch between the follower tongues 240C is set to 30° with the rotation shaft at the center. On the other hand, the interval BP between the position detection hole 231 and the detection sensor 232 at the time when the intermediate transfer belt 216 stops, as shown in FIG. 17, is set to 30 mm. Moreover, the rotation angle of the driving axis 250 while the intermediate transfer belt 216 travels 30 mm is 120°. Consequently, even in the slowest possible meshing between the follower tongues 240C and the transmission tongues 252, the detection hole 231 passes the detection sensor 232 after a rotation of 90° after the meshing. In this case, the load variation due to the meshing of the follower tongues 240C with the transmission tongues 252 brings about a speed variation of the driving motor as shown by CA in FIG. 25. While the driving motor settles these speed variations, the driving shaft 250 rotates only about 30°. Consequently, a detection signal for the reference position of the intermediate transfer belt 216 is generated after the speed variations brought about by the load variations due to the meshing have settled down.

As described above, the tip of the driving shaft 250 is spherical, and the coupling portion of the first flange 240 is conical. Similarly, the tip of the positioning shaft 270 is spherical, and the coupling portion of the second flange 245 is conical. Therefore, even when the driving shaft 250, the positioning shaft 270 and the photosensitive member 202 are coupled while their axes are tilted against each other, the contact portions of the coupling portions are circles formed by the intersection between a plane perpendicular to the axis of the photosensitive member 202 and the conical surface. Consequently, the photosensitive member 202 can be held and controlled over the entire periphery. As a result, it is possible to hold and position the photosensitive member 202 reliably. Moreover, since the line that connects the centers of the left and right spherical surfaces 270A and 250A usually becomes the rotation center of the photosensitive member 202, the rotation center of the photosensitive member 202 can be positioned with good reproducibility.

Moreover, since the first and second concave tapered surfaces 240B and 245B contact the spherical surfaces 250A and 270A in a circle extending around the entire periphery, the coupling portion does not misalign. Thus, the rotation center of the photosensitive member 202 can be controlled reliably. As a result, variations in the rotation speed of the photosensitive member can be prevented, and a favorable image can be obtained without positional misalignments.

Moreover, when the transmission tongues 252 reach the tip position of the follower tongues 240C as shown in FIG. 24, the tip of the driving shaft 250 enters the first concave tapered surface 240B of the first flange 240, so that the driving shaft 250 can be coupled securely with the first concave tapered surface 240B of the photosensitive member 202 even when a force acts in the radial direction of the photosensitive member 202 where the transmission tongues 252 abut the follower tongues 240C. Moreover, when the transmission tongues 252 are moved toward the photosensitive member 202, and when the tips of the transmission tongues 252 reach the tip position of the follower tongues 240C, the inner peripheral surface of the convex portions of the follower tongues 240C are closer to the rotation center than the outermost peripheral portion of the transmission tongues 252. Therefore, when the driving shaft 250 is moved toward the photosensitive member 202 and the photosensitive member 202 is being positioned, the inner peripheral surface of the follower tongues 240C on the side of the photosensitive member 202 cannot abut the outer peripheral surfaces of the transmission tongues 252 on the side of the driving shaft 250. As a result, the photosensitive member 202 is moved securely in a radial direction, and the photosensitive member 202 can be positioned at its correct position.

Moreover, the pitch between the convex and concave portions of the follower tongues 240C is smaller than the rotation angle of the driving shaft 250 from the time when the motor is started until the reference position detection signal for the intermediate transfer belt 216 is generated. Therefore, the speed variations brought about by the meshing between the transmission tongues 252 and the follower tongues 240C have settled down when the reference position of the intermediate transfer belt 216 is detected. As a result, the reference position of the intermediate transfer belt 216 is detected after the speed of the intermediate transfer belt 216 has been stabilized, and anomalous speed variations do not occur after the reference position has been detected, so that the positions of the images on the intermediate transfer belt 216 can be aligned precisely.

In this embodiment, the positioning shaft 270 rotates together with the second flange due to friction, but there is no necessary limitation to this configuration, and the same effect also can be attained if the positioning shaft 270 is fixed in the rotation direction. In this case, the positioning shaft is movable only in an axial direction, and the spherical surface 270A at the end slides on the contact portion with the second concave tapered surface 245B.

Fifth Embodiment

Figure 26:
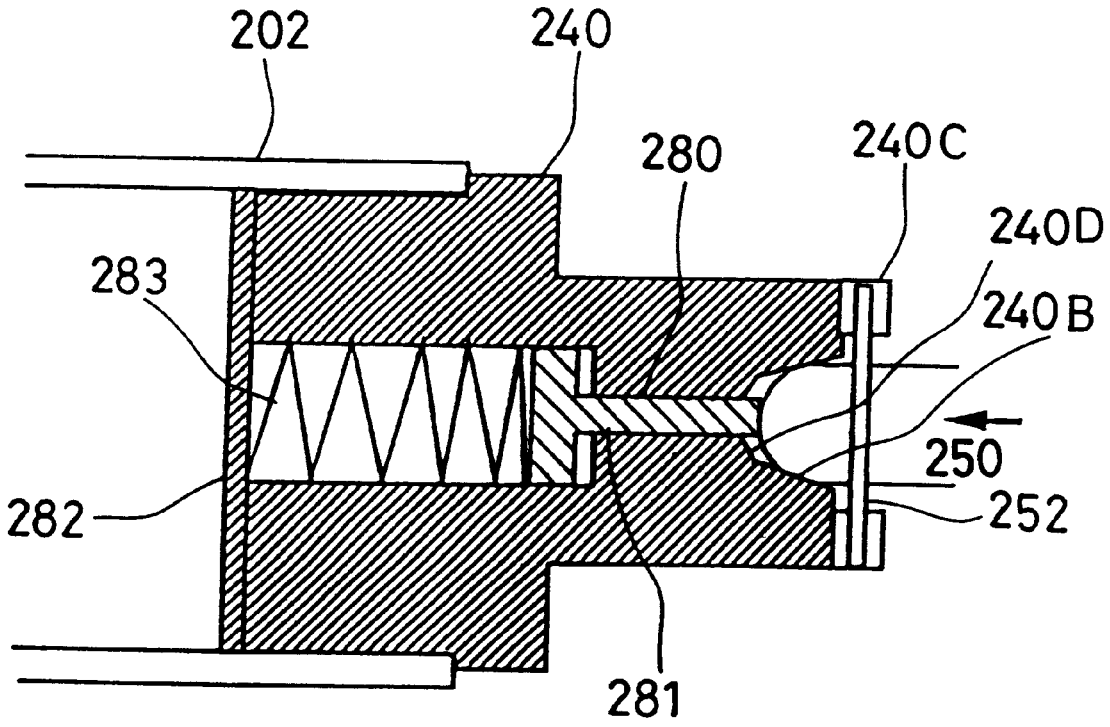
FIG. 26 is a cross sectional view of a fifth embodiment of the present invention, taken at the rotation center of the coupling portion of the first flange on the driving side and the driving shaft.
Figure 27:
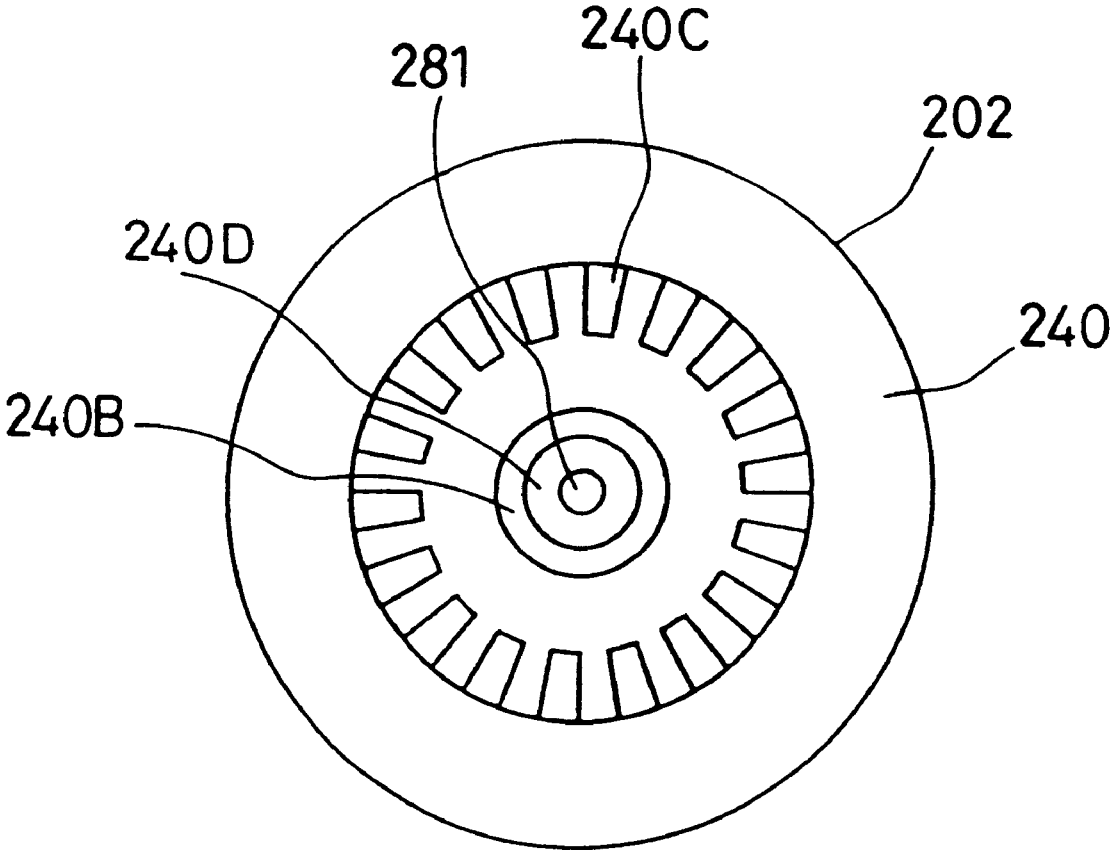
FIG. 27 is a lateral view of the first flange in the fifth embodiment of the present invention, seen from the direction of the end surface.

FIG. 26 is a cross sectional view of a fifth embodiment of the present invention, taken at the rotation center of the coupling portion of the first flange on the driving side and the driving shaft. FIG. 27 is a lateral view of the first flange, seen from the direction of the end surface. Different from the above fourth embodiment, the first flange 240 is made of an insulating polycarbonate. Moreover, the tip of the first concave tapered surface 240B is provided with a tapered surface 240D with a tip angle that is larger than that of the tapered surface 240B, which tapered surface 240D is separated from but in close vicinity to the driving shaft 250. Moreover, the follower tongues 240C of the first flange 240 of the photosensitive member 202 are formed by 20 convex and concave portions arranged at equal intervals.

The center of the tapered surface 240C is provided with a through hole 280, leading into an inner portion of the photosensitive member 202 in the axial direction. An electrode member 281 made of metal is retained in the through hole 280 and is movable in the axial direction. A metal plate 282 is attached to the end surface of the side opposite to the first concave tapered surface 240B of the first flange 240, where it contacts the drum cylinder of the photosensitive member 202. A pressure spring 283 is provided between the metal plate 282 and the electrode member 281, and this pressure spring 283 biases the electrode member 281 toward the flange end surface (in the direction of the first concave tapered surface 240B). As is shown in FIG. 26, when the photosensitive member 202 is being positioned, the tip of the driving shaft 250 abuts the electrode member 281. At this time, the force of the pressure spring 283 is pressing the electrode member 281 in the direction of the tip of the driving shaft 250. This establishes an electrical connection from the driving shaft 250 to the drum cylinder of the photosensitive member 202 through the electrical member 281, the pressure spring 283, and the metal plate 282, so that the drum cylinder of the photosensitive member 202 can be drawn to ground potential. All other structural elements and operations are the same as in the fourth embodiment.

The following is an explanation of an image forming apparatus and the operation of the image forming units with such a configuration.

When the coupling between the driving shaft 250 and the first concave tapered surface 240B is repeated in the fourth embodiment, there is the danger that the first concave tapered surface 240B is deformed. Therefore, if the driving shaft 250 is not moved beyond its regular position to the tip of the first concave tapered surface 240B the driving shaft 250 cannot press onto the first concave tapered surface 240B anymore. If at this time the stroke of the driving shaft 250 in the axial direction is short, the driving shaft 250 does not press sufficiently onto the photosensitive member 202, so that the driving shaft 250 cannot hold the photosensitive member 202 completely, and the danger arises that the position of the photosensitive member 202 varies.

In this embodiment, the tip of the first concave tapered surface 240B is provided with a tapered surface 240D whose tip angle that is larger than that of the tapered surface 240B, which tapered surface 240D contacts and separates from the driving shaft 250, so that even when the first concave tapered surface 240B is deformed and the driving shaft 250 attempts to enter the first concave tapered surface 240B beyond a certain position, the tip of the driving shaft 250 abuts the tapered surface 240D, which has a large tip angle. Consequently, it can be prevented that the driving shaft 250 enters much beyond a certain position into the tapered portion. As a result, it is possible to set a small moving stroke in the axial direction for the driving shaft 250.

Moreover, in the fourth embodiment, a conductive resin is used for the material of the first flange 240, but if a conductive resin is used, there is the problem that such a resin is brittle and may break. In addition, since an electrically conductive path is established through the first concave tapered surface 240B with unreliable contact, there is the problem that a poor conduction may occur easily, which can lead to corruption of the image.

With this embodiment, however, the electrode member 281 contacts the driving shaft 250 at the rotation center of the coupling portion where the relative displacement amount is the smallest, so that a secure electrical conduction can be established also during rotation. In addition, the electrode member 281 and the driving shaft 250 rotate together, and do not slide at the contact face, so that an even more secure electrical conduction can be established.

Moreover, the pitch of the concave and convex portions of the follower tongues 240C is 16° with the rotation axis as the center. On the other hand, the rotation angle of the driving shaft 250 is about 25° from the start of the driving motor for the photosensitive member 202 until a certain speed is reached. Therefore, even in the slowest possible case for the meshing of the follower tongues 240C and the transmission tongues 252C, load variations due to the meshing occur during the acceleration of the driving motor, as shown by CB in FIG. 25. Since the motor of the driving motor is driven with the largest current during the acceleration, the speed variations are small even when a load is added. Consequently, after the occurrence of load variations, the time to settle down speed variations caused by the load variations is short.

This means that even in the slowest possible case for the meshing of the follower tongues 240C and the transmission tongues 252C, the speed of the intermediate transfer belt 216 can be stabilized in a short time. Consequently, after the motor that is the driving motor has been started, and the reference position of the intermediate transfer belt 216 is detected at a certain time, anomalous speed variations do not occur after this position detection. Thus, speed variations of the intermediate transfer belt 216 after the generation of the reference signal can be prevented. As a result, positional misalignments can be prevented for each color.

Thus, with this embodiment, providing the tip of the first concave tapered surface 240B with a tapered surface 240D whose tip angle that is larger than that of the tapered surface 240B, the photosensitive member 202 can be pressed securely by the driving shaft 250, even when the stroke of the driving shaft 250 in the axial direction is small, and as a result, the photosensitive member 202 can be held securely by the driving shaft 250. Moreover, by providing an electrode member 281 at the center of the tapered surface 240D, secure electrical conduction between the driving shaft 250 and the cylinder of the photosensitive member 202 can be established even during rotation. Moreover, it is possible to use for the first flange 240 a low-price molded product of a resin with high strength. In addition, since the tip angle of the tapered surface 240D of the first flange 240 is large, it can hold the electrode member 281, which moves in the axial direction, up to the vicinity of the point of contact with the driving axis 250. Moreover, even in the slowest possible case for the meshing of the follower tongues 240C and the transmission tongues 252C, load variations due to the meshing occur during the acceleration of the driving motor, so that speed variations of the intermediate transfer belt 216 after the generation of the reference signal can be prevented. As a result, positional misalignments can be prevented for each color.

In this embodiment, the electrode member 281 is provided at the first flange 240, which couples with the driving shaft 250, but there is no limitation to this configuration, and the same effect can be obtained if the electrode member 281 is provided at the second flange 245, which couples with the positioning shaft 270.

Sixth Embodiment

Figure 28:
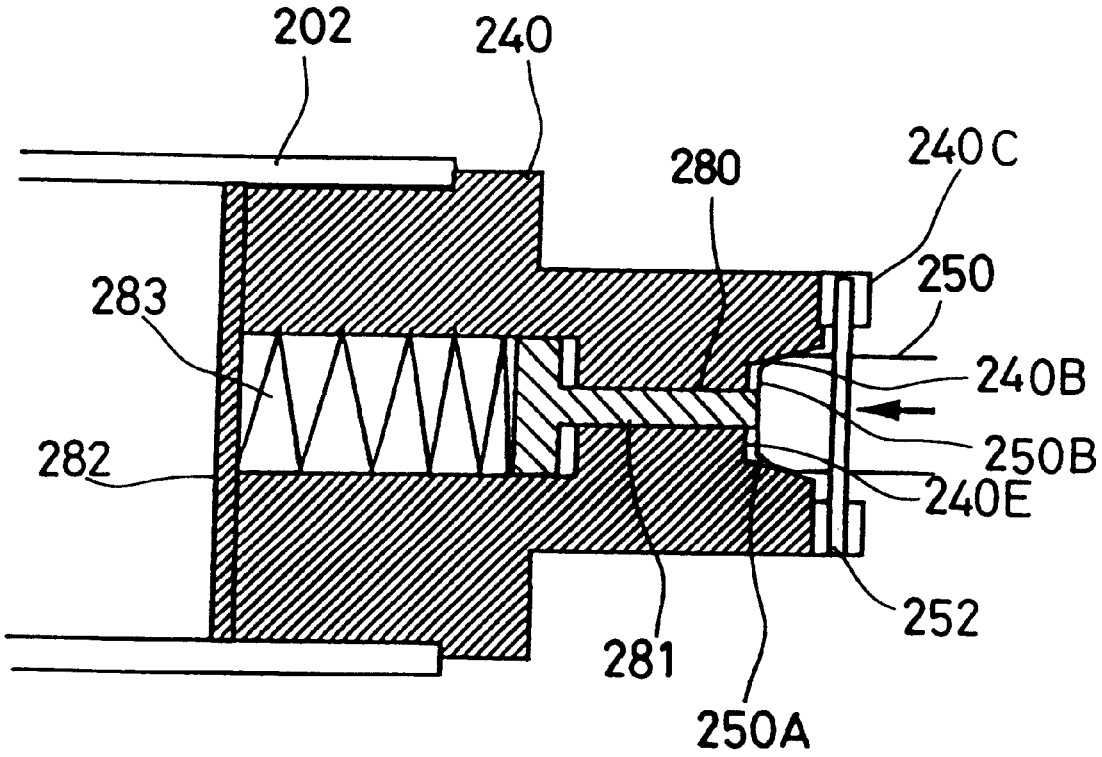
FIG. 28 is a cross sectional view of a sixth embodiment of the present invention, taken at the rotation center of the coupling portion of the first flange on the driving side and the driving shaft.

FIG. 28 is a cross sectional view of a sixth embodiment of the present invention, taken at the rotation center of the coupling portion of the first flange on the driving side and the driving shaft. Different from the above-noted fifth embodiment, a flat surface 240E that is perpendicular to the rotation axis is formed at the tip of the first concave tapered surface 240B, and a flat surface 250B that is perpendicular to the rotation axis is formed at the tip of the spherical surface 250A of the driving shaft 250. All other structural elements and operations are the same as in the fifth embodiment.

The following is an explanation of an image forming apparatus and the operation of the image forming units with such a configuration.

The flat surface 240E perpendicular to the rotation axis is provided at the tip of the concave tapered surface 240B, and is in close opposition to the driving shaft 250. Therefore, even when the first concave tapered surface 240B of the positioning contact portion is deformed and the driving shaft 250 attempts to enter the first concave tapered surface 240B beyond a certain position, the tip of the driving shaft 250 abuts the flat surface 240E. Consequently, it can be prevented that the driving shaft 250 enters much beyond a certain position into the tapered portion. As a result, it is possible to set a small moving stroke in the axial direction for the driving shaft 250.

Moreover, during the switching and moving of the image forming units 1, the driving shaft 250 has to be completely detached from the first concave tapered surface 240B. On the other hand, during the image formation operation, it is necessary to press the driving shaft 250 against the first concave tapered surface 240B to position the photosensitive member 202. Therefore, it is necessary to move the driving shaft 250 into the axial direction over a distance that is longer than the distance from the tip of the first flange 240 to the contact portion between the driving shaft 250 and the first concave tapered surface 240B. To ensure this moving distance, a waiting space for the driving shaft 250 has to be provided extending in the width direction inside the apparatus, and as a result, leads to the problem that the width of the apparatus main body increases and the apparatus turns out to be bigger.

In this embodiment, a flat surface 250B is provided at the tip of the driving shaft 250 so that the distance that the driving shaft 250 moves in the axial direction is shortened, and the detaching and pressing of the driving shaft 250 from and against the first concave tapered surface 240B of the first flange 240 can be performed reliably. Moreover, since the first concave tapered surface 240B of the first flange 240 contacts the spherical surface 250A over the entire periphery of a ring, the photosensitive member 202 can be held securely even when the spherical surface 250A of the driving shaft 250 is short.

In this manner, with this embodiment, the electrode member 281 can be retained by the through hole 280 up to a position closer to the output shaft 250 by providing the tip of the first concave tapered surface 240B with a flat surface 240E perpendicular to the rotation axis. Moreover, providing the tip of the driving shaft 250 with a flat surface 250B stabilizes the contact to the electrode member 281, which the tip of the driving shaft 250 contacts elastically. Therefore, electrical conduction between the driving shaft 250 and the cylinder of the photosensitive member 202 can be established more securely. Moreover, providing the tip of the spherical surface 250A of the driving shaft 250 with a flat surface 250B makes it possible to set a shorter moving stroke of the driving shaft 250 while retaining the photosensitive member 202 securely. As a result, the apparatus main body can be made smaller.

Seventh Embodiment

Figure 29:
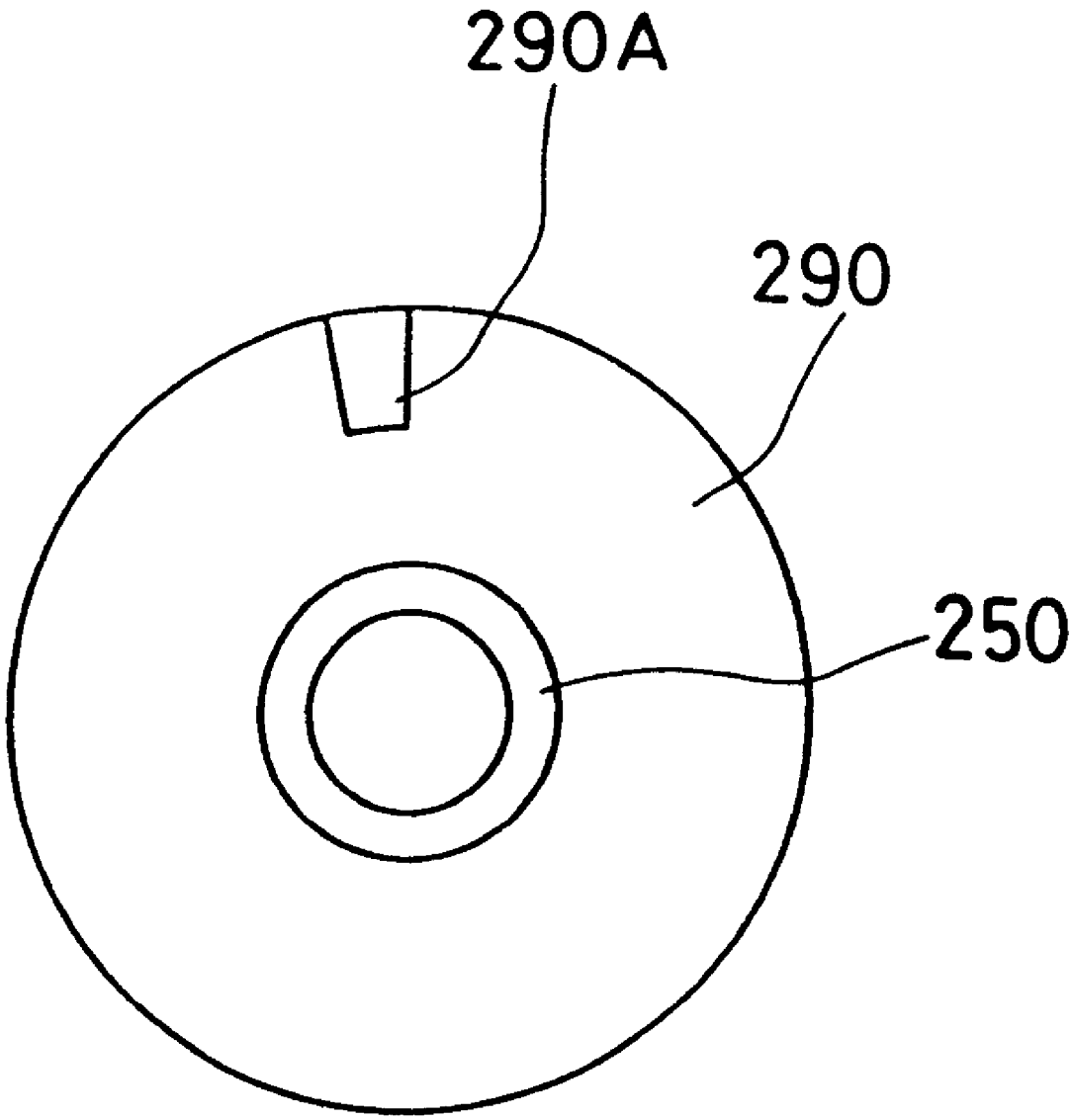
FIG. 29 is a lateral view of the driving shaft in a seventh embodiment of the present invention, seen from the tip direction.
Figure 30:
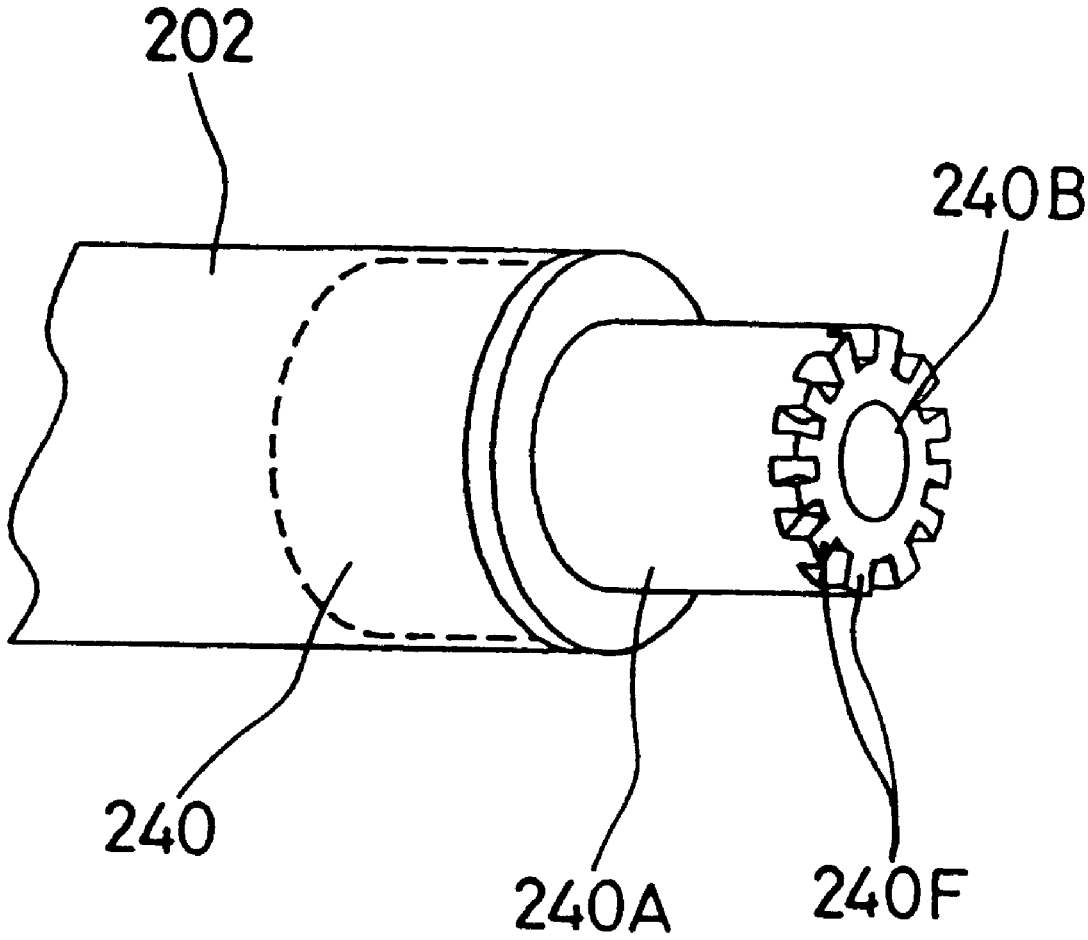
FIG. 30 is a perspective view showing an end portion of the first flange of the photosensitive member in the seventh embodiment of the present invention.
Figure 31:
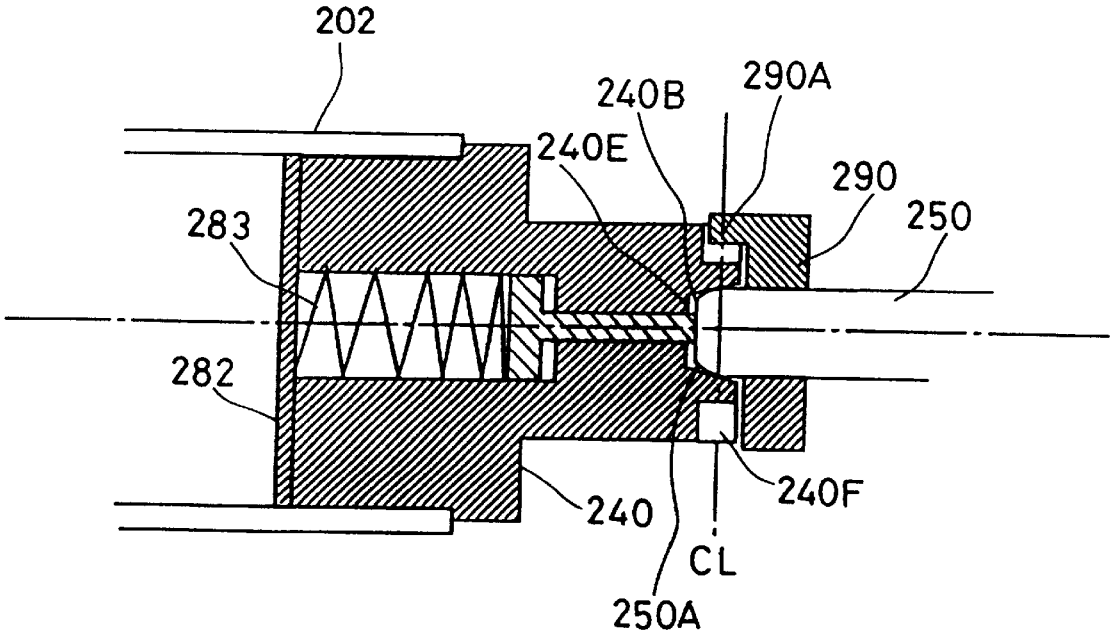
FIG. 31 is a cross sectional view of the seventh embodiment of the present invention, taken at the rotation center of the coupling portion of the first flange on the driving side and the driving shaft.

FIG. 29 is a lateral view of the driving shaft in a seventh embodiment of the present invention, seen from the tip direction. FIG. 30 is a perspective view showing an end portion of the first flange of the photosensitive member in the seventh embodiment of the present invention. FIG. 31 is a cross sectional view of the seventh embodiment of the present invention, taken at the rotation center of the coupling portion of the first flange on the driving side and the driving shaft.

Figure 32:
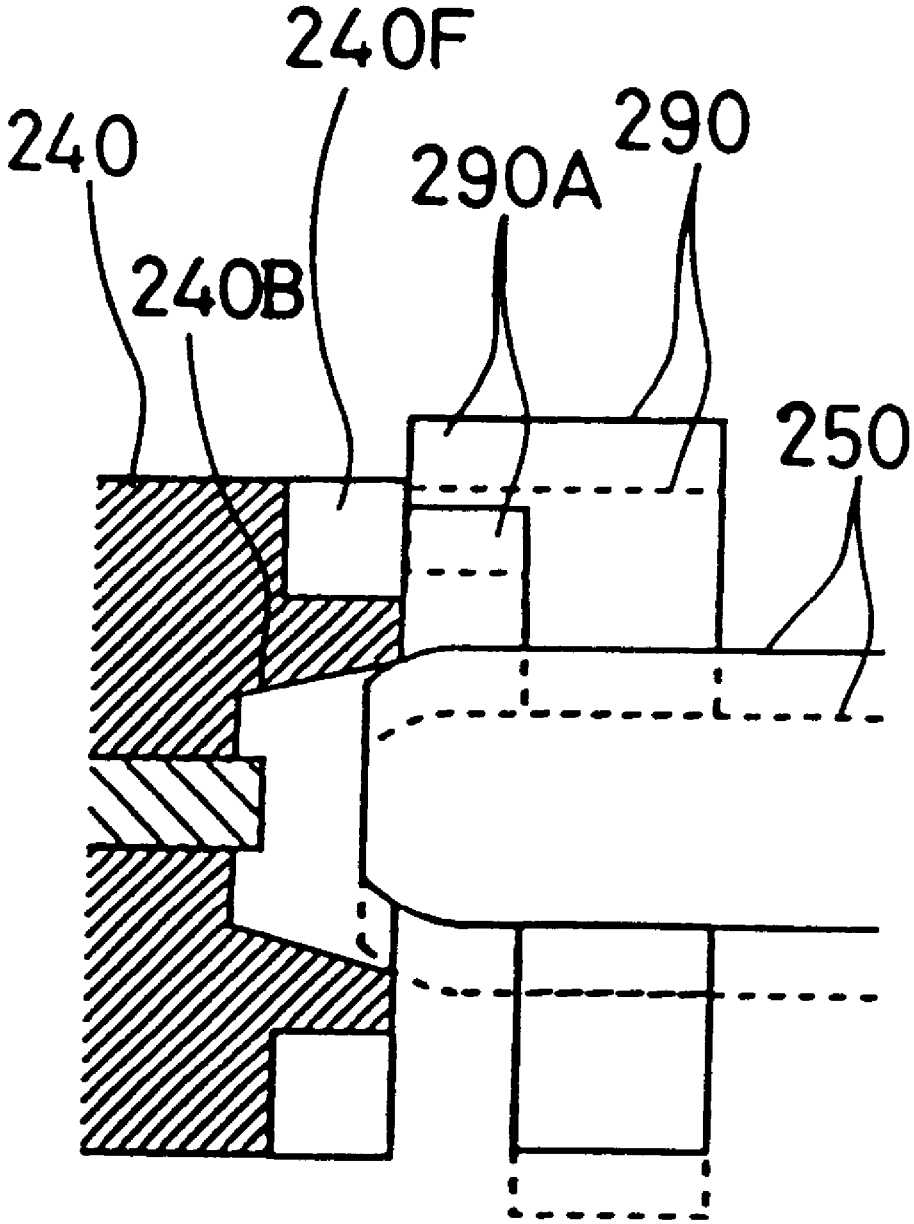
FIG. 32 is a cross sectional view of the seventh embodiment of the present invention, taken at the rotation center of the coupling portion during the coupling operation.

Different from the above-noted sixth embodiment, a disk-shaped transmission member 290 is attached to the driving shaft 250, and the disk-shaped transmission member 290 is provided with a single transmission tongue 290A, which is a rectangular convex portion. This transmission tongue 290A is provided at the same axial position (on the line CL) as the center of the spherical surface 250A of the tip of the driving shaft 250. Moreover, the first flange 240 is provided with follower tongues 240F by forming concave portions in the end portion of the first flange 240. Here, the tips of the follower tongues 240F of the first flange 240 are arranged in the same plane as the end portion of the first concave tapered portion. This makes it possible to arrange the contact portion of the transmission tongue 290A and the follower tongues 240F at the same axial position (on the line CL) as the center of the spherical surface 250A. In addition, even if the tip of the driving shaft 250 abuts a peripheral portion of the first concave tapered surface 240B as shown by the solid line in FIG. 32, the transmission tongue 290A of the transmission member 290 does not protrude beyond an outermost peripheral portion of the follower tongues 240F. Moreover, even if the tip of the driving shaft 250 abuts a peripheral portion on the opposite side of the first concave tapered surface 240B as indicated by the dashed line in FIG. 32, the transmission tongue 290A of the transmission member 290 does not protrude to the inside beyond an innermost peripheral portion of the follower tongues 240F. All other structural elements and operations are the same as in the sixth embodiment.

In conventional configurations, when the photosensitive member 202 and the driving shaft 250 are misaligned and not concentric, the error in the angular speed transmitted by the driving shaft 250 to the photosensitive member 202 increases, and there is the problem that the positions for superimposing the colors on the intermediate transfer belt 216 are misaligned.

Figure 33:
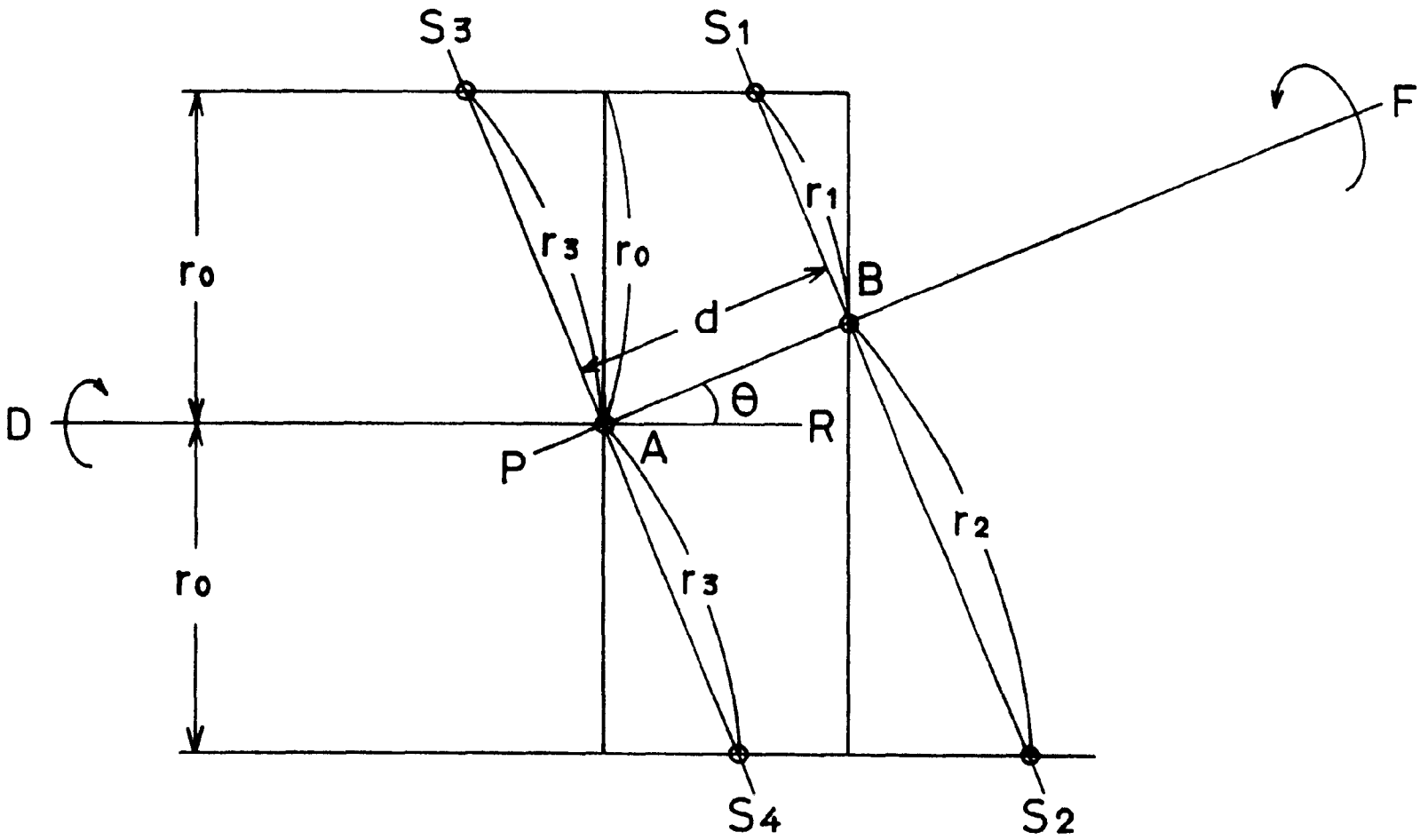
FIG. 33 is a diagram illustrating the effect of the seventh embodiment of the present invention.

Referring to FIG. 33, the following is an explanation of the reason why the angular speed changes. In FIG. 33, the center axis PF of the photosensitive member 202 (first concave tapered surface 240B) and the center axis DR of the driving shaft 250 intersect at point A at an intersection angle θ. The transmission tongue is at a position at a radius $r_0$ from the center axis of the driving shaft 250, and the follower tongues on the side of the photosensitive member 202 are at a position that is perpendicular to the center axis PF from point B on the center axis PF of the photosensitive member 202. The intersection A and the contact point where the transmission tongue contacts the follower tongues (passing through the positions $S_1$ and $S_2$) are shifted by a distance d (segment AB) in the direction of the center axis PF of the photosensitive member 202.

Because of the intersection angle θ, the transmission tongue and the follower tongue mesh obliquely. Consequently, during the meshing rotation, even when the radius of the contact points S with respect to the center axis DR of the driving shaft 250 is a constant $r_0$, the radius with respect to the center axis PF of the photosensitive member 202 varies. In the plane including the center axis DR of the driving shaft 250 and the center axis PF of the photosensitive member 202, this radius takes on a minimum value $r_1$ at the position of $S_1$ and a maximum value $r_2$ at the position of $S_2$. The difference $\Delta R_1$ between these radii can be expressed by Eq. 1:

$$\Delta R_1 = r_2 - r_1 = 2d \cdot \tan\theta$$

Since the radii for the contact points S of the transmission tongue and the follower tongues vary like this with respect to the center axis PF of the photosensitive member 202, the angular speed of the photosensitive member 202 varies even though the angular speed of the driving shaft 250 is constant.

As becomes clear from Eq. 1, the amount of the speed variations depends on the distance d. Since the members constituting the tapered surface of the photosensitive member 202 differ for each color, this distance d also differs for each color. This can cause different speed variations for each color.

Moreover, in conventional configurations, since the coupling portion of the photosensitive member 202 and the driving shaft 250 is unstable, the distance d varies during the rotation. Therefore, even more anomalous speed variations are superimposed.

On the other hand, if the contact points S of the transmission tongue and the follower tongues are at positions perpendicular to the driving shaft 250 on a line through the intersection A between the center axis PF of the photosensitive member 202 and the center axis DR of the driving shaft 250, the radius with respect to the center axis DR of the driving shaft 250 is constant, but the radius for the contact points S of the transmission tongue and the follower tongues with respect to the center axis PF of the photosensitive member 202 changes. In the plane including the center axis DR of the driving shaft 250 and the center axis PF of the photosensitive member 202, this radius takes on a maximum value $r_3$ at the positions $S_3$ and $S_4$, and a minimum value $r_0$ at positions perpendicular to this plane. The difference $\Delta R_2$ between these radii can be expressed by Eq. 2:

$$\Delta R_2 = r_3 - r_0 = (1/\cos\theta - 1)\cdot r_0$$

If $r_0$=10 mm, d=1 mm, θ=1°, then $\Delta R_1/\Delta R_2$=229.

From this, it can be seen that if the follower tongues are at the position of point A, the speed variations are smaller than 1/200 than if they are at the position of point B. Consequently, arranging the intersection between the rotation axis of the photosensitive member 202 and the rotation axis of the driving shaft 250 and the contact point where the transmission tongue contacts the follower tongues in the same plane perpendicular to the rotation axis of the driving shaft 250 suppresses positional misalignments due to speed variations and makes it possible to obtain a high-quality image.

Moreover, in conventional configurations, transmission tongues and follower tongues are arranged at substantially equal-spaced intervals in the circumferential direction. However, if the center axis DR of the driving shaft 250 is tilted against the center axis PF of the photosensitive member 202, it is not possible to abut the transmission tongues uniformly against all follower tongues. The transmission tongues and the follower tongues come in contact only at the position $S_1$ in FIG. 34, where the photosensitive member 2 rotates the fastest (where the radius is the smallest). Consequently, since the tongues that contact at the time of rotation driving change, irregularities and form errors in the pitch of the transmission tongues and the follower tongues cause variations in the angular speed of the photosensitive member 202. Then, when such angular speed variations occur, undesired positional misalignments are caused by different speed variations for each color.

On the other hand, in this embodiment, there is only one transmission tongue 290A, so that the angular speed is always transmitted by the same tongue. Consequently, the angular speed transmitted from the driving shaft 250 to the photosensitive member 202 does not vary.

Moreover, when the driving shaft 250 is moved in the direction of the photosensitive member 202, and the tip of the transmission tongue 290A of the transmission member 290 has reached the tip of the follower tongues 240F, the tip of the driving shaft 250 has entered the first concave tapered surface 240B. And, even if the tip of the driving shaft 250 abuts a peripheral portion of the first concave tapered surface 240B, the transmission tongue 290A of the transmission member 290 does not protrude beyond an outermost peripheral portion of the follower tongues 240F. Moreover, even if the tip of the driving shaft 250 abuts a peripheral portion on the opposite side of the first concave tapered surface 240B, the transmission tongue 290A of the transmission member 290 does not protrude to the inside beyond an innermost peripheral portion of the follower tongues 240F. Therefore, when the photosensitive member is moved in the direction of the photosensitive member 202 for positioning, the inner peripheral surface of the transmission tongue 290A on the side of the driving shaft 250 does not abut the outer peripheral surface of the follower tongue 240F on the side of the photosensitive member 202. As a result, the photosensitive member 202 can be moved securely in a radial direction to position the photosensitive member 202 in its correct position.

Eighth Embodiment

Figure 34:
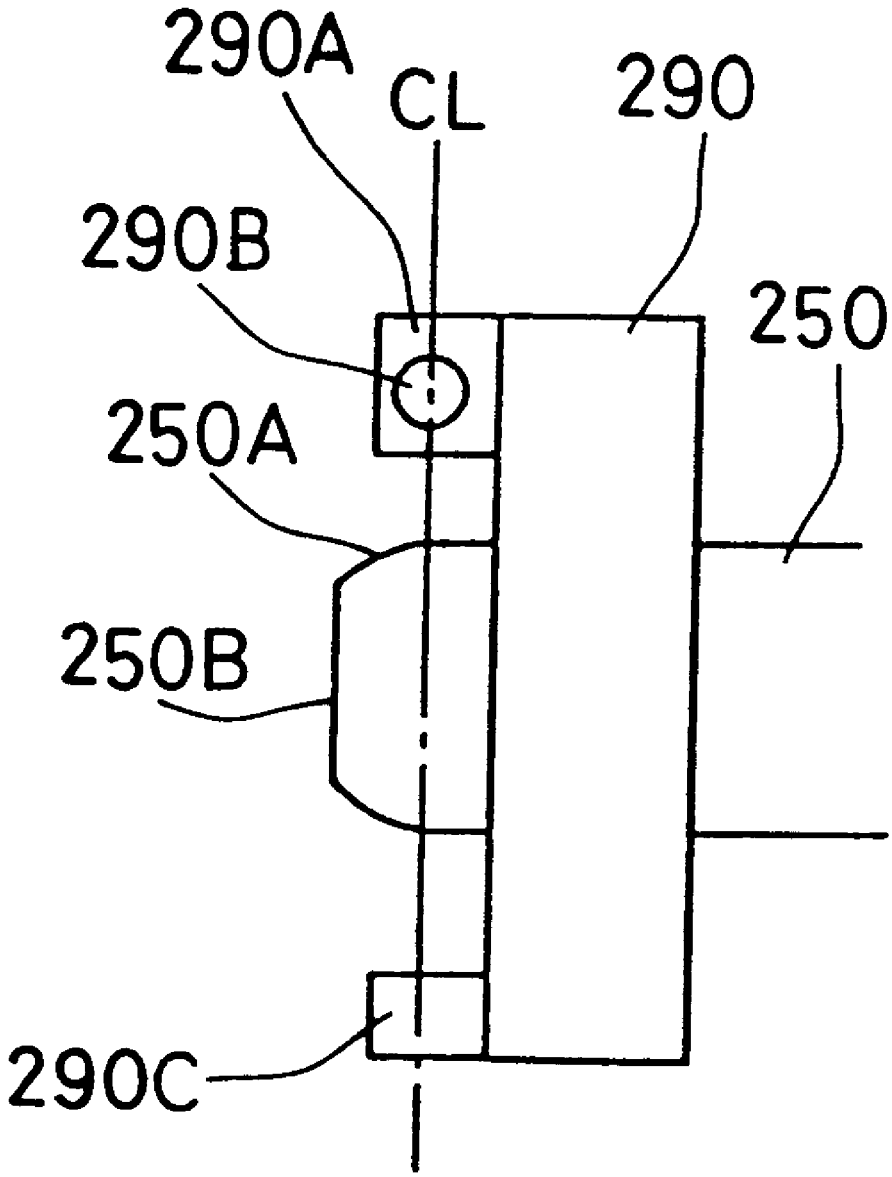
FIG. 34 is a front view showing the driving shaft in an eighth embodiment of the present invention.
Figure 35:
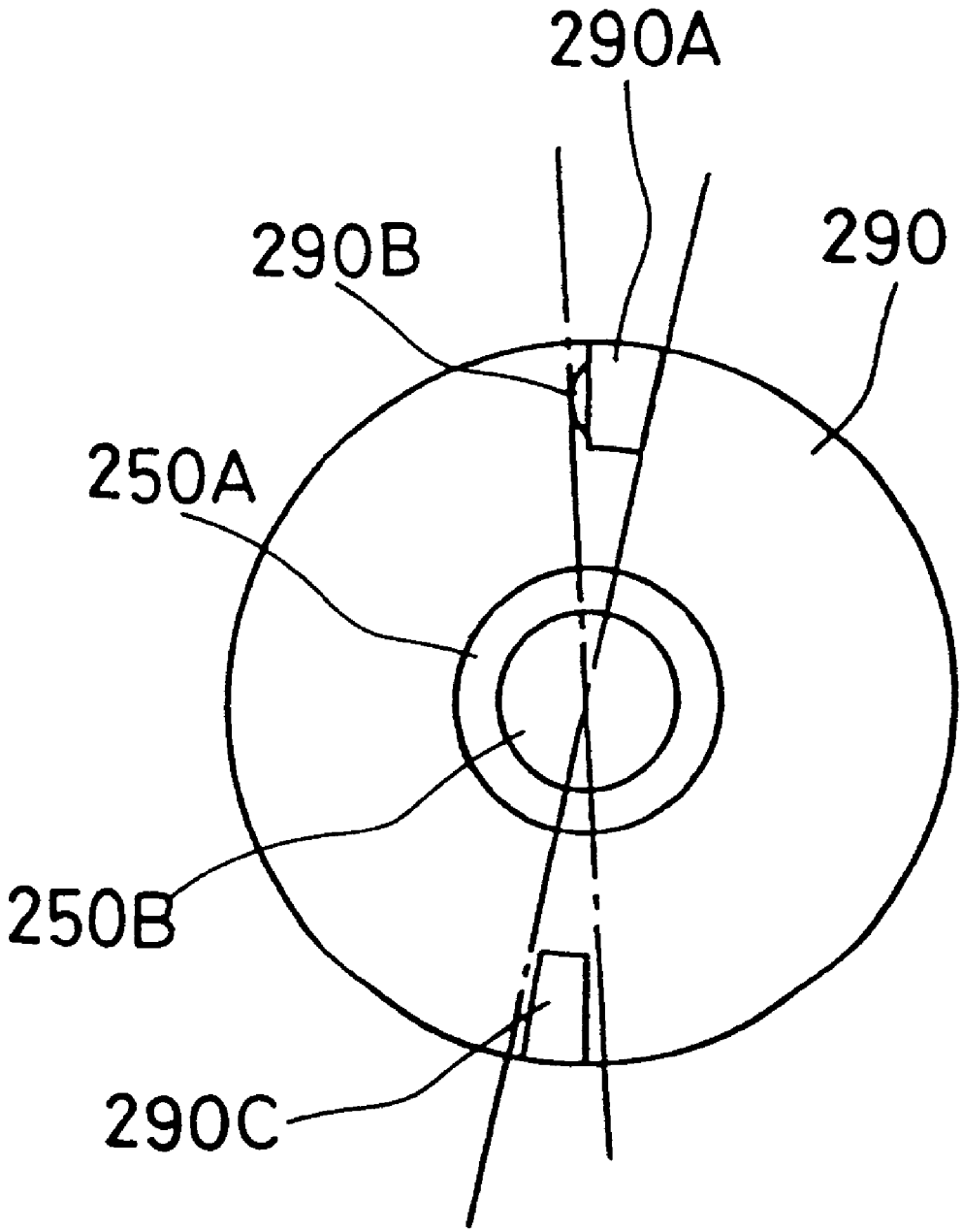
FIG. 35 is a lateral view of the driving shaft in the eighth embodiment of the present invention, seen from its axial direction.

FIG. 34 is a front view showing the driving shaft in an eighth embodiment of the present invention. FIG. 35 is a lateral view seen from its axial direction.

Different from the above-noted seventh embodiment, the surface of the transmission tongue 290A abutting the follower tongues 240F is provided with a spherical protrusion 290B whose center is at the same axial position as the center of the spherical surface 250A of the tip of the driving shaft 250 (on the line CL). Moreover, a rectangular protrusion portion 290C of the same height as the transmission tongue 290A but narrower is provided at a position symmetrical to the transmission tongue 290A with respect to the rotation center. All other structural elements and operations are the same as in the seventh embodiment.

The following is an explanation of an image forming apparatus and the operation of the image forming units with such a configuration.

In the seventh embodiment, the contact face of the transmission tongue 290A and the follower tongues 240F is flat, so that it is not possible to precisely define the contact point between the tongues. This means, since there is a small tilt between the transmission tongue 290A and the follower tongues 240F, rotating the driving shaft 250 and the photosensitive member 202 changes the contact point where the transmission tongue 290A contacts the follower tongues 240F. Consequently, form errors of the contact surface cause variations in the rotation speed of the photosensitive member 202. Then, when such rotation speed variations occur, undesired positional misalignments are caused by different speed variations for each color.

On the other hand, in this embodiment, the contact surface of the transmission tongue 290A is provided with a spherical protrusion 290B, so that the contact point is normally at the tip of this protrusion 290B, even when the rotation is performed while the transmission tongue 290A and the follower tongues 240F are slightly tilted against each other. Therefore, it is possible to prevent variations of the rotation speed of the photosensitive member 202, which are caused by the change of the contact portion between the transmission tongue 290A and the follower tongues 240F. As a result, positional misalignments due to speed variations can be suppressed and it is possible to obtain a high-quality image.

Moreover, in the seventh embodiment, there is one transmission tongue 290A, so that when the transmission tongue 290A hits the tip of the follower tongues 240F, the counter force causes a bending moment in the driving shaft 250. This can distort the coupling and moving portion of the bearing 256, so that the driving shaft 250 cannot be moved in the axial direction anymore. Consequently, at the start of the rotation, the transmission tongue 290A and the follower tongues 240F cannot be meshed correctly, and as a result, there is the problem that the angular speed cannot be transmitted to the photosensitive member 202.

On the other hand, in this embodiment, a protrusion portion 290C of the same height as the transmission tongue 290A is provided at a position that is symmetrical to the transmission tongue 290A with respect to the rotation center, so that when the transmission tongue 290A hits the follower tongues 240F, the protrusion portion abuts a position symmetrical to the position abutted by the transmission tongue 290A. Therefore, there is no counter force acting on the driving shaft 250, so that the driving shaft 250 moves smoothly in the axial direction. As a result, the transmission tongue 290A and the follower tongues 240F can be meshed securely when the rotation starts. Since the protrusion portion 290C is rectangular and narrower than the transmission tongue 290A, it does not contact the follower tongues 240F during the rotation driving.

In this embodiment, the transmission tongue 290A is provided with a spherical protrusion 290B, but there is no limitation to this configuration, and the same effect can be attained when the follower tongues 240F are provided with spherical protrusions.

Moreover, in this embodiment, there is only one protrusion portion 290C provided at a position that is symmetrical to the transmission tongue 290A, but there is no limitation to this configuration. An even more stabilized effect can be attained if a plurality of protrusions are provided at the positions of the vertices of a regular polygon including the position of the transmission tongue 290A and having the rotation center at its center.

Ninth Embodiment

Figure 36:
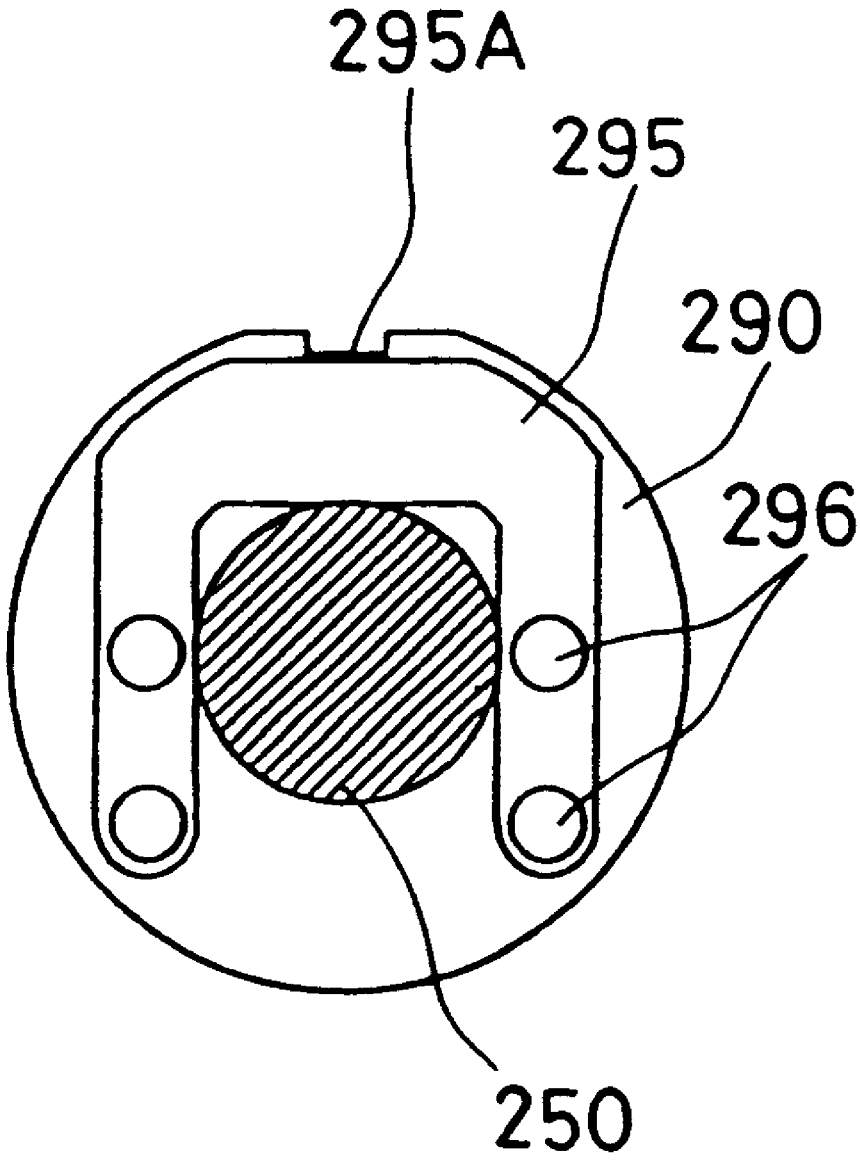
FIG. 36 is a lateral view of the driving shaft in an ninth embodiment of the present invention, seen from its axial direction.
Figure 37:
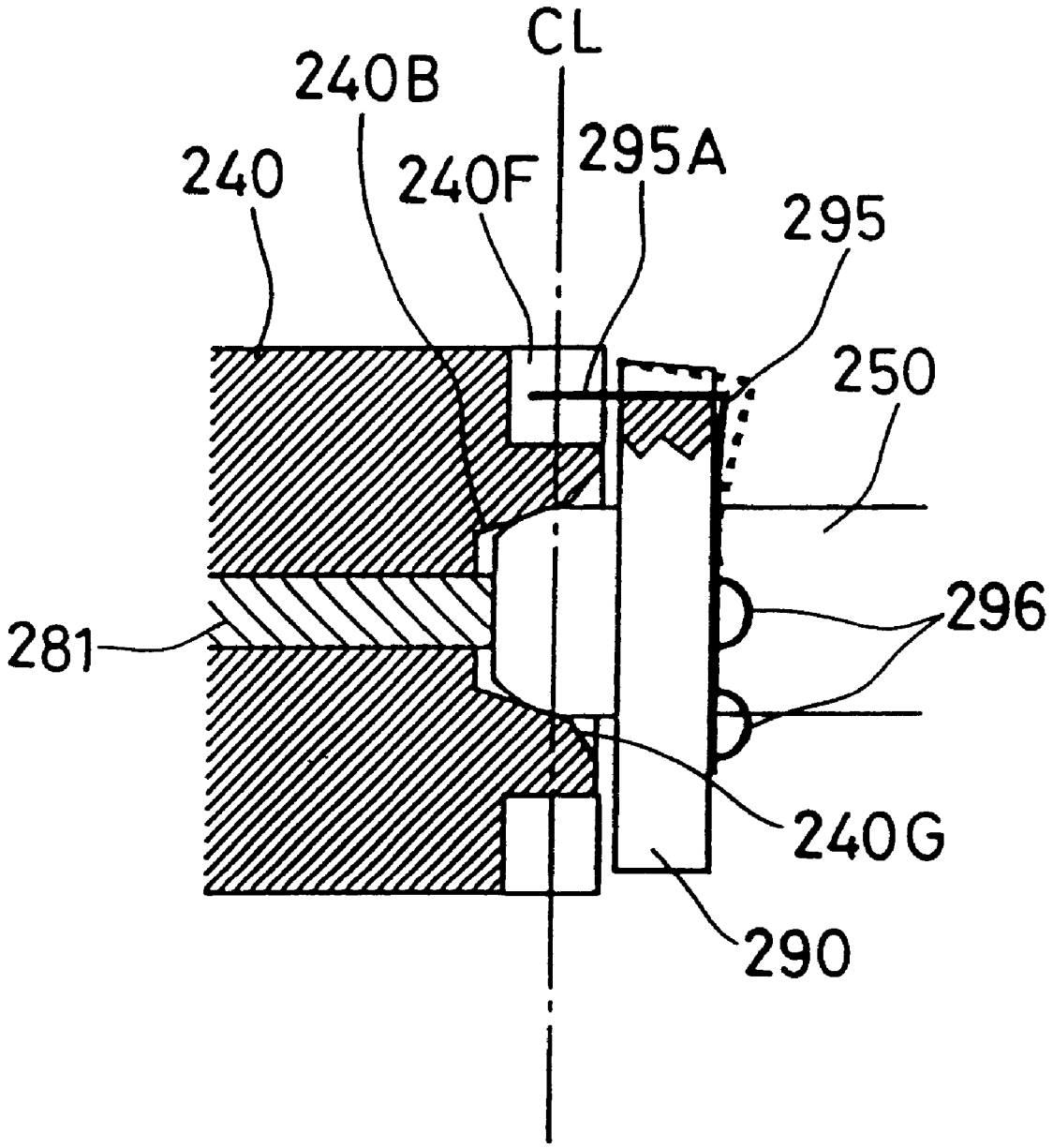
FIG. 37 is a cross sectional view of the ninth embodiment of the present invention, taken at the rotation center of the coupling position of the first flange and the driving shaft.

FIG. 36 is a cross sectional view of the driving shaft in a ninth embodiment of the present invention, seen from the axial direction. FIG. 37 is a cross sectional view of the ninth embodiment of the present invention, taken at the rotation center of the coupling portion of the first flange and the driving shaft.

Different from the eighth embodiment, a driving plate spring 295 having a transmission tongue 295A for meshing with the follower tongues 240F is attached to the transmission member 290 with a fixing pin 296. Moreover, the end of the first concave tapered surface 240B of the first flange 240 is provided with a tapered surface 240G with a large tip angle. All other structural elements and operations are the same as in the eighth embodiment.

The following is an explanation of an image forming apparatus and the operation of the image forming units with such a configuration.

The smaller the tip angle of the first concave tapered surface 240B, the more precisely can the position of the photosensitive member 202 be defined. However, if the taper angle is small, the driving shaft 250 cannot be inserted into the first concave tapered surface 240B, unless the driving shaft 250 and the photosensitive member 202 are aligned almost completely concentrically at the image forming position P. If the driving shaft 250 cannot be inserted into the first concave tapered surface 240B, the photosensitive member 202 cannot be positioned in the image forming position P.

Conversely, the larger the circle at the end of the first concave tapered surface 240B is, the easier it is to insert the driving shaft 250 into the first concave tapered surface 240B, even when the carriage 211 has positioned the photosensitive member 202 with misalignment. However, in this case, the distance from the end of the first concave tapered surface 240B to the coupling contact portion with the driving shaft 250 becomes undesirably long, and because it is necessary to move the driving shaft 250 over this distance, the moving stroke for the driving shaft 250 becomes long. As a result, a large waiting space has to be provided extending in the width direction inside the apparatus, which leads to the problem that the width of the apparatus main body increases, and the apparatus turns out to be bigger.

In this embodiment, the end of the first concave tapered surface 240 of the first flange 240 is provided with a tapered surface 240G with a large tip angle, so that not only the ring of the tapered end can be made larger, but also the distance from the end of the first concave tapered surface 240B to the coupling contact portion with the driving shaft 250 can be shortened. As a result, the moving stroke of the driving shaft 250 in the axial direction can be set shorter, and the driving shaft 250 can be taken out completely from the first concave tapered surface 240B, so that the apparatus main body can be made smaller.

Moreover, the transmission tongue 295A is movable in the axial direction with respect to the driving shaft 250 and is elastically biased by the driving plate spring 295, so that when the driving shaft 250 is moved in the coupling direction, the transmission tongue 295 can be accommodated even when the transmission tongue 295A abuts the follower tongues 240F. Thus, when the driving shaft 250 abuts the first concave tapered surface 240B, it does not hinder the moving of the photosensitive member 202 in the radial direction. Since in this configuration only the transmission tongue 295 moves in the axial direction with respect to the driving shaft 250, the transmission member 290 can be made shorter in the axial direction of the driving shaft 250. As a result, it is possible to make the apparatus main body smaller, since the length from the bearing of the driving shaft 250 to the tip thereof can be shortened.

Tenth Embodiment

Figure 38:
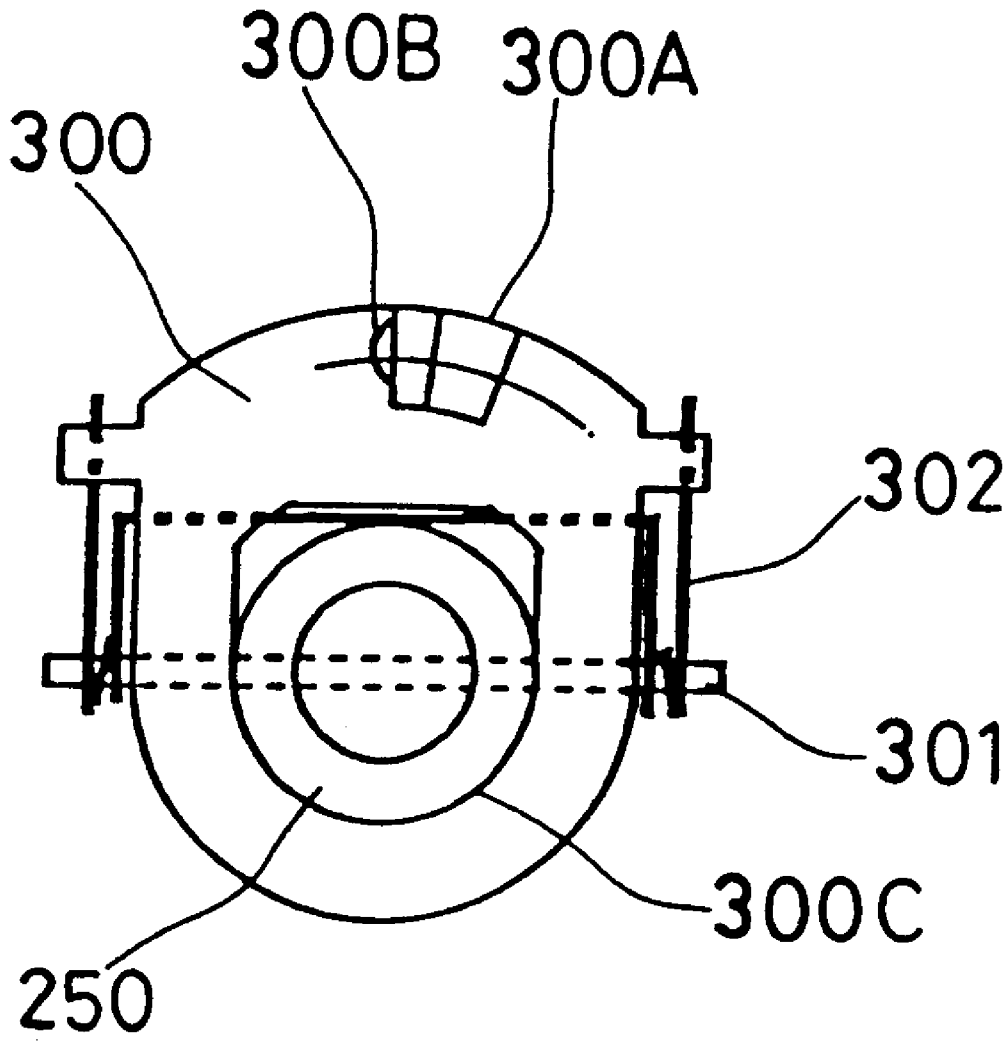
FIG. 38 is a lateral view of a driving shaft having a transmission member in a tenth embodiment in accordance with the present invention, seen from the axial direction.
Figure 39:
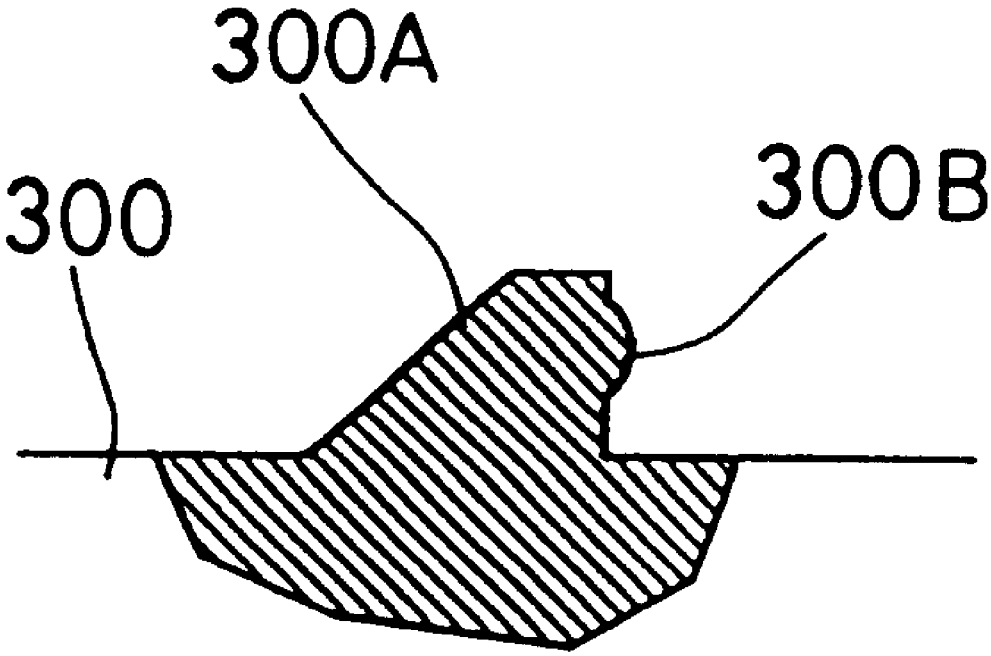
FIG. 39 is a cross sectional view of the transmission tongue that the transmission member in the tenth embodiment of the present invention is provided with, seen from a radial direction.
Figure 40:
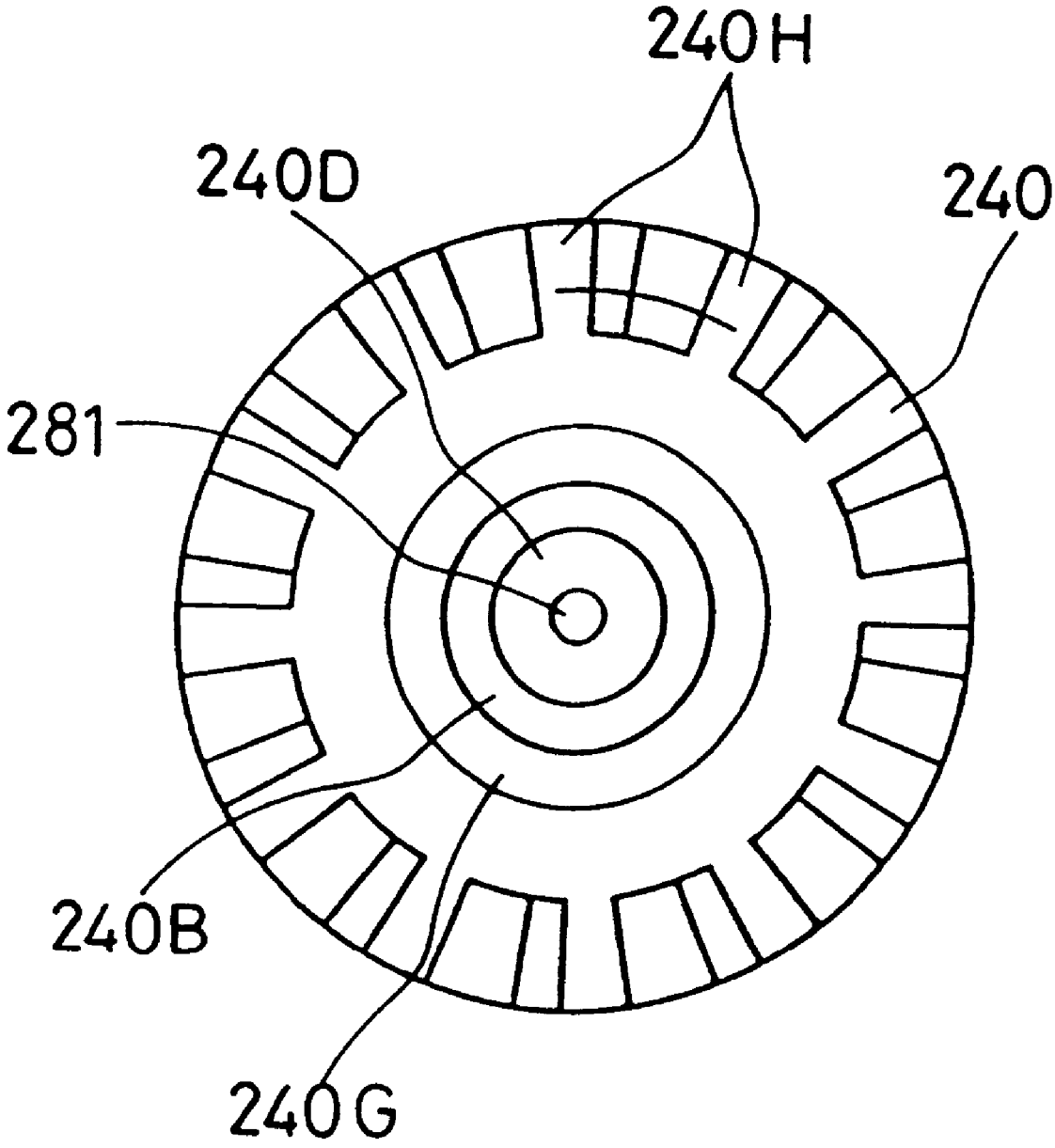
FIG. 40 is a lateral view showing the configuration of the end surface of the first flange in the tenth embodiment of the present invention.
Figure 41:
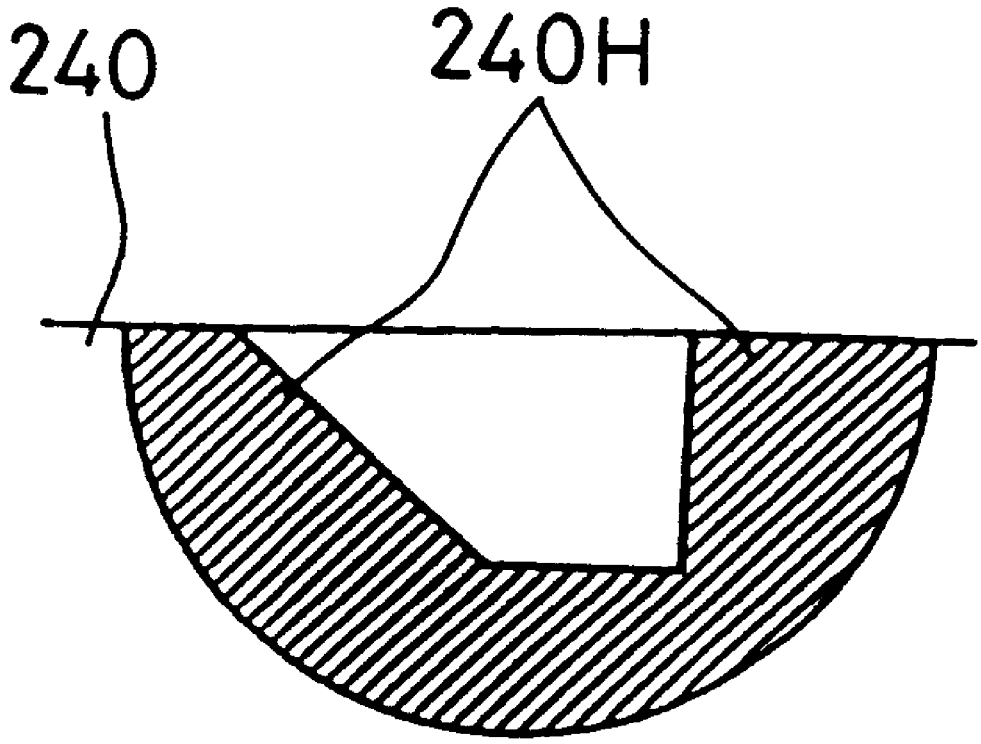
FIG. 41 is a cross sectional view of the follower tongue that a peripheral portion of the end surface of the first flange in this tenth embodiment of the present invention is provided with, seen from the radial direction.
Figure 42:
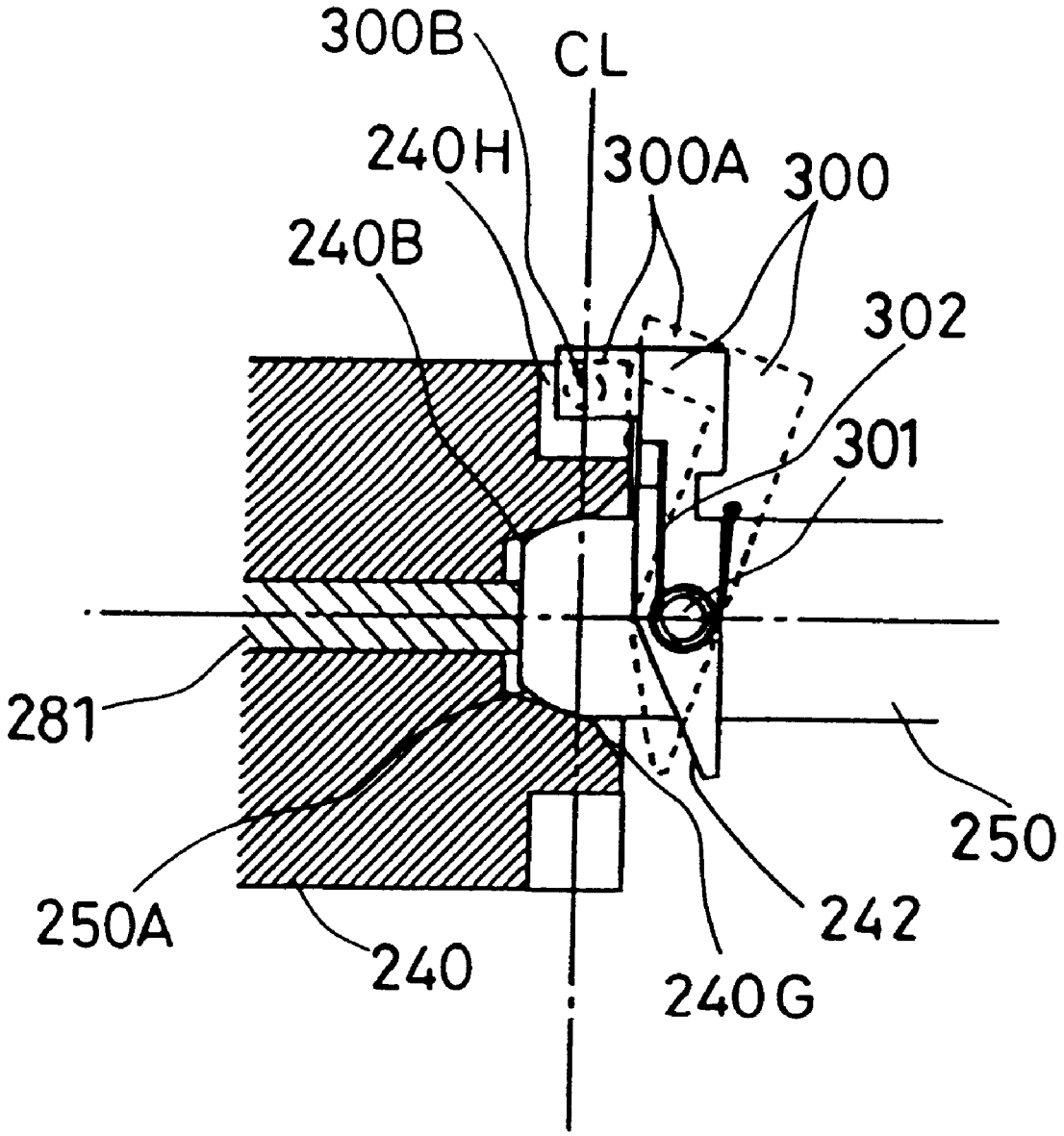
FIG. 42 is cross sectional view of the coupling position in the tenth embodiment of the present invention, taken at the rotation center of the first flange.
Figure 43:
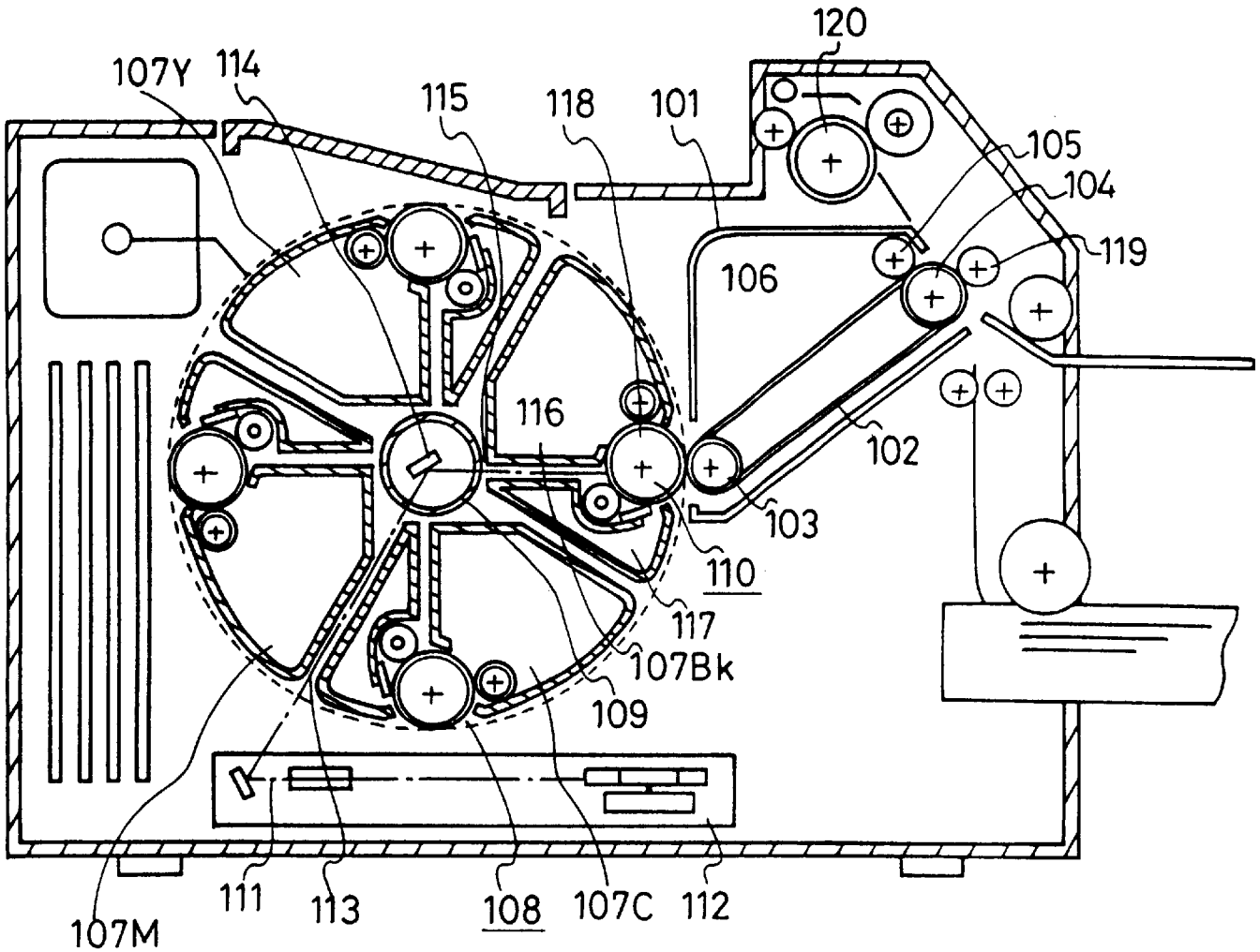
FIG. 43 (PRIOR ART)
FIG. 43 is a cross sectional view showing the configuration of a conventional image forming apparatus.
Figure 44:
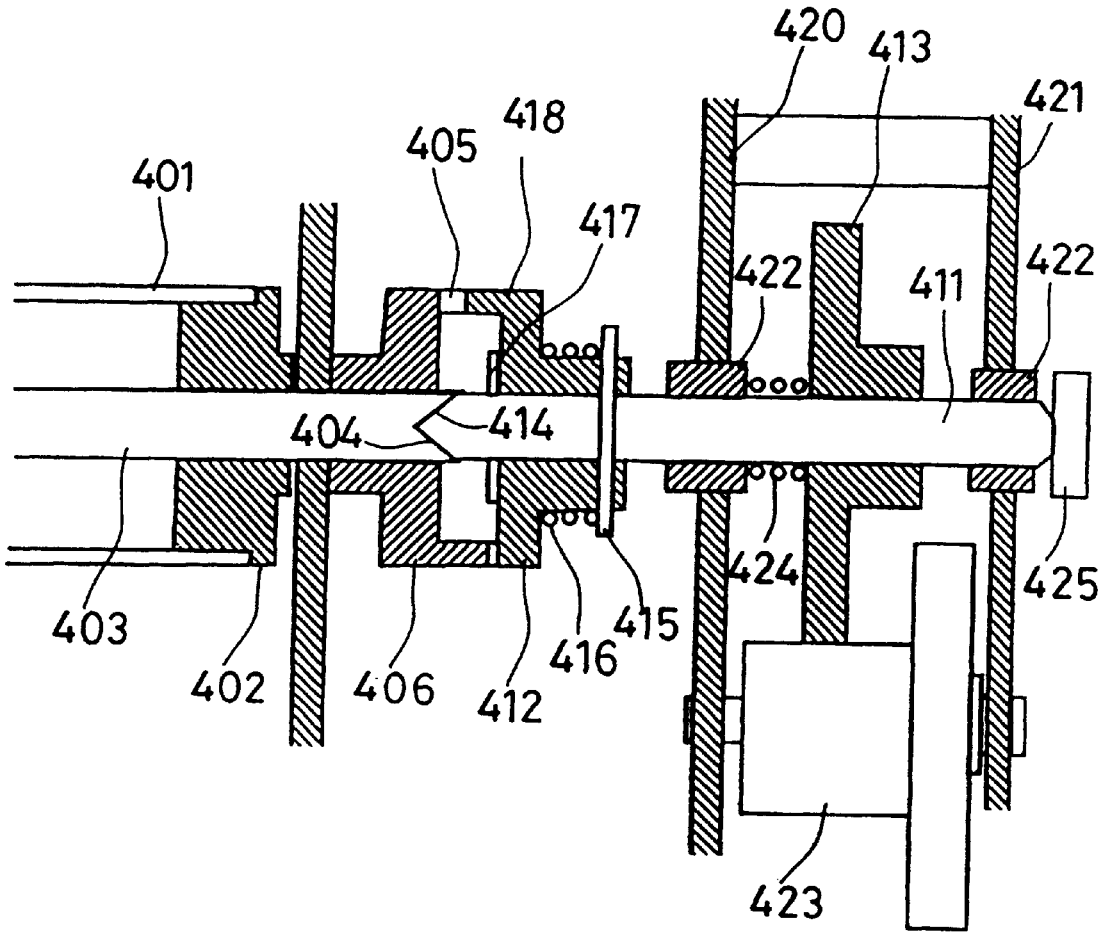
FIG. 44 (PRIOR ART)
FIG. 44 is a cross sectional view showing the configuration of a positioning and driving mechanism in a conventional image forming apparatus.
Figure 45:
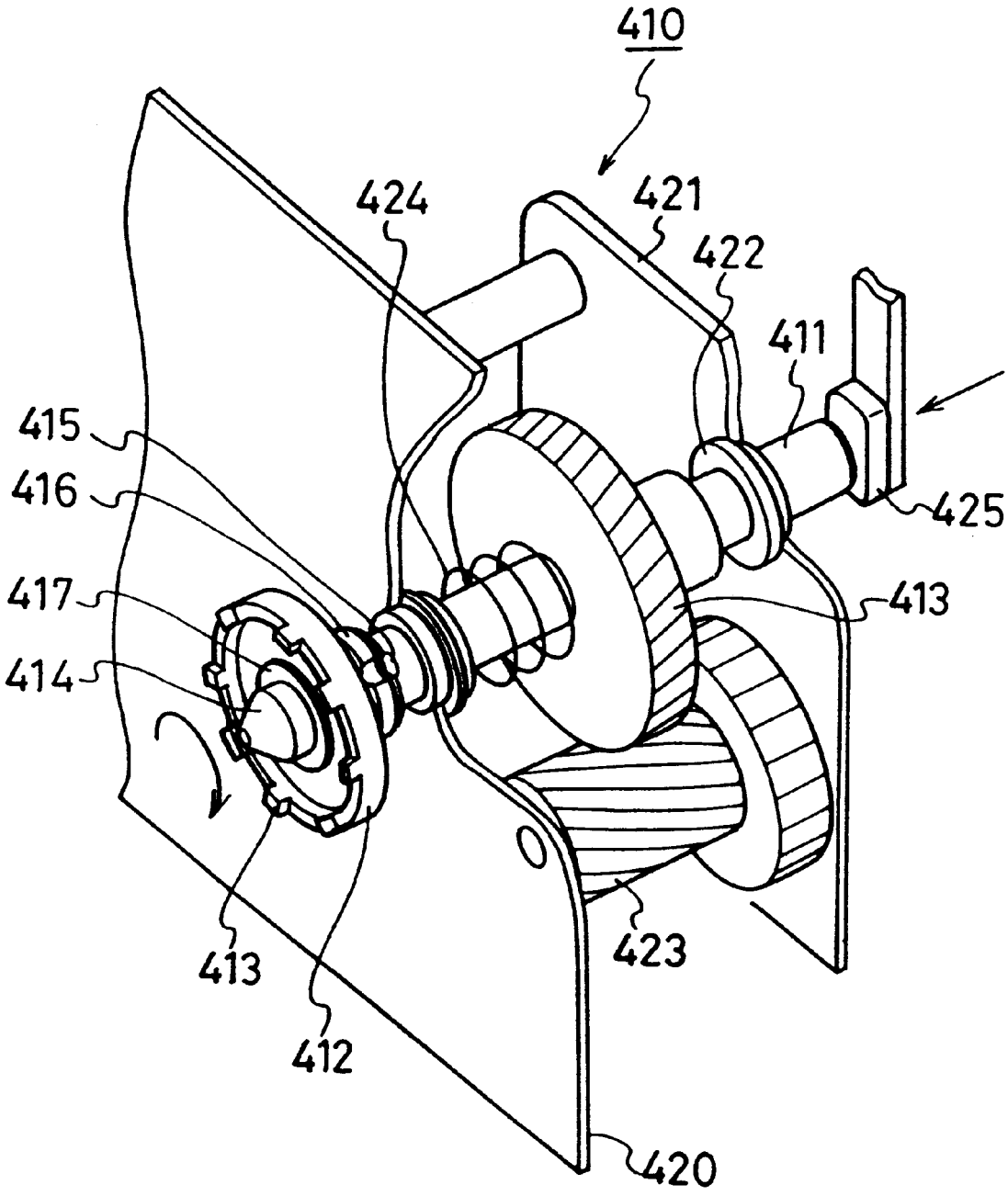
FIG. 45 (PRIOR ART)
FIG. 45 is a cross sectional view of a conventional image forming apparatus, taken at the rotation axis of the coupling portion.
Figure 46:
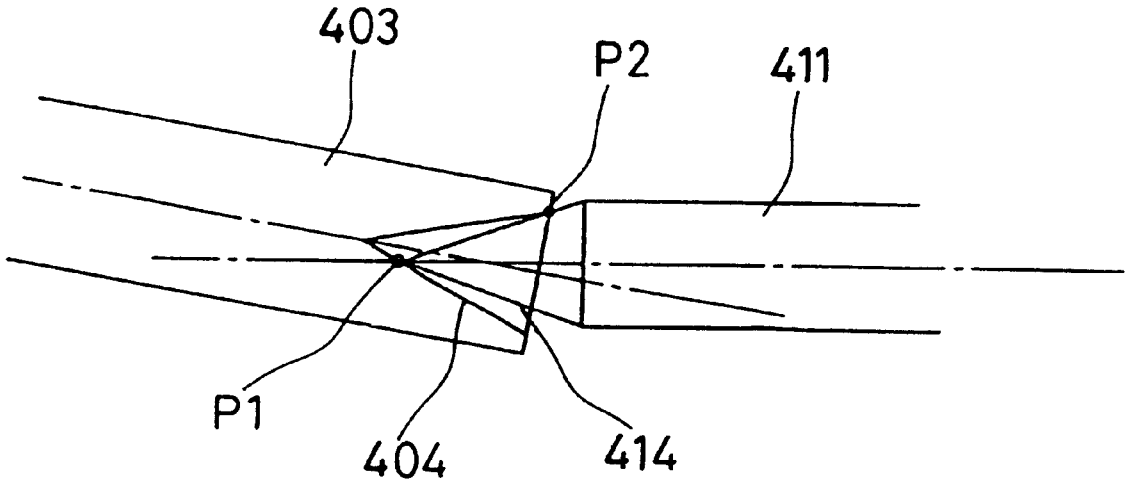
FIG. 46 (PRIOR ART)
FIG. 46 is a diagram illustrating the problems with the conventional image forming apparatus.

FIG. 38 is a lateral view of a tenth embodiment of a driving shaft having a transmission member in accordance with the present invention, seen from the axial direction. FIG. 39 is a cross sectional view of the transmission tongue that the transmission member in this tenth embodiment of the present invention is provided with. FIG. 40 is a lateral view showing the configuration of the end surface of the first flange in the tenth embodiment of the present invention. FIG. 41 is a cross sectional view of the follower tongue that a peripheral portion of the end surface of the first flange in this tenth embodiment of the present invention is provided with, seen from the radial direction. FIG. 42 is cross sectional view of the coupling position in the tenth embodiment of the present invention, taken at the rotation center of the first flange.

Different from the above-noted ninth embodiment, a transmission member 300 is supported rotatably around a rotation shaft 301, which is attached to the driving shaft 250 and whose rotation center is perpendicular to the driving shaft 250. The transmission member 300 is rotationally biased by a torsion spring 302, so that the transmission tongue 300A is rotatably forced into the tip direction of the driving shaft 250. An arc-shaped stopper portion 300C abuts the peripheral surface of the driving shaft 250, which defines the posture of the transmission member 300 in the rotational orientation.

A clearance is ensured for the rotation shaft 301, so that the strength and operation necessary for the transmission of the motive force can be applied. Moreover, the rotation shaft 301 is provided at a position directly near the end surface of the first flange opposing the transmission member 300 during the positioning and coupling. The side of the transmission member 300 that opposes the first flange 240 and which is opposite to the transmission tongue 300A with respect to the rotation shaft 301 is provided with an oblique surface 242, which gradually recedes from the first flange 240.

Moreover, as in the above ninth embodiment, the face of the transmission tongue 300A that abuts the follower tongues 240H is provided with a spherical protrusion 300B centered on the same position (on line CL) in the axial direction as the center of the spherical surface 250A of the tip of the driving shaft 250. Furthermore, an oblique surface is formed on the transmission tongue 300A, on the surface in peripheral direction that is on the opposite side from the protrusion 300B and that does not contact the follower tongue 240H.

Moreover, an oblique surface is formed on the follower tongue 240H of the first flange 240, in the peripheral direction that does not contact the transmission tongue 300A when being driven to rotate. All other structural elements and operations are the same as in the ninth embodiment.

Because in this embodiment the transmission member 300 is supported rotatably around the driving shaft 250, it does not become long in the rotation axial direction, even when the coupling/sliding portion between the rotation center and the transmission member 300 is set to be long. As a result, the length from the bearing of the driving shaft 250 to its tip can be set short and without clearance, so that the apparatus main body can be made smaller.

Moreover, in the above-noted fourth embodiment, if the driving shaft 250 is rotated while the tip of the transmission tongue 252 abuts the tips of the follower tongues 240C, only the side of the driving shaft 250 rotates at first. Then, when the convex and concave portions of the transmission tongue 252 and the follower tongues 240C come into a meshing position, the driving shaft 250 moves toward the photosensitive member 202. This causes the tongues to mesh, so that it becomes possible to transmit a motive force. During the meshing movement, the transmission tongue is moved impulsively, because the follower tongues 240C are rectangular. Therefore, there is the problem that the tip of the driving shaft 250 collides with first concave tapered surface 240B, which causes collision noise. Moreover, also in conventional configurations, there is the problem that when the coupling tongues 412 enter the photosensitive member side, the coupling tongues 412 move impulsively and collide with the stopper 417, which causes collision noise.

In this embodiment, the faces of the transmission tongue 300A and the follower tongues 240H that are not in contact when driven for rotation are oblique surfaces in the peripheral direction, and the transmission tongue 300A moves into the meshing position while sliding on the oblique surface when the rotation starts while the tips of the transmission tongue 300A and the follower tongues 240H abut each other. Consequently, during this controlled movement of the transmission tongue 300A the impact when the stopper portion 300C collides with the driving shaft 250 is small. As a result, the collision noise when the transmission member 300 is brought into its proper position can be suppressed.

Moreover, because the rotation radius of the stopper portion 300C is smaller than that of the transmission tongue 300A, the moving speed of the stopper portion 300C is reduced. Therefore, when the transmission member 300 is brought into its proper position, the impact when the stopper portion 300C collides with the driving shaft 250 is reduced. As a result, the collision noise can be suppressed even further.

Moreover, since the stopper portion 300C brings the transmission member 300 into its proper position, the tip of the transmission tongue 300A does not hit the bottom of the follower tongues 240H, and the center of the protrusion 300B is usually at the same position in the axial direction as the center of the spherical surface 250A at the tip of the driving shaft 250.

Moreover, the rotation shaft 301 is provided such that it is in a position directly near the end surface of the first flange 240 during the positioning and coupling, so that even when there is an intersection angle θ between the center axis of the driving shaft 250 and the center axis of the photosensitive member 202 the distance between the contact point where the transmission tongue 300A contacts the follower tongues 240H and the center axis of the driving shaft 250 can be maintained substantially constant.

Moreover, since the transmission member 300 is provided with an oblique surface 242, the other portions of the transmission member 300 do not contact the follower tongues 240H when the transmission tongue 300A abuts the tips of the follower tongues 240H as indicated by the dashed line in FIG. 42, and as a result, they do not impede the operation of the driving shaft 250.

In this embodiment, the transmission tongue 300A is provided with a spherical protrusion 300B, but there is no limitation to this configuration, and the same effect also can be attained when the follower tongues 240H are provided with spherical protrusions.

Moreover, the above explanations referred to examples of coupling between the driving shaft 250 and the first concave tapered surface 240B of the first flange 240, but the positioning of the photosensitive member 202 can be performed similarly by coupling between the positioning shaft 270 and the second concave tapered surface 245B of the second flange 245.

Moreover, in the above explanations, a convex spherical surface is formed at the tip of the driving shaft 250 on the main body side, and a concave tapered surface is formed on the side of the first flange 240, but the same effect also can be attained, if contrarily a concave tapered surface is formed at the tip of the driving shaft 250 and a convex spherical surface is formed at the center on the side of the first flange 240.

Moreover, the above explanations refer to examples in which the rotator of the image forming units 201 to be positioned is the photosensitive member 202, but there is no necessary limitation to the photosensitive member 202 as the rotator, and it also can be the developing roller 205, which is a structural member of the image forming units 201.

The invention may be embodied in other specific forms without departing from the spirit or essential characteristics thereof The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. An image forming apparatus, comprising:

a plurality of image forming units having a rotator, image forming unit conveying means for switching said plurality of image forming units by moving them successively between an image forming position and a waiting position;

a rotator support member for positioning the rotator that is in the image forming position into a proper position in an apparatus main body by coupling with at least one axial end portion of said rotator in an axial direction of said rotator and supporting said image forming units in a freely rotatable manner; and a rotation stop portion for positioning a rotational orientation of an axis of said rotator of said image forming units, wherein said rotation stop portion stops the rotation of said image forming units on a surface that is substantially parallel to a line connecting the axis of said rotator and a rotation stop position.

2. The image forming apparatus according to claim 1, wherein said rotator is a photosensitive member or a developing roller.

3. The image forming apparatus according to claim 1, further comprising a rotator driving means for driving said rotator, said rotation stop portion being provided on the same side of said rotator in the axial direction as said rotator driving means.

4. The image forming apparatus according to claim 3, wherein one supporting position of the rotator axis, a driving force transmission position for driving force transmission with said driving means, and a rotation stop position for stopping rotation with said rotation stop portion are substantially on the same plane, which is perpendicular to the axis of said rotator.

5. The image forming apparatus according to claim 1, wherein said rotator is a photosensitive member;

wherein said image forming units further comprise a developer, which is driven by a developer driving means; and wherein said rotation stop portion is provided on the same side of said rotator in the axial direction as said developer driving means.

6. The image forming apparatus according to claim 1, wherein said rotator is a photosensitive member; and further comprising a developer and a developer driving means for driving said developer;

said rotation stop portion stops the rotation of said image forming units on a surface that is substantially parallel to a direction of a driving force exerted by said developer driving means.

7. The image forming apparatus according to claim 6, wherein said rotation stop portion stops the rotation of said image forming units near an action line of the driving force exerted by said developer driving means.

8. The image forming apparatus according to claim 1, wherein said rotation stop portion is provided in said image forming unit conveying means.

9. The image forming apparatus according to claim 1, wherein said rotator is a photosensitive member;

further comprising a developer, a developer driving means for driving said developer, and a photosensitive member driving means for driving said photosensitive member;

wherein at the time of image formation, said developer driving means starts to drive said developer after said photosensitive member driving means has started to drive said photosensitive member.

10. The image forming apparatus according to claim 1, further comprising a thrust stop portion for positioning the axial direction of said rotator of said image forming units, which is provided near the axis of said rotator.

11. The image forming apparatus according to claim 10, wherein said rotation stop portion and said thrust stop portion are provided on the same side of the rotator in the axial direction.

12. The image forming apparatus according to claim 1, wherein said rotator is a photosensitive member;

further comprising a developer, a developer driving means for driving said developer, and a photosensitive member driving means for driving said photosensitive member;

wherein the direction of the torque on the axis of said photosensitive member due to the gravitational force of said image forming unit acting on said image forming unit is opposite to the direction of the torque on the axis of the photosensitive member due to the developer driving means, and the size of the torque due to the gravitational force of said image forming unit is smaller than the size of the torque due to the driving gear for the developer.

13. An image forming unit comprising a rotator, wherein the image forming unit is retained in a manner that it can be installed in or removed from an apparatus main body;

wherein a rotator support member on an apparatus main body side is coupled with at least one axial end portion of said rotator, which is positioned in an image forming position, in the axial direction of said rotator to position said rotator into a proper position in an apparatus main body; and wherein positioning of a rotational orientation of an axis of said rotator is performed with a rotation stop portion that is provided on the side of said apparatus main body and stops the rotation of said image forming units on a surface that is substantially parallel to a line connecting the axis of said rotator and a rotation stop position.

14. An image forming apparatus, comprising:

a plurality of image forming units having a rotator with flanges on both ends;

a unit retaining member, which retains said plurality of image forming units, and switches said plurality of image forming units by moving them successively between an image forming position and a waiting position;

an intermediate transfer member, which contacts the image forming unit positioned in the image forming position and successively accepts toner images of various colors from said image forming units, so as to form a colored toner image on its surface; and a positioning member for coupling with at least one of said flanges of said rotator by advancing and receding in an axial direction when being substantially coaxial with said rotator of the image forming unit that is positioned in the image forming position;

wherein a coupling part for coupling with said positioning member is provided at the center of end surfaces of said flanges;

wherein said coupling part is a concave tapered surface with a circular cross section having the axis of said rotator as a center axis;

a tip of said positioning member is a convex spherical surface, whose rotation center is the center axis.

15. The image forming apparatus according to claim 14, wherein said rotator is a photosensitive member or a developing roller.

16. The image forming apparatus according to claim 14, wherein the tip of the concave tapered surface at the coupling part contacting the positioning member during positioning and coupling is provided with a tapered surface with circular cross section, whose tip angle is larger than that of said concave tapered surface, and which is in close opposition to a tip of said positioning member.

17. The image forming apparatus according to claim 14, wherein the tip of the concave tapered surface at the coupling part contacting the positioning member during positioning and coupling is provided with a flat surface, which is in close opposition to a tip of said positioning member.

18. The image forming apparatus according to claim 14, wherein the positioning member is made of a conductive material and is electrically grounded;

wherein the flange coupling with said positioning member is made of an insulating material;

wherein a center of a coupling part of said flange is provided with a through hole connecting an inner portion of said rotator with an outer portion thereof; and wherein an electrode member is provided inside the through hole, which is retained while being biased in direction of said positioning member, and which establishes conduction between said rotator and said positioning member by contacting said positioning member.

19. The image forming apparatus according to claim 14, wherein the convex spherical tip of said positioning member is provided with a flat portion that is perpendicular to the rotation axis.

20. The image forming apparatus according to claim 14, further comprising:

a driving motor for generating a rotation force for said rotator; and a rotation transmission member provided in one piece with one positioning member, wherein transmission and disconnection of the rotation force is performed by substantially coaxial rotation with that rotator that is positioned in the image forming position, and advancing and receding in the axial direction of said rotator;

wherein the flange opposing said rotation transmission member has, on an end surface, a rotation follower portion to which a rotation force is transmitted when it contacts said rotation transmission member.

21. The image forming apparatus according to claim 20, wherein a contact portion for contact between said rotation transmission member and said rotation follower portion extends through a center of the convex spherical surface of the tip of said positioning member, and is at a position perpendicular to a rotation center axis of said rotation transmission member.

22. The image forming apparatus according to claim 21, wherein at least one of the contact faces where the rotation transmission member contacts the rotation follower portions is provided with a protrusion.

23. An image forming apparatus, comprising:

a plurality of image forming units having a rotator with flanges on both ends;

a unit retaining member, which retains said plurality of image forming units, and switches said plurality of image forming units by moving them successively between an image forming position and a waiting position;

an intermediate transfer member, which contacts the image forming unit positioned in the image forming position and successively accepts toner images of various colors from said image forming units, so as to form a colored toner image on its surface;

a positioning member for coupling at a coupling part at a center of an end surface of at least one of said flanges of said rotator by advancing and receding in an axial direction when being substantially coaxial with said rotator of the image forming unit that is positioned in the image forming position;

a driving motor for generating a rotation force for said rotator; and a rotation transmission member provided in one piece with one positioning member, for which transmission and disconnection of the rotation force is performed by substantially coaxial rotation with the rotator that is positioned in the image forming position, and advancing and receding in the axial direction of said rotator;

wherein an end surface of the flange opposing said rotation transmission member is provided with rotation follower portions made of a plurality of concave and convex portions; and wherein said rotation transmission member is provided with one transmission tongue for transmitting a rotation force by meshing with said rotation follower portions.

24. The image forming apparatus according to claim 23, wherein said rotator is a photosensitive member or a developing roller.

25. The image forming apparatus according to claim 23, wherein said rotation transmission member is provided with at least one protrusion portion of the same height as said transmission tongue;

wherein, during rotation, the at least one protrusion portion enters a concave portion of said rotation follower portions, but does not contact said rotation follower portions.

26. An image forming apparatus, comprising:

a plurality of image forming units having a rotator with flanges on both ends;

a unit retaining member, which retains said plurality of image forming units, and switches said plurality of image forming units by moving them successively between an image forming position and a waiting position;

an intermediate transfer member, which contacts the image forming unit positioned in the image forming position and successively accepts toner images of various colors from said image forming units, so as to form a colored toner image on its surface;

a positioning member for coupling at a coupling part at a center of an end surface of at least one of said flanges of said rotator by advancing and receding in an axial direction when being substantially coaxial with said rotator of the image forming unit that is positioned in the image forming position;

a driving motor for generating a rotation force for said rotator; and a rotation transmission member provided in one piece with one positioning member, for which transmission and disconnection of the rotation force is performed by substantially coaxial rotation with the rotator that is positioned in the image forming position, and advancing and receding in the axial direction of said rotator;

wherein an end surface of the flange opposing said rotation transmission member is provided with rotation follower portions made of a plurality of concave and convex portions;

wherein said rotation transmission member is provided with a transmission tongue for transmitting a rotation force by meshing with said rotation follower portions; and wherein, when a tip of said transmission tongue reaches a tip position of said rotation follower portions during the transition from a disconnected state to a connected state of the rotation force, said positioning member has advanced inside beyond an edge portion of the coupling part.

27. The image forming apparatus according to claim 26, wherein said rotator is a photosensitive member or a developing roller.

28. The image forming apparatus according to claim 26, wherein said coupling part comprises:

a concave tapered surface with circular cross section, which contacts said positioning member during positioning and coupling; and a tapered surface with circular cross section, which is provided at a tip of said concave tapered surface, and whose tip angle is greater than that of said concave tapered surface.

29. The image forming apparatus according to claim 26, wherein at least a tip of said transmission tongue of said rotation transmission member is movable in a axial direction with respect to said positioning member and biased toward said rotator.

30. The image forming apparatus according to claim 29, wherein said transmission tongue of said rotation transmission member is formed only in a portion in a rotation circumferential direction, and said rotation transmission member is retained rotatably with respect to said positioning member around a rotation shaft that is provided perpendicularly to the rotation center axis at a peripheral portion where said transmission tongue is not formed.

31. The image forming apparatus according to claim 30, wherein said rotation transmission member is provided with a posture defining means for defining a posture of the rotation orientation of said rotation transmission member.

32. The image forming apparatus according to claim 30, wherein the rotation shaft is provided at a position directly near an end surface of the flange that opposes said rotation transmission member during positioning and coupling.

33. The image forming apparatus according to claim 26, wherein a surface that opposes in a circumferential direction a surface where said transmission tongue and at least one of said rotation follower portions contact during rotation and driving is oblique in a circumferential direction.

34. The image forming apparatus according to claim 26, wherein, when a tip of said rotation transmission member reaches a tip position of said rotation follower portions while being moved toward said rotator, coupling between said positioning member and said coupling part is incomplete; and wherein at least one portion of the transmission tongue of said rotation transmission member is normally positioned between an outermost peripheral portion and an innermost peripheral portion of said rotation follower portions.

35. An image forming apparatus, comprising:

a plurality of image forming units having a rotator with flanges on both ends;

a unit retaining member, which retains said plurality of image forming units, and switches said plurality of image forming units by moving them successively between an image forming position and a waiting position;

an intermediate transfer member, which contacts the image forming unit positioned in the image forming position and successively accepts toner images of various colors from said image forming units, so as to form a colored toner image on its surface;

a driving motor for generating a rotation force for said rotator and said intermediate transfer member, which stops when said unit retaining member is being moved;

a detection means for detecting a reference position of said intermediate transfer member after said driving motor has started;

an exposure means for forming a latent image on said rotator, based on a detection signal from said detection means;

a rotation transmission member for which transmission and disconnection of the rotation force is performed by substantially coaxial rotation with the rotator that is positioned in the image forming position, and advancing and receding in the axial direction of said photosensitive member;

wherein an end surface of one of said flanges is provided in circumferential direction with rotation follower portions made of a plurality of concave and convex portions, which transmit a rotation force by meshing with said rotation transmission member;

wherein a pitch between neighboring concave and concave portions of said rotation follower portions is smaller than a rotation angle of said driving transmission member from the start of said driving motor until the generation of the detection signal.

36. The image forming apparatus according to claim 35, wherein said rotator is a photosensitive member or a developing roller.

37. The image forming apparatus according to claim 35, wherein a pitch between neighboring concave and concave portions of said rotation follower portions is smaller than a rotation angle of said driving transmission member from the start of said driving motor until the acceleration of said driving motor to a predetermined speed.

38. An image forming unit comprising a rotator with flanges on both ends, which can be installed in and removed from an image forming apparatus comprising:

a unit retaining member, which retains a plurality of image forming units, and switches said plurality of image forming units by moving them successively between an image forming position and a waiting position;

an intermediate transfer member, which contacts the image forming unit positioned in the image forming position and successively accepts toner images of various colors from said image forming units, so as to form a colored toner image on its surface; and a positioning member for coupling with at least one of said flanges of said rotator by advancing and receding in the axial direction when being substantially coaxial with said rotator of the image forming unit that is positioned in the image forming position, the tip of the positioning member being a convex spherical surface whose rotation center is the center axis;

wherein a coupling part for coupling with said positioning member of said image forming apparatus is provided at the center of an end surface of said flanges; and wherein said coupling part is a concave tapered surface with a circular cross section having the axis of said rotator as a center axis.

39. The image forming unit according to claim 38, wherein said rotator is a photosensitive member or a developing roller.

40. The image forming unit according to claim 38, wherein the tip of the concave tapered surface at the coupling part contacting the positioning member of the image forming apparatus during positioning and coupling is provided with a tapered surface with circular cross section, whose tip angle is larger than that of said concave tapered surface, and which is in close opposition to a tip of said positioning member.

41. The image forming unit according to claim 38, wherein the tip of the concave tapered surface at the coupling part contacting the positioning member of the image forming apparatus during positioning and coupling is provided with a flat surface, which is in close opposition to a tip of said positioning member.

42. The image forming unit according to claim 38, wherein the flange is made of an insulating material;

wherein a center of a coupling part of said flange is provided with a through hole connecting an inner portion of said rotator with an outer portion thereof; and wherein an electrode member is provided inside the through hole, which is retained while being biased in direction of the positioning member of the image forming apparatus, and which establishes conduction between said rotator and said positioning member by contacting said positioning member.

43. The image forming unit according to claim 38, wherein the image forming apparatus further comprises:

a driving motor for generating a rotation force for said rotator; and a rotation transmission member provided in one piece with one positioning member, wherein transmission and disconnection of the rotation force is performed by substantially coaxial rotation with the rotator that is positioned in the image forming position, and advancing and receding in the axial direction of said rotator;

wherein the flange opposing said rotation transmission member has, on an end surface, a rotation follower portion to which a rotation force is transmitted when it contacts said rotation transmission member.

44. The image forming unit according to claim 43, wherein the contact portion between said rotation transmission member and said rotation follower portion goes through a center of the convex spherical portion of the tip of said positioning member at a coupling position, and is at a position perpendicular to a rotation center axis of said rotation transmission member.

45. The image forming unit according to claim 44, wherein at least one of the contact faces where the rotation transmission member contacts the rotation follower portions is provided with a protrusion.

46. An image forming unit comprising a rotator with flanges on both ends, which can be installed in and removed from an image forming apparatus comprising:

a unit retaining member, which retains a plurality of image forming units, and switches said plurality of image forming units by moving them successively between an image forming position and a waiting position;

an intermediate transfer member, which contacts the image forming unit positioned in the image forming position and successively accepts toner images of various colors from said image forming units, so as to form a colored toner image on its surface;

a positioning member for coupling with at least one of said flanges of said rotator by advancing and receding in an axial direction when being substantially coaxial with said rotator of the image forming unit that is positioned in the image forming position;

a driving motor for generating a rotation force for said rotator; and a rotation transmission member provided in one piece with one positioning member, and which has a transmission tongue for performing transmission and disconnection of the rotation force by substantially coaxial rotation with the rotator that is positioned in the image forming position, and advancing and receding in an axial direction of said rotator;

wherein a coupling part for coupling with the positioning member of the image forming apparatus is provided at the center of an end surface of said flanges;

wherein an end surface of the flange that opposes the rotation transmission member is provided with rotation follower portions made of a plurality of concave and convex portions; and wherein, when a tip of said transmission tongue reaches a tip position of said rotation follower portions during the transition from a disconnected state to a transmission state of the rotation force, said positioning member has advanced inside beyond an edge portion of said coupling part.

47. The image forming unit according to claim 46, wherein said rotator is a photosensitive member or a developing roller.

48. The image forming unit according to claim 46, wherein said coupling part comprises:

a concave tapered surface with circular cross section, which contacts said positioning member during positioning and coupling; and a tapered surface with circular cross section, which is provided at the tip of said concave tapered surface, and whose tip angle is greater than that of said concave tapered surface.

49. The image forming unit according to claim 46, wherein a surface that opposes in a circumferential direction a surface of the rotation follower portion that contacts said transmission tongue during rotation and driving is oblique in a circumferential direction.

50. The image forming apparatus unit to claim 46, wherein, when a tip of said transmission tongue reaches a tip position of said rotation follower portions while being moved toward said rotator, coupling between said positioning member and said coupling part is incomplete; and wherein at least one portion of the transmission tongue of said rotation transmission member is normally positioned between an outermost peripheral portion and an innermost peripheral portion of said rotation follower portions.

51. An image forming unit comprising a rotator with flanges on both ends, which can be installed in and removed from an image forming apparatus comprising:

a unit retaining member, which retains said plurality of image forming units, and switches said plurality of image forming units by moving them successively between an image forming position and a waiting position;

an intermediate transfer member, which contacts the image forming unit positioned in the image forming position and successively accepts toner images of various colors from said image forming units, so as to form a colored toner image on its surface;

a driving motor for generating a rotation force for said rotator and said intermediate transfer member, which stops when said unit retaining member is being moved;

a detection means for detecting a reference position of said intermediate transfer member after said driving motor has started;

an exposure means for forming a latent image on said image forming unit, based on a detection signal from said detection means;

a rotation transmission member for which transmission and disconnection of the rotation force is performed by substantially coaxial rotation with the rotator that is positioned in the image forming position, and advancing and receding in the axial direction of said photosensitive member;

wherein an end surface of one of said flanges is provided in circumferential direction with rotation follower portions made of a plurality of concave and convex portions, which transmit a rotation force by meshing with said rotation transmission member;

wherein a pitch between neighboring concave and concave portions of said rotation follower portions is smaller than a rotation angle of said driving transmission member from the start of said driving motor until the generation of the detection signal.

52. The image forming apparatus according to claim 51, wherein said rotator is a photosensitive member or a developing roller.

53. The image forming apparatus according to claim 51, wherein a pitch between neighboring concave and concave portions of said rotation follower portions is smaller than a rotation angle of said driving transmission member from the start of said driving motor until the acceleration of said driving motor to a predetermined speed.

54. An image forming apparatus, comprising:

a plurality of image forming units having a rotator, image forming unit conveying means for switching said plurality of image forming units by moving them successively between an image forming position and a waiting position;

a rotator support member for positioning the rotator that is in the image forming position into a proper position in an apparatus main body by coupling with at least one axial end portion of said rotator in an axial direction of said rotator and supporting said image forming units in a freely rotatable manner; and a rotation stop portion for positioning the rotational orientation of an axis of said rotator of said image forming units;

a developer and a developer driving means for driving said developer;

wherein said rotator is a photosensitive member and said rotation stop portion stops the rotation of said image forming units on a surface that is substantially parallel to a direction of a driving force exerted by said developer driving means.

55. An image forming apparatus, comprising:

a plurality of image forming units having a rotator, image forming unit conveying means for switching said plurality of image forming units by moving them successively between an image forming position and a waiting position;

a rotator support member for positioning the rotator that is in the image forming position into a proper position in an apparatus main body by coupling with at least one axial end portion of said rotator in an axial direction of said rotator and supporting said image forming units in a freely rotatable manner;

a rotation stop portion for positioning the rotational orientation of an axis of said rotator of said image forming units; and a developer, a developer driving means for driving said developer, and a photosensitive member driving means for driving said photosensitive member;

wherein said rotator is a photosensitive member;

wherein at the time of image formation, said developer driving means starts to drive said developer after said photosensitive member driving means has started to drive said photosensitive member.

56. An image forming apparatus, comprising:

a plurality of image forming units having a rotator, image forming unit conveying means for switching said plurality of image forming units by moving them successively between an image forming position and a waiting position;

a rotator support member for positioning the rotator that is in the image forming position into a proper position in an apparatus main body by coupling with at least one axial end portion of said rotator in an axial direction of said rotator and supporting said image forming units in a freely rotatable manner;

a rotation stop portion for positioning the rotational orientation of an axis of said rotator of said image forming units; and a thrust stop portion for positioning the axial direction of said rotator of said image forming units, which is provided near the axis of said rotator.

57. An image forming apparatus, comprising:

a plurality of image forming units having a rotator, image forming unit conveying means for switching said plurality of image forming units by moving them successively between an image forming position and a waiting position;

a rotator support member for positioning the rotator that is in the image forming position into a proper position in an apparatus main body by coupling with at least one axial end portion of said rotator in an axial direction of said rotator and supporting said image forming units in a freely rotatable manner;

a rotation stop portion for positioning the rotational orientation of an axis of said rotator of said image forming units; and a developer, a developer driving means for driving said developer, and a photosensitive member driving means for driving said photosensitive member;

wherein said rotator is a photosensitive member;

wherein the direction of the torque on the axis of said photosensitive member due to the gravitational force of said image forming unit acting on said image forming unit is opposite to the direction of the torque on the axis of the photosensitive member due to the developer driving means, and the size of the torque due to the gravitational force of said image forming unit is smaller than the size of the torque due to the driving gear for the developer.

* * * * *

UNITED STATES PATENT AND TRADEMARK OFFICE

CERTIFICATE OF CORRECTION

PATENT NO. : 6,546,220 B1
DATED : April 8, 2003
INVENTOR(S) : Asakura et al.

It is certified that error appears in the above-identified patent and that said Letters Patent is hereby corrected as shown below:

Column 62,
Line 44, "unit to" should read -- unit according to --

Signed and Sealed this

Thirtieth Day of December, 2003

JAMES E. ROGAN
*Director of the United States Patent and Trademark Office*